US006021388A

United States Patent [19]

Otsuka et al.

[11] Patent Number: 6,021,388

[45] Date of Patent: Feb. 1, 2000

[54] SPEECH SYNTHESIS APPARATUS AND METHOD

[75] Inventors: Mitsuru Otsuka, Iwatsuki; Yasunori Ohora, Yokohama; Takashi Aso, Yokohama; Yasuo Okutani, Yokohama, all of Japan

[73] Assignee: Canon Kabushiki Kaisha, Tokyo, Japan

[21] Appl. No.: 08/995,152

[22] Filed: Dec. 19, 1997

[30] Foreign Application Priority Data

Dec. 26, 1996 [JP] Japan ..... 8-348439

[51] Int. Cl.[7] ..... G10L 7/02

[52] U.S. Cl. ..... 704/268; 704/269

[58] Field of Search ..... 704/258, 264, 704/267, 268, 269, 265

[56] References Cited

U.S. PATENT DOCUMENTS

| | | | |
|---|---|---|---|
| 5,220,629 | 6/1993 | Kosaka et al. | 704/260 |
| 5,381,514 | 1/1995 | Aso et al. | 704/264 |
| 5,633,984 | 5/1997 | Aso et al. | 704/260 |
| 5,682,502 | 10/1997 | Ohtsuka et al. | 704/267 |
| 5,745,650 | 4/1998 | Otsuka et al. | 704/268 |
| 5,745,651 | 4/1998 | Ohtsuka et al. | 704/268 |
| 5,787,396 | 7/1998 | Komori et al. | 704/256 |
| 5,797,116 | 8/1998 | Yamada et al. | 704/251 |
| 5,812,975 | 9/1998 | Komori et al. | 704/256 |

FOREIGN PATENT DOCUMENTS 0 685 834 12/1995 European Pat. Off. .

OTHER PUBLICATIONS

Takayuki Nakajima, et al., Power Spectrum Envelope (PSE) Speech Analysis–synthesis System, *Journal of Acoustic Society of Japan,* vol. 44, No. 11, (1988), pp. 824–832.

*Primary Examiner*—David R. Hudspeth
*Assistant Examiner*—Martin Lerner
*Attorney, Agent, or Firm*—Fitzpatrick, Cella, Harper & Scinto

[57] ABSTRACT

A speech synthesis apparatus for outputting synthesized speech on the basis of a parameter sequence of a speech waveform includes a parameter generation unit which generates a parameter sequence for speech synthesis on the basis of a character sequence input by a character sequence input unit, and stores the generated parameter sequence in a parameter storage unit. A waveform generation unit is also provided that generates pitch waveforms each for one pitch period on the basis of synthesis parameters and pitch scales included in the parameter sequence, and generates a speech waveform by connecting the generated pitch waveforms in accordance with frame lengths set by a frame length setting unit.

63 Claims, 24 Drawing Sheets

$$\theta = 2\pi / N_p(f)$$

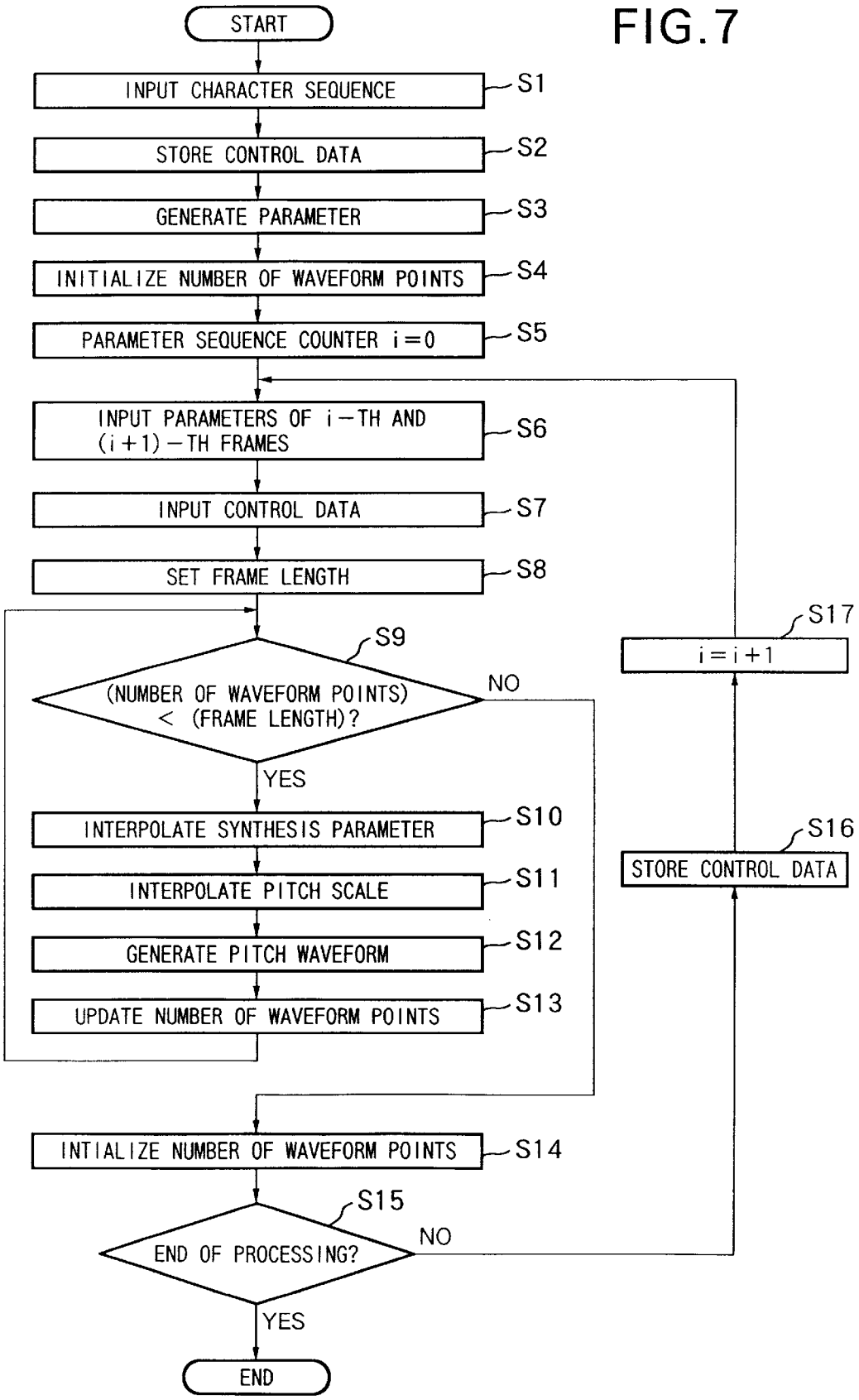
FIG.7
START
INPUT CHARACTER SEQUENCE
S1
STORE CONTROL DATA
S2
GENERATE PARAMETER
S3
INITIALIZE NUMBER OF WAVEFORM POINTS
S4
PARAMETER SEQUENCE COUNTER i=0
S5
INPUT PARAMETERS OF i-TH AND (i+1)-TH FRAMES
S6
INPUT CONTROL DATA
S7
SET FRAME LENGTH
S8
S9
(NUMBER OF WAVEFORM POINTS) < (FRAME LENGTH)?
NO
YES
INTERPOLATE SYNTHESIS PARAMETER
S10
INTERPOLATE PITCH SCALE
S11
GENERATE PITCH WAVEFORM
S12
UPDATE NUMBER OF WAVEFORM POINTS
S13
INTIALIZE NUMBER OF WAVEFORM POINTS
S14
S15
END OF PROCESSING?
NO
YES
END
S16
STORE CONTROL DATA
S17
i=i+1

FIG.8

DATA STRUCTURE OF PARAMETERS FOR ONE FRAME

| | |
|---|---|
| K | ARTICULATING SPEED COEFFICIENT |
| s | PITCH SCALE |
| p[0]~p[M−1] | SYNTHESIS PARAMETER |

$$\Delta p(m) = \{p_{i+1}(m) - p_i(m)\} / N_i$$
$$p(m) = p_i(m) + n_w \Delta p(m)$$

$\Delta s = (s_{i+1} - s_i) / N_i$ $s = s_i + n_w \Delta s$

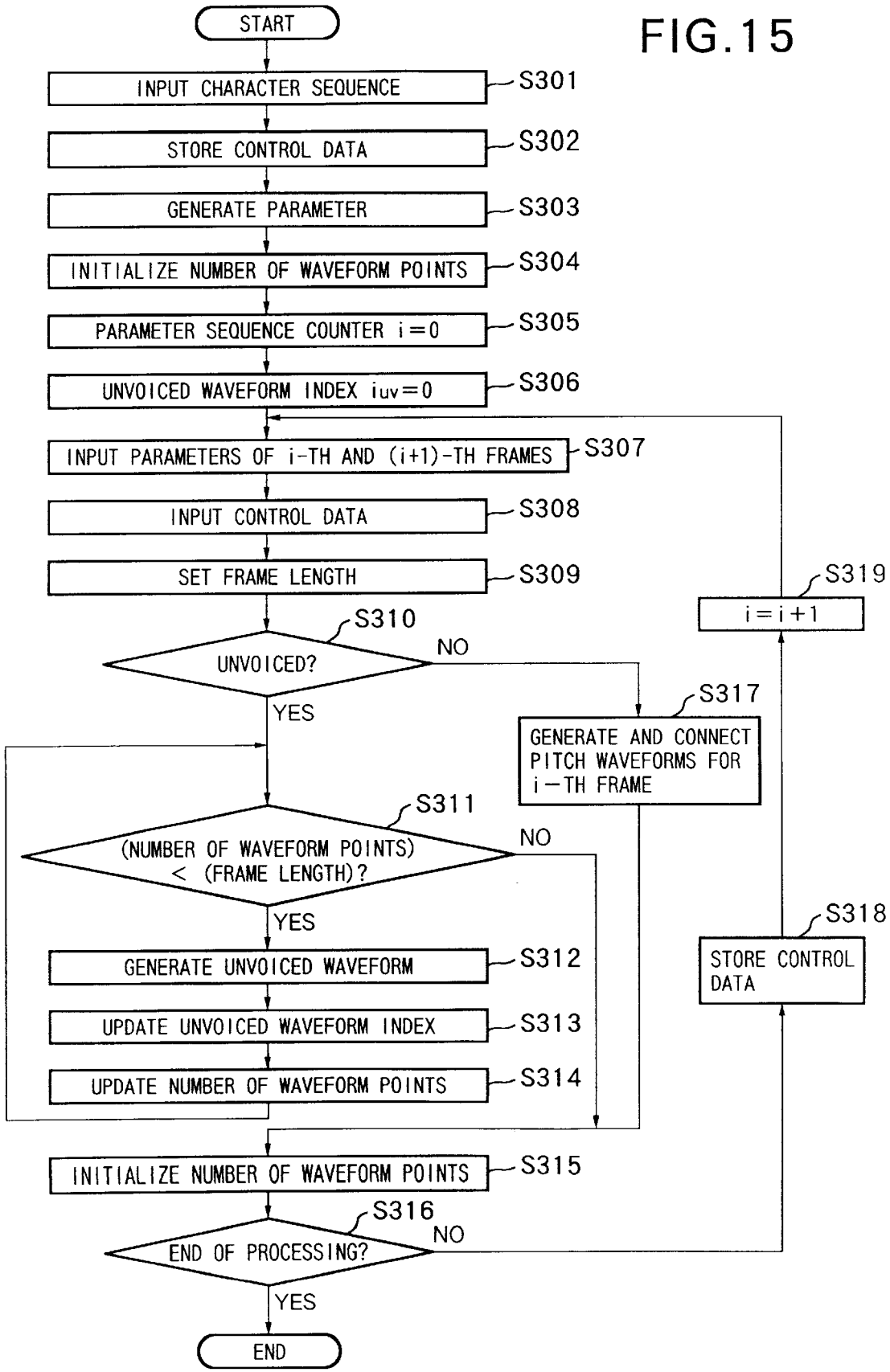
FIG.15
START
INPUT CHARACTER SEQUENCE
S301
STORE CONTROL DATA
S302
GENERATE PARAMETER
S303
INITIALIZE NUMBER OF WAVEFORM POINTS
S304
PARAMETER SEQUENCE COUNTER i=0
S305
UNVOICED WAVEFORM INDEX iuv=0
S306
INPUT PARAMETERS OF i-TH AND (i+1)-TH FRAMES
S307
INPUT CONTROL DATA
S308
SET FRAME LENGTH
S309
S310
UNVOICED?
NO
YES
S317
GENERATE AND CONNECT PITCH WAVEFORMS FOR i-TH FRAME
S311
(NUMBER OF WAVEFORM POINTS) < (FRAME LENGTH)?
NO
YES
GENERATE UNVOICED WAVEFORM
S312
UPDATE UNVOICED WAVEFORM INDEX
S313
UPDATE NUMBER OF WAVEFORM POINTS
S314
INITIALIZE NUMBER OF WAVEFORM POINTS
S315
S316
END OF PROCESSING?
NO
YES
END
S319
i=i+1
S318
STORE CONTROL DATA

FIG.16

DATA STRUCTURE OF PARAMETERS FOR ONE FRAME

| | |
|---|---|
| K | ARTICULARTING SPEED COEFFICIENT |
| uvflag | VOICED／UNVOICED INFORMATION |
| s | PITCH SCALE |
| p[0]～p[M－1] | SYNTHESIS PARAMETER |

SPEECH SYNTHESIS APPARATUS AND METHOD

BACKGROUND OF THE INVENTION

The present invention relates to a speech synthesis method and apparatus based on a ruled synthesis scheme.

In general, in a ruled speech synthesis apparatus, synthesized speech is generated using one of a synthesis filter scheme (PARCOR, LSP, MLSA), a waveform edit scheme, and an impulse response waveform overlap-add scheme (Takayuki Nakajima & Torazo Suzuki, "Power Spectrum Envelope (PSE) Speech Analysis Synthesis System", *Journal of Acoustic Society of Japan,* Vol. 44, No. 11 (1988), pp. 824–832).

However, the above-mentioned schemes suffer the following shortcomings. The synthesis filter scheme requires a large volume of calculations, upon generating a speech waveform, and a delay in completing the calculations deteriorates the sound quality of synthesized speech. The waveform edit scheme requires a complicated waveform editing in correspondence with the pitch of synthesized speech, and hardly attains proper waveform editing, thus deteriorating the sound quality of synthesized speech. Furthermore, the impulse response waveform superposing scheme results in poor sound quality in waveform superposed portions.

SUMMARY OF THE INVENTION

The present invention has been made in consideration of the above situation, and has as its object to provide a speech synthesis method and apparatus, which suffers less deterioration of sound quality.

In order to achieve the above object, according to the present invention, there is provided a speech synthesis apparatus for outputting synthesized speech on the basis of a parameter sequence of a speech waveform, comprising:

pitch waveform generation means for generating pitch waveforms on the basis of waveform and pitch parameters included in the parameter sequence used in speech synthesis; and speech waveform generation means for generating a speech waveform by connecting the pitch waveforms generated by the pitch waveform generation means.

In order to achieve the above object, according to the present invention, there is also provided a speech synthesis method for outputting synthesized speech on the basis of a parameter sequence of a speech waveform, comprising:

a pitch waveform generation step of generating pitch waveforms on the basis of waveform and pitch parameters included in the parameter sequence used in speech synthesis; and a speech waveform generation step of generating a speech waveform by connecting the pitch waveforms generated in the pitch waveform generation step.

Other features and advantages of the present invention will be apparent from the following descriptions taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the descriptions, serve to explain the principle of the invention.

FIG. 7 is a flow chart showing the speech synthesis procedure according to the first embodiment;

FIG. 8 shows the data structure of parameters for one frame;

FIG. 15 is a flow chart showing the speech synthesis procedure according to the third embodiment;

FIG. 16 shows the data structure of parameters for one frame according to the third embodiment;

DETAILED DESCRIPTION OF THE PREFERRED EMBODIMENTS

Preferred embodiments of the present invention will now be described in detail in accordance with the accompanying drawings.

[First Embodiment]

Figure 22:
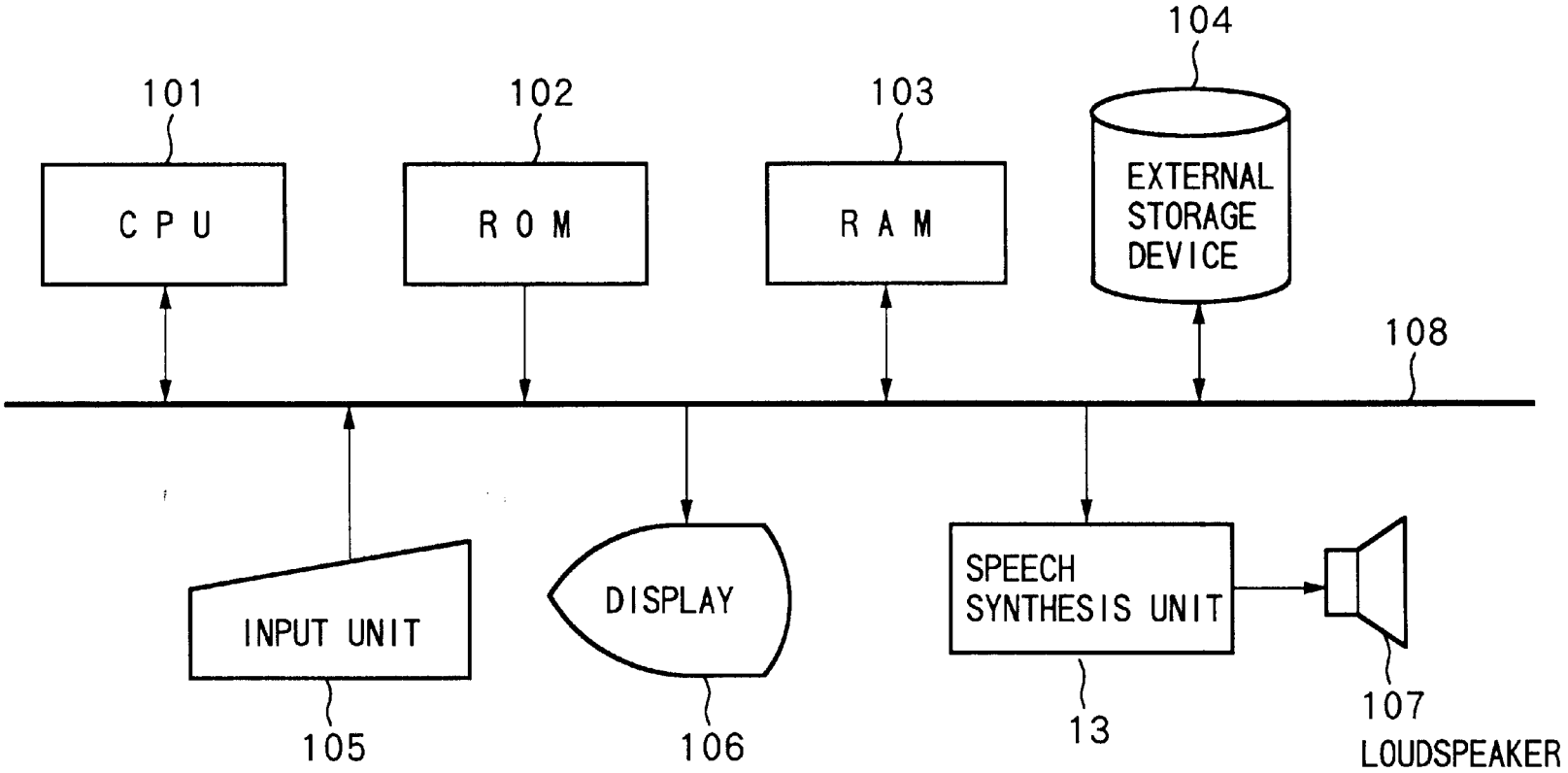
FIG. 22 is a block diagram showing the arrangement of an apparatus for speech synthesis by rule according to an embodiment of the present invention.

FIG. 22 is a block diagram showing the arrangement of an apparatus for speech synthesis by rule according to an embodiment of the present invention. In FIG. 22, reference numeral 101 denotes a CPU for performing various kinds of control in the apparatus for speech synthesis by rule of this embodiment. Reference numeral 102 denotes a ROM which stores various parameters and a control program to be executed by the CPU 101. Reference numeral 103 denotes a RAM which stores a control program to be executed by the CPU 101 and provides a work area of the CPU 101. Reference numeral 104 denotes an external storage device such as a hard disk, floppy disk, CD-ROM, or the like.

Reference numeral 105 denotes an input unit which comprises a keyboard, a mouse, and the like. Reference numeral 106 denotes a display for making various kinds of display under the control of the CPU 101. Reference numeral 13 denotes a speech synthesis unit for generating a speech output signal on the basis of parameters generated by ruled speech synthesis (to be described later). Reference numeral 107 denotes a loudspeaker which reproduces the speech output signal output from the speech synthesis unit 13. Reference numeral 108 denotes a bus which connects the above-mentioned blocks to allow them to exchange data.

Figure 1:
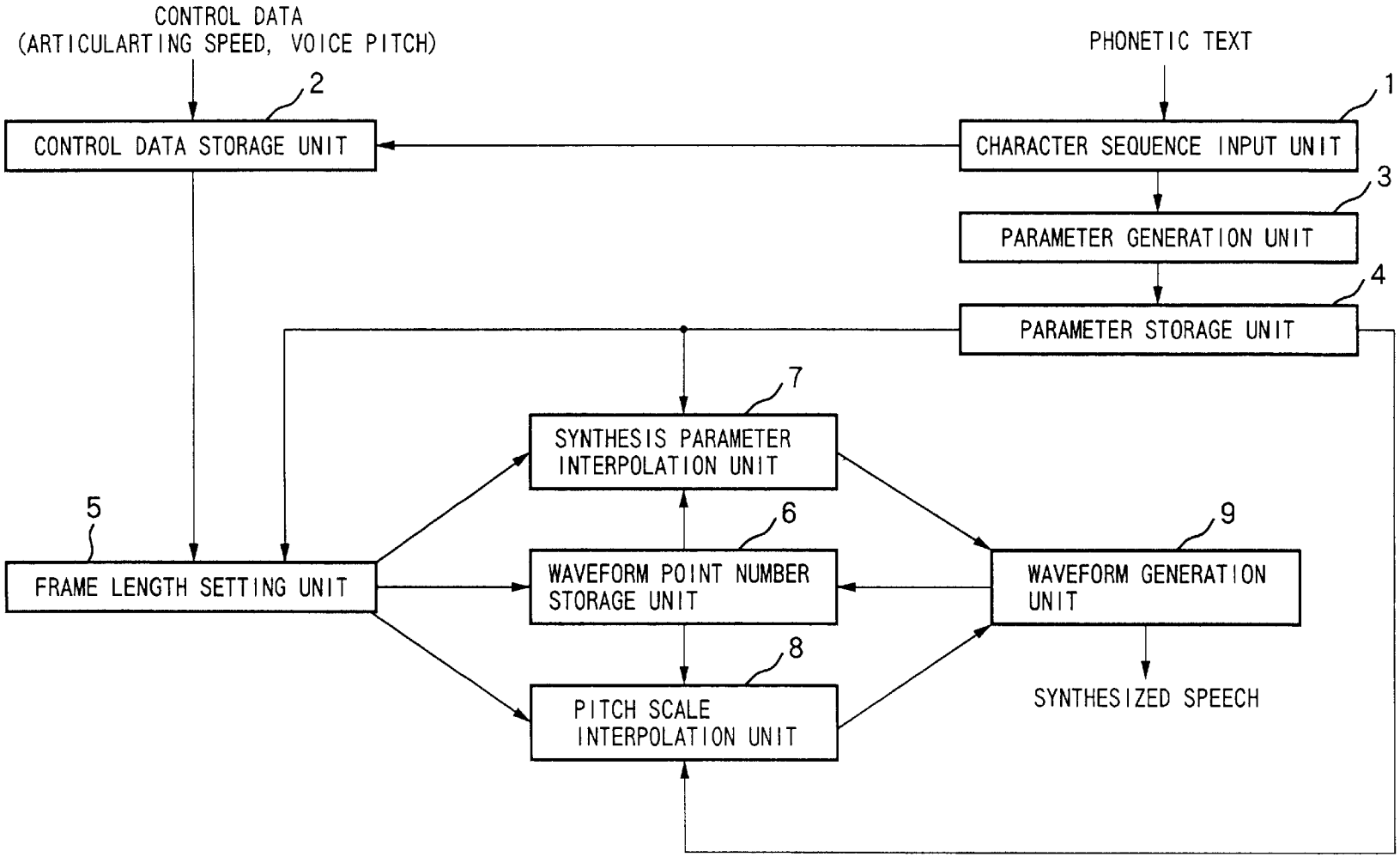
FIG. 1 is a block diagram showing the functional arrangement of a speech synthesis apparatus according to an embodiment of the present invention.

FIG. 1 is a block diagram showing the functional arrangement of a speech synthesis apparatus according to this embodiment. The functional blocks to be described below are functions implemented when the CPU 101 executes the control program stored in the ROM 102 or the control program loaded from the external storage device 104 and stored in the RAM 103.

Reference numeral 1 denotes a character sequence input unit which inputs a character sequence of speech to be synthesized. For example, when the speech to be synthesized is "あいうえお (aiueo)", a character sequence "AIUEO" is input from the input unit 105. The character sequence may include a control sequence for setting the articulating speed, the voice pitch, and the like. Reference numeral 2 denotes a control data storage unit which stores information, which is determined to be the control sequence in the character sequence input unit 1, and control data such as the articulating speed, the voice pitch, and the like input from a user interface in its internal register.

Reference numeral 3 denotes a parameter generation unit for generating a parameter sequence corresponding to the character sequence input by the character sequence input unit 1. Each parameter sequence is made up of one or a plurality of frames, each of which stores parameters for generating a speech waveform.

Reference numeral 4 denotes a parameter storage unit for extracting parameters for generating a speech waveform from the parameter sequence generated by the parameter generation unit 3, and storing the extracted parameters in its internal register. Reference numeral 5 denotes a frame length setting unit for calculating the length of each frame on the basis of the control data stored in the control data storage unit 2 and associated with the articulating speed, and a articulating speed coefficient (a parameter used for determining the length of each frame in correspondence with the articulating speed) stored in the parameter storage unit 4.

Reference numeral 6 denotes a waveform point number storage unit for calculating the number of waveform points per frame, and storing it in its internal register. Reference numeral 7 denotes a synthesis parameter interpolation unit for interpolating the synthesis parameters stored in the parameter storage unit 4 on the basis of the frame length set by the frame length setting unit 5 and the number of waveform points stored in the waveform point number storage unit 6. Reference numeral 8 denotes a pitch scale interpolation unit for interpolating a pitch scale stored in the parameter storage unit 4 on the basis of the frame length set by the frame length setting unit 5 and the number of waveform points stored in the waveform point number storage unit 6.

Reference numeral 9 denotes a waveform generation unit for generating pitch waveforms on the basis of the synthesis parameters interpolated by the synthesis parameter interpolation unit 7 and the pitch scale interpolated by the pitch scale interpolation unit 8, and connecting the pitch waveforms to output synthesized speech. Note that the individual internal registers in the above description are areas assured on the RAM 103.

Pitch waveform generation done by the waveform generation unit 9 will be described below with reference to FIGS. 2A to 2C, and FIGS. 3, 4, 5, and 6.

Figure 2A:
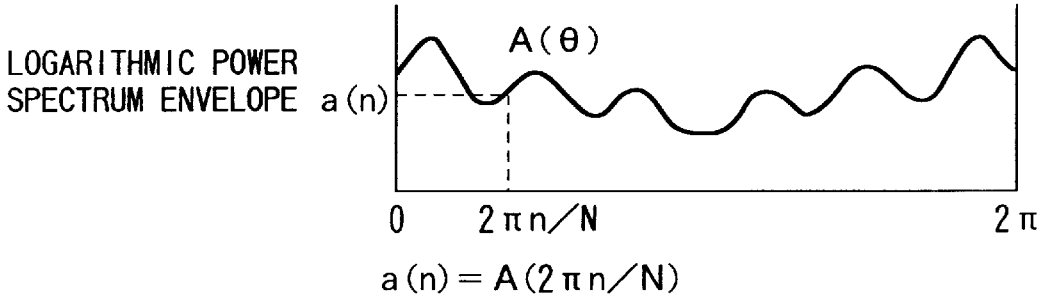
FIG. 2A is a graph showing an example of a logarithmic power spectrum envelope of speech.
Figure 2B:
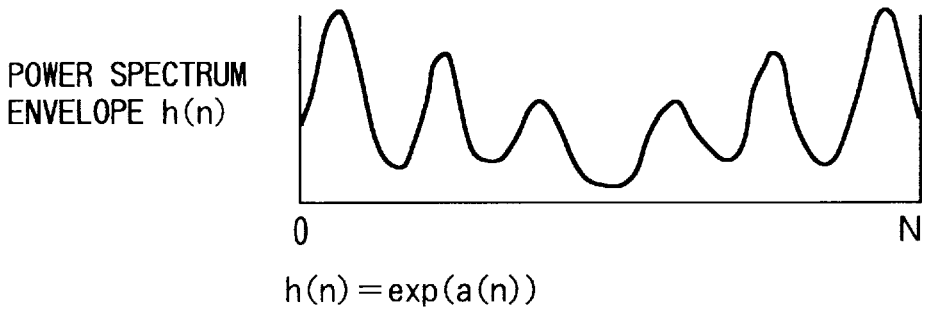
FIG. 2B is a graph showing a power spectrum envelope obtained based on the logarithmic power spectrum envelope shown in FIG. 2A.
Figure 2C:
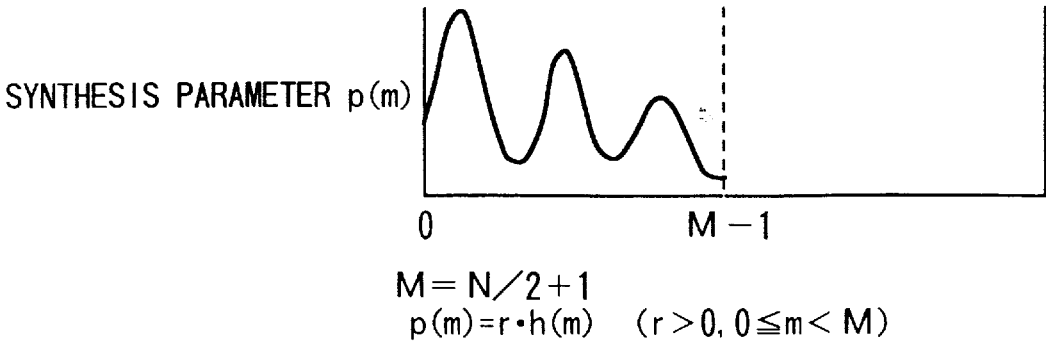
FIG. 2C is a graph for explaining a synthesis parameter p(m)

The synthesis parameters used in pitch waveform generation will first be explained. FIG. 2A shows an example of a logarithmic power spectrum envelope of speech. FIG. 2B shows a power spectrum envelope obtained based on the logarithmic power spectrum envelope shown in FIG. 2A. FIG. 2C is a graph for explaining a synthesis parameter p(m).

In FIG. 2A, let N be the order of the Fourier transform, and M be the order of the synthesis parameter. Note that N and M are determined to satisfy N=2(M−1). In this case, using a function A(θ) a logarithmic power spectrum envelope a(n) of speech is given by:

$$a(n) = A\left(\frac{2\pi n}{N}\right) \quad (0 \le n < N) \tag{1}$$

When the logarithmic power spectrum envelope given by equation (1) above is transformed back into a linear one and inputted into an exponential function, as shown in equation (2) below, an envelope shown in FIG. 2B is obtained:

$$h(n)=\exp(a(k)) \quad (0 \leqq n < N) \tag{2}$$

The synthesis parameter p(m) (0≦m<M) uses values ranging from frequency=0 of the power spectrum envelope to the value ½ the sampling frequency, and is given by equation (3) below by letting r>0. FIG. 2C shows the synthesis parameter p(m).

$$p(m)=r \cdot h(m) \quad (0 \leqq m < M) \tag{3}$$

Figure 3:
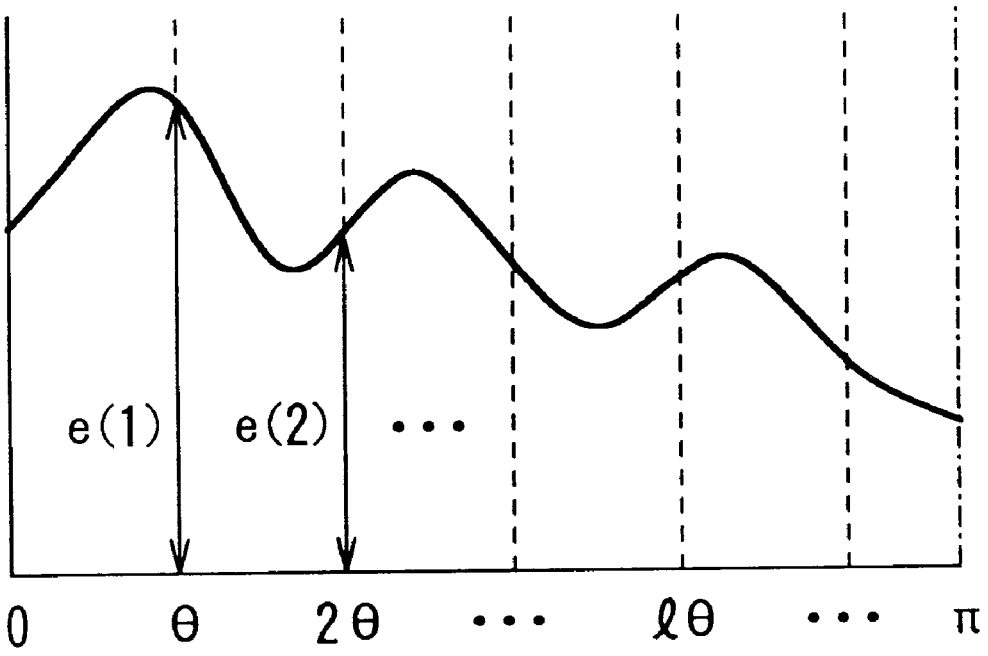
FIG. 3 is a graph for explaining sampling of the spectrum envelope.

On the other hand, if $f_s$ represents the sampling frequency, a sampling period $T_s$ is expressed by $T_s=1/f_s$. Similarly, if f represents the pitch frequency of synthesized speech, a pitch period T is expressed by T=1/f. When signals having the pitch period T are sampled at the sampling period $T_s$, the number $N_p(f)$ of samples (to be referred to as the number of pitch period points hereinafter) is given by equation (4-1)

below. Furthermore, if [x] represents a maximum integer equal to or smaller than x, the number $N_p(f)$ of pitch period points quantized by an integer is given by the following equation (4-2):

$$N_p(f) = f_s T = \frac{T}{T_s} = \frac{f_s}{f} \tag{4-1}$$

$$N_p(f) = \left[\frac{f_s}{f}\right] \tag{4-2}$$

which corresponds to an angle $2\pi$. Then, the angle $\theta$ is as shown in FIG. 3, and is expressed by equation (5) below. Note that FIG. 3 shows sampling of the spectrum envelope at every angle $\theta$.

$$\theta = \frac{2\pi}{N_p(f)} \tag{5}$$

Let t be a row index, and u be a column index. Then, a matrix Q and its inverse matrix are defined by:

$$Q = (q(t, u)) \quad (0 \le t < M, 0 \le u < M) \tag{6-1}$$

$$(t, u) = \cos\left(tu2\frac{\pi}{N}\right) \tag{6-2}$$

$$Q^{-1} = (q_{inv}(t, u)) \quad (0 \le t < M, 0 \le u < M) \tag{6-3}$$

Using $q_{inv}$ given by equation (6-3) above, the values of the spectrum envelope corresponding to integer multiples of the pitch frequency can be expressed by equation (7-1) or (7-2) below. In other words, sample values e(1), e(2), . . . of the spectrum envelope shown in FIG. 3 can be expressed by equation (7-1) or (7-2) below. Rewriting, equation (7-1) yields equation (7-2).

$$e(l) = \sum_{t=0}^{M-1} \cos(tl\theta) \sum_{m=0}^{M-1} q_{inv}(t, m)p(m) \quad (1 \le l \le [N_p(f)/2]) \tag{7-1}$$

$$e(l) = \sum_{m=0}^{M-1} p(m) \sum_{t=0}^{M-1} \cos(tl\theta) q_{inv}(t, m) \quad (1 \le l \le [N_p(f)/2]) \tag{7-2}$$

Let w(k) ($0 \leqq k < N_p(f)$) be the pitch waveform, and C(f) be a power normalization coefficient corresponding to the pitch frequency f. Then, the power normalization coefficient C(f) is given by equation (8) below using a pitch frequency $f_0$ that yields C(f)=1.0:

$$C(f) = \sqrt{\frac{f}{f_0}} \tag{8}$$

Figure 4:
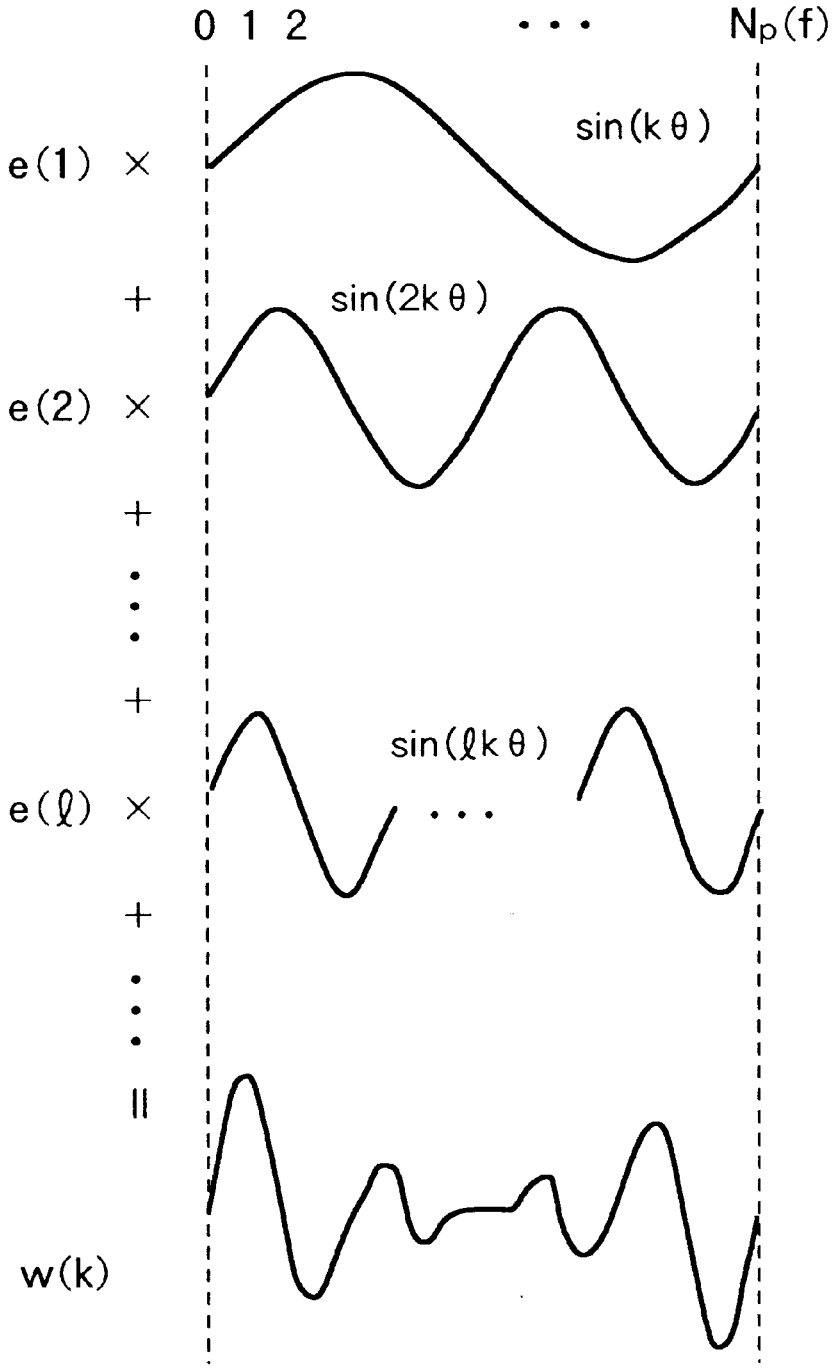
FIG. 4 is a chart showing the generation process of a pitch waveform w(k) by superposing sine waves corresponding to integer multiples of the fundamental frequency.

The pitch waveform w(k) is generated by superposing sine waves corresponding to integer multiples of the fundamental frequency, as shown in FIG. 4, and is expressed by equations (9-1) to (9-3) below. Rewriting equation (9-2) yields equation (9-3).

$$w(k) = C(f) \sum_{l=1}^{[N_p(f)/2]} e(l)\sin(lk\theta) \tag{9-1}$$

$$w(k) = C(f) \sum_{l=1}^{[N_p(f)/2]} \sin(lk\theta) \sum_{m=0}^{M-1} p(m) \sum_{t=0}^{M-1} \cos(tl\theta) q_{inv}(t, m) \tag{9-2}$$

$$w(k) = C(f) \sum_{m=0}^{M-1} p(m) \sum_{l=0}^{[N_p(f)/2]} \sin(lk\theta) \sum_{t=0}^{M-1} \cos(tl\theta) q_{inv}(t, m) \tag{9-3}$$

Figure 5:
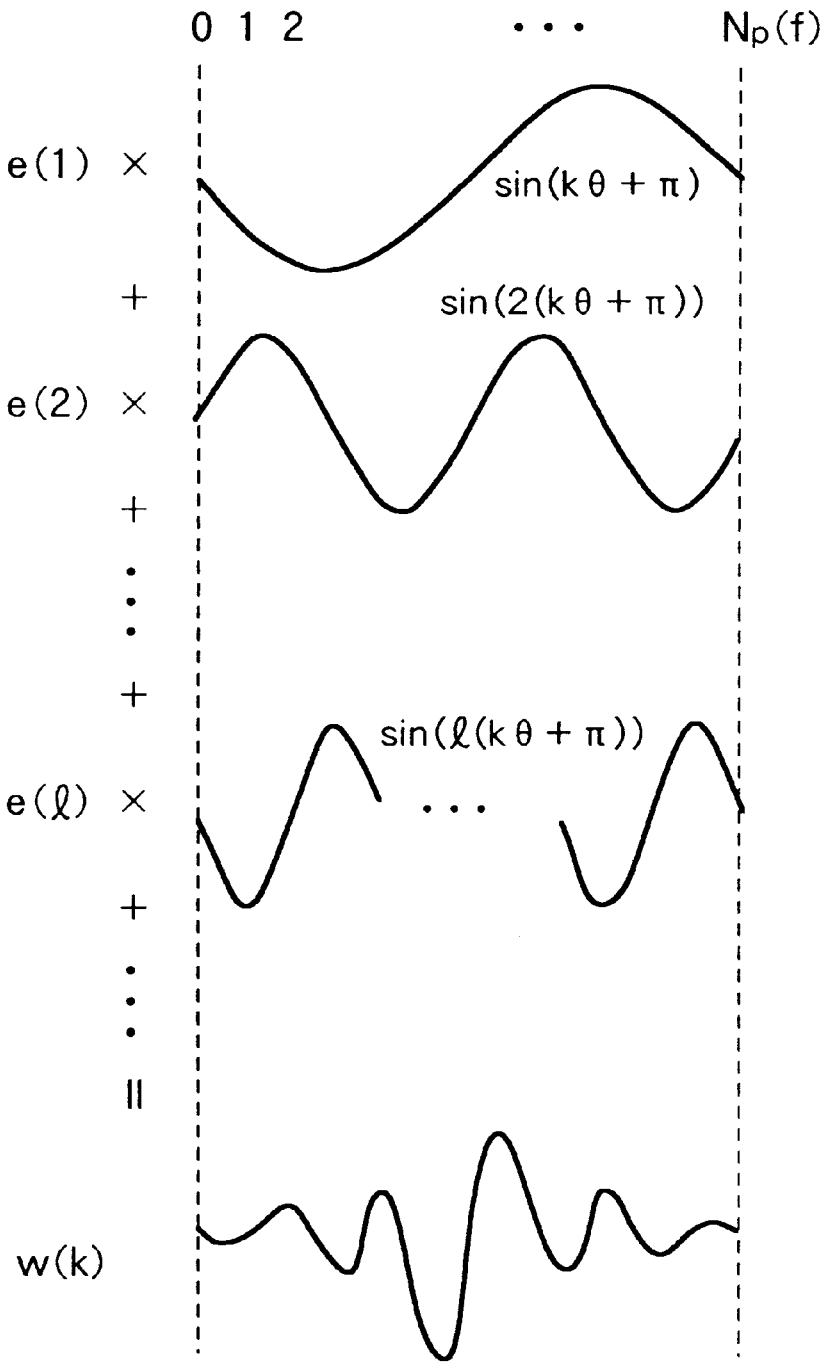
FIG. 5 is a chart showing the generation process of the pitch waveform w(k) by superposing sine waves whose phases are shifted by $\pi$ from those in FIG. 4.

Alternatively, as shown in FIG. 5, by superposing sine waves while shifting their phases by $\pi$, as shown in FIG. 5, the pitch waveform can also be expressed by equations (10-1) to (10-3) below. Rewriting equation (10-2) gives equation (10-3).

$$w(k) = C(f) \sum_{l=1}^{[N_p(f)/2]} e(l)\sin(l(k\theta + \pi)) \tag{10-1}$$

$$w(k) = C(f) \sum_{l=1}^{[N_p(f)/2]} \sin(l(k\theta + \pi)) \sum_{m=0}^{M-1} p(m) \sum_{t=0}^{M-1} \cos(tl\theta) q_{inv}(t, m) \tag{10-2}$$

$$w(k) = C(f) \sum_{m=0}^{M-1} p(m) \sum_{l=0}^{[N_p(f)/2]} \sin(l(k\theta + \pi)) \sum_{t=0}^{M-1} \cos(tl\theta) q_{inv}(t, m) \tag{10-3}$$

In the following description, equation (9-3) or (10-3) that expresses the pitch waveform by using the synthesis parameter p(m) as a common divisor (the same applies to the second to 10th embodiments to be described later). Note that the waveform generation unit 9 of this embodiment does not directly calculate equation (9-3) or (10-3) upon waveform generation for the pitch frequency f, but improves the calculation speed as follows. The waveform generation procedure of the waveform generation unit 9 will be described in detail below.

A pitch scale s is used as a measure for expressing the voice pitch, and waveform generation matrices WGM(s) at individual pitch scales s are calculated and stored in advance. If $N_p(s)$ represents the number of pitch period points corresponding to a given pitch scale s, the angle $\theta$ per sample is given by equation (11) below in accordance with equation (5) above:

$$\theta = \frac{2\pi}{N_p(s)} \tag{11}$$

Each $c_{km}(s)$ is calculated by equation (12-1) below when equation (9-3) is used, or is calculated by equation (12-2) below when equation (10-3) is used, so as to obtain a waveform generation matrix WGM(s) given by equation (12-3) below and store it in a table. Also, the number $N_p(s)$ of pitch period points and power normalization coefficient C(s) corresponding to the pitch scale s are also calculated using equations (4-2) and (8) above, and are stored in tables. Note that these tables are stored in a nonvolatile memory such as the external storage device 104 or the like, and are loaded onto the RAM 103 in speech synthesis processing.

$$c_{km}(s) = \sum_{l=1}^{[N_p(s)/2]} \sin(lk\theta) \sum_{t=0}^{M-1} \cos(tl\theta) q_{inv}(t, m) \quad (12\text{-}1)$$

$$c_{km}(s) = \sum_{l=1}^{[N_p(s)/2]} \sin(l(k\theta + \pi)) \sum_{t=0}^{M-1} \cos(tl\theta) q_{inv}(t, m) \quad (12\text{-}2)$$

$$WGM(s) = (c_{km}(s)) \quad (0 \le k < N_p(s), 0 \le m < M) \quad (12\text{-}3)$$

Figure 6:
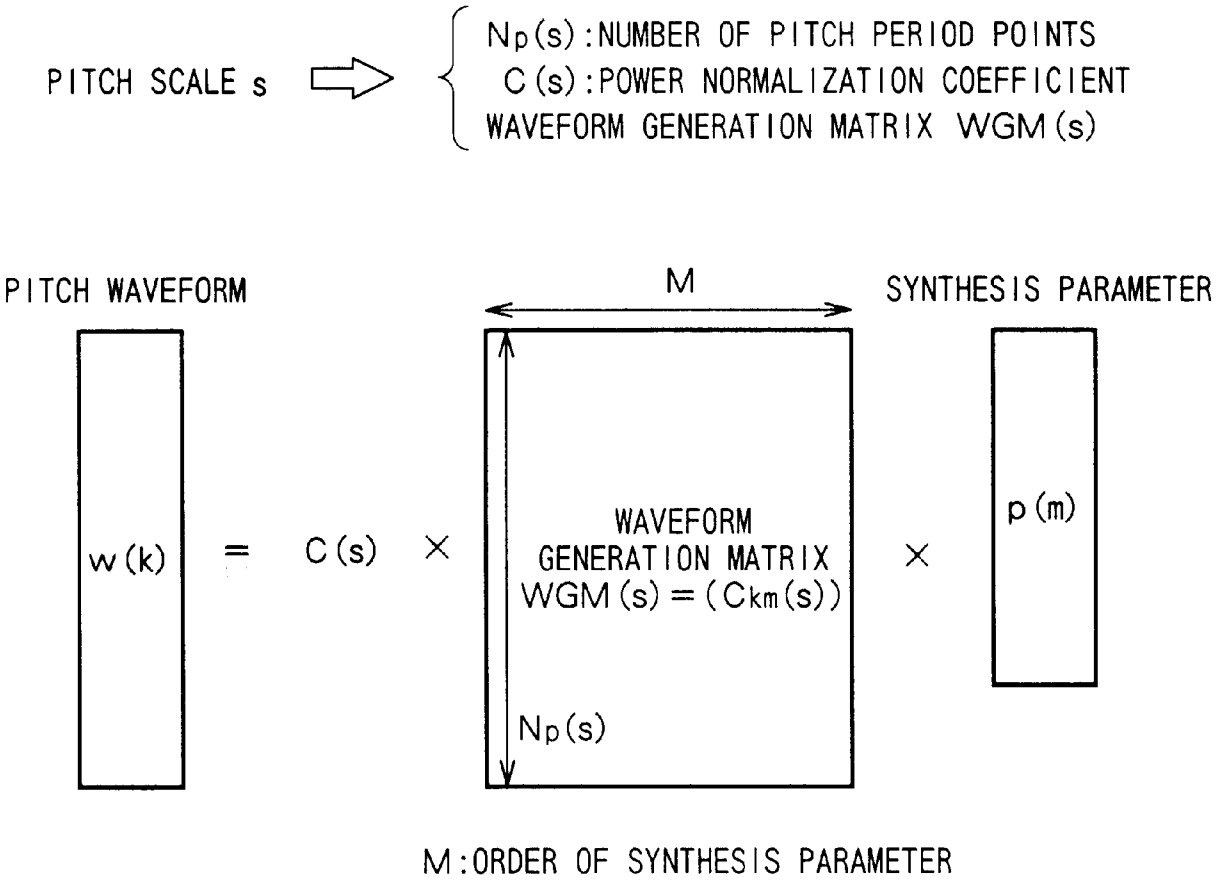
FIG. 6 shows the pitch waveform generation calculation in a waveform generator according to the embodiment of the present invention.

The waveform generation unit 9 reads out the number $N_p(s)$ of pitch period points, the power normalization coefficient C(s), and the waveform generation matrix WGM(s) $=(c_{km}(s))$ from the tables upon receiving synthesis parameters p(m) ($0 \leqq m < M$) output from the synthesis parameter interpolation unit 7 and pitch scales s output from the pitch scale interpolation unit 8, and generates a pitch waveform using equation (13) below. FIG. 6 shows the pitch waveform generation calculation of the waveform generation unit according to this embodiment.

$$w(k) = C(s) \sum_{m=0}^{M-1} c_{km}(s) p(m) \quad (0 \le k < N_p(s)) \quad (13)$$

The above-mentioned operation will be described below with reference to the flow chart in FIG. 7. FIG. 7 is a flow chart showing the speech synthesis procedure according to the first embodiment.

In step S1, a phonetic text is input by the character sequence input unit 1. In step S2, externally input control data (articulating speed and voice pitch) and control data included in the input phonetic text are stored in the control data storage unit 2. In step S3, the parameter generation unit 3 generates a parameter sequence on the basis of the phonetic text input by the character sequence input unit 1.

FIG. 8 shows the data structure of parameters for one frame generated in step S3. In FIG. 8, "K" is a articulating speed coefficient, and "s" is the pitch scale. Also, "p[0] to p[M−1] are synthesis parameters for generating a speech waveform of the corresponding frame.

In step S4, the internal registers of the waveform point number storage unit 6 are initialized to 0. If $n_w$ represents the number of waveform points, $n_w=0$ is set. Furthermore, in step S5, a parameter sequence counter i is initialized to 0.

In step S6, the parameter storage unit 4 loads parameters for the i-th and (i+1)-th frames output from the parameter generation unit 3. In step S7, the frame length setting unit 5 loads the articulating speed output from the control data storage unit 2. In step S8, the frame length setting unit 5 sets a frame length $N_i$ using articulating speed coefficients of the parameters stored in the parameter storage unit 4, and the articulating speed output from the control data storage unit 2.

In step S9, whether or not the processing of the i-th frame has ended is determined by checking if the number $n_w$ of waveform points is smaller than the frame length $N_i$. If $n_w \geqq N_i$, it is determined that the processing of the i-th frame has ended, and the flow advances to step S14; if $n_w < N_i$, it is determined that processing of the i-th frame is still underway, and the flow advances to step S10.

Figure 9:
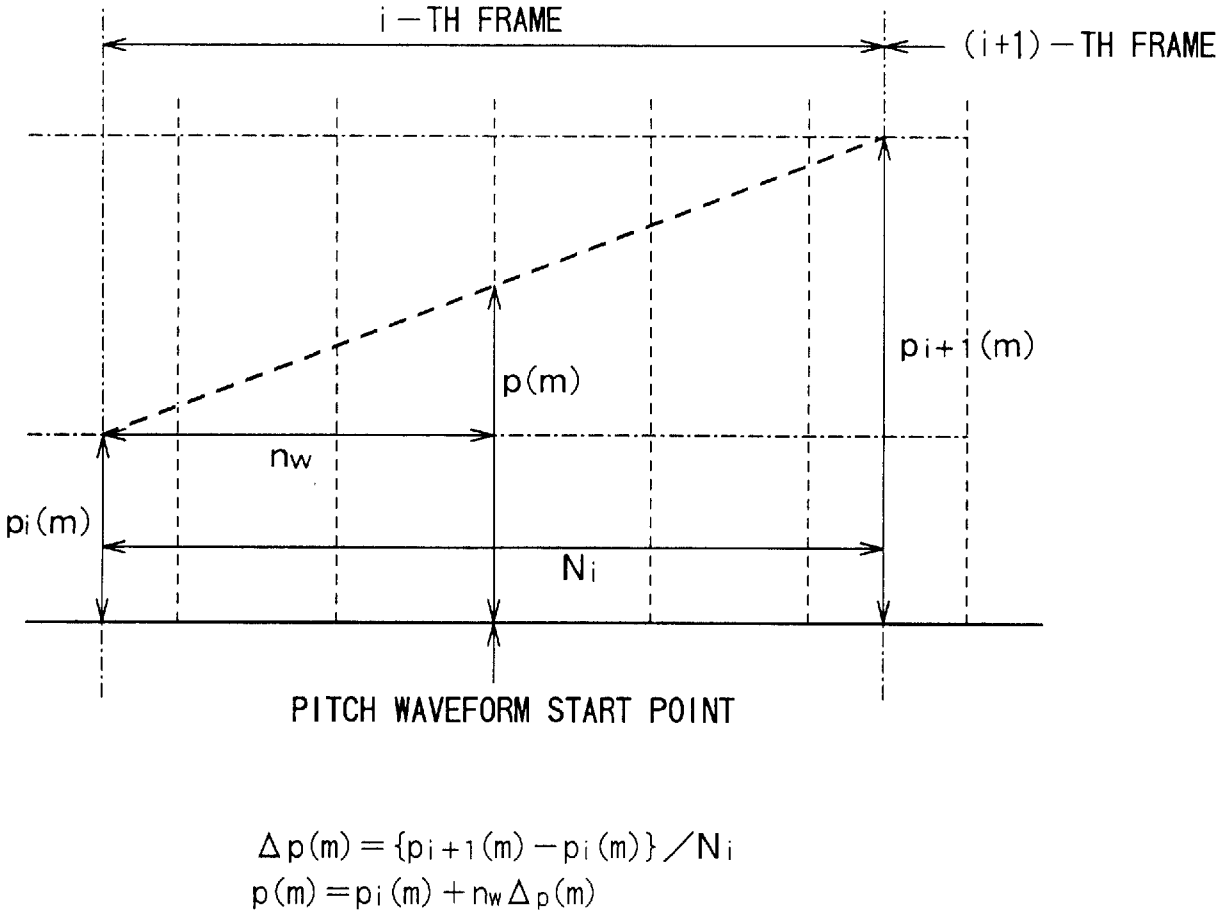
FIG. 9 is a graph for explaining synthesis parameter interpolation.

In step S10, the synthesis parameter interpolation unit 7 interpolates synthesis parameters using synthesis parameters ($p_i[m]$, $p_{i+1}[m]$) stored in the parameter storage unit 4, the frame length ($N_i$) set by the frame length setting unit 5, and the number ($n_w$) of waveform points stored in the waveform point number storage unit 6. FIG. 9 is an explanatory view of synthesis parameter interpolation. Let $p_i[m]$ ($0 \leqq m < M$) be the synthesis parameters of the i-th frame, and $p_{i+1}[m]$ ($0 \leqq m < M$) be those of the (i+1)-th frame, and the length of the i-th frame be defined by $N_i$ samples. In this case, a difference $\Delta_p[m]$ ($0 \leqq m < M$) per sample is given by:

$$\Delta_p[m] = \frac{p_{i+1}[m] - p_i[m]}{N_i} \quad (14)$$

Hence, every time a pitch waveform is generated, synthesis parameters p[m] are updated, as expressed by equation (15) below. That is, a pitch waveform generated from each start point is generated using p[m] given by:

$$p[m] = p_i[m] + n_w \Delta_p[m] \quad (15)$$

Figure 10:
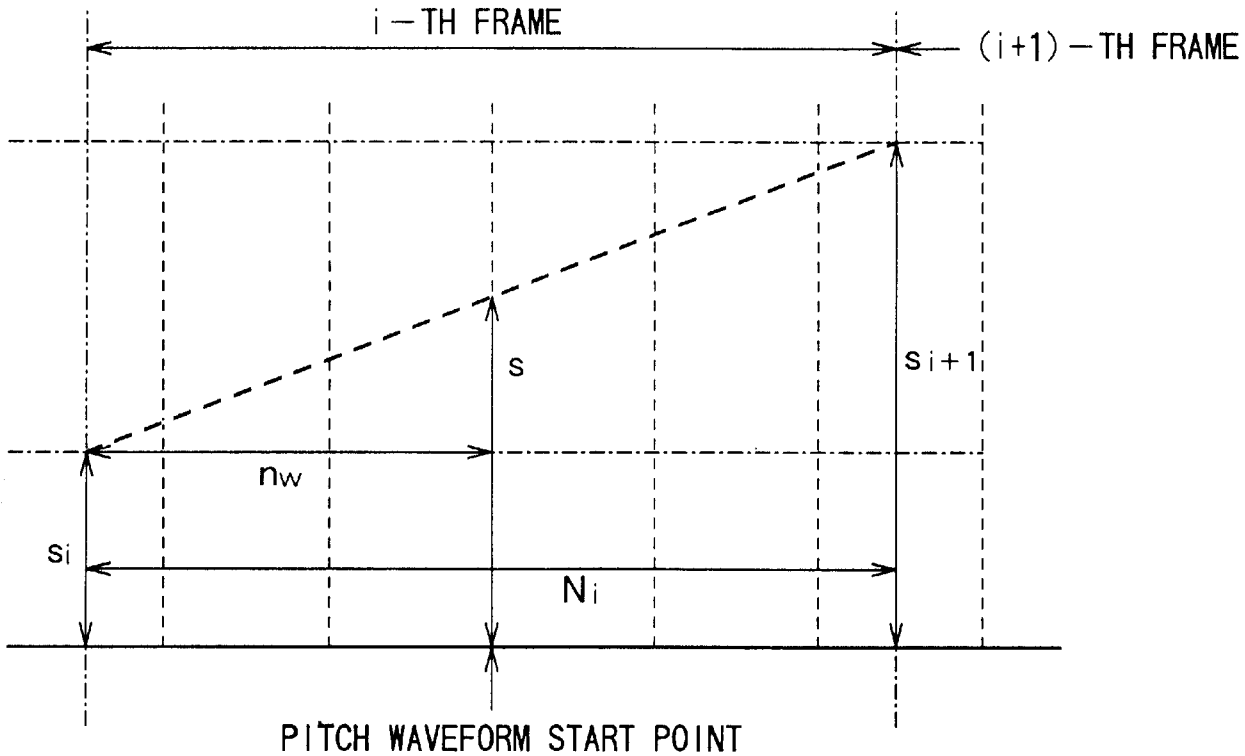
FIG. 10 is a graph for explaining pitch scale interpolation.

Subsequently, in step S11, the pitch scale interpolation unit 8 performs pitch scale interpolation using pitch scales ($s_i$, $s_{i+1}$) stored in the parameter storage unit 4, the frame length ($N_i$) set by the frame length setting unit 5, and the number ($n_w$) of waveform points stored in the waveform point number storage unit 6. FIG. 10 is an explanatory view of pitch scale interpolation. Let $s_i$ be the pitch scale of the i-th frame and $s_{i+1}$ be that of the (i+1)-th frame, and the frame length of the i-th frame be defined by $N_i$ samples. At this time, a difference $\Delta_s$ of the pitch scale per sample is given by:

$$\Delta_s = \frac{s_{i+1} - s_i}{N_i} \quad (16)$$

Hence, every time a pitch waveform is generated, the pitch scale s is updated, as expressed by equation (17) below. That is, at each start point of a pitch waveform, the pitch waveform is generated using the pitch scale s given by equation (17) below and the parameters obtained by equation (15) above:

$$s = s_i + n_w \Delta_s \quad (17)$$

In step S12, the waveform generation unit 9 generates a pitch waveform using the synthesis parameter p[m] ($0 \leqq m < M$) obtained by equation (15) above and pitch scale s obtained by equation (17) above. More specifically, the waveform generation unit 9 reads out the number $N_p(s)$ of pitch period points, the power normalization coefficient C(s), and the waveform generation matrix WGM(s)=$C_{km}(s)$ ($0 \leqq k \leqq N_p(s)$, $0 \leqq m < M$) corresponding to the pitch scale s from the corresponding tables, and generates the pitch waveform using equation (13) mentioned above.

Figure 11:
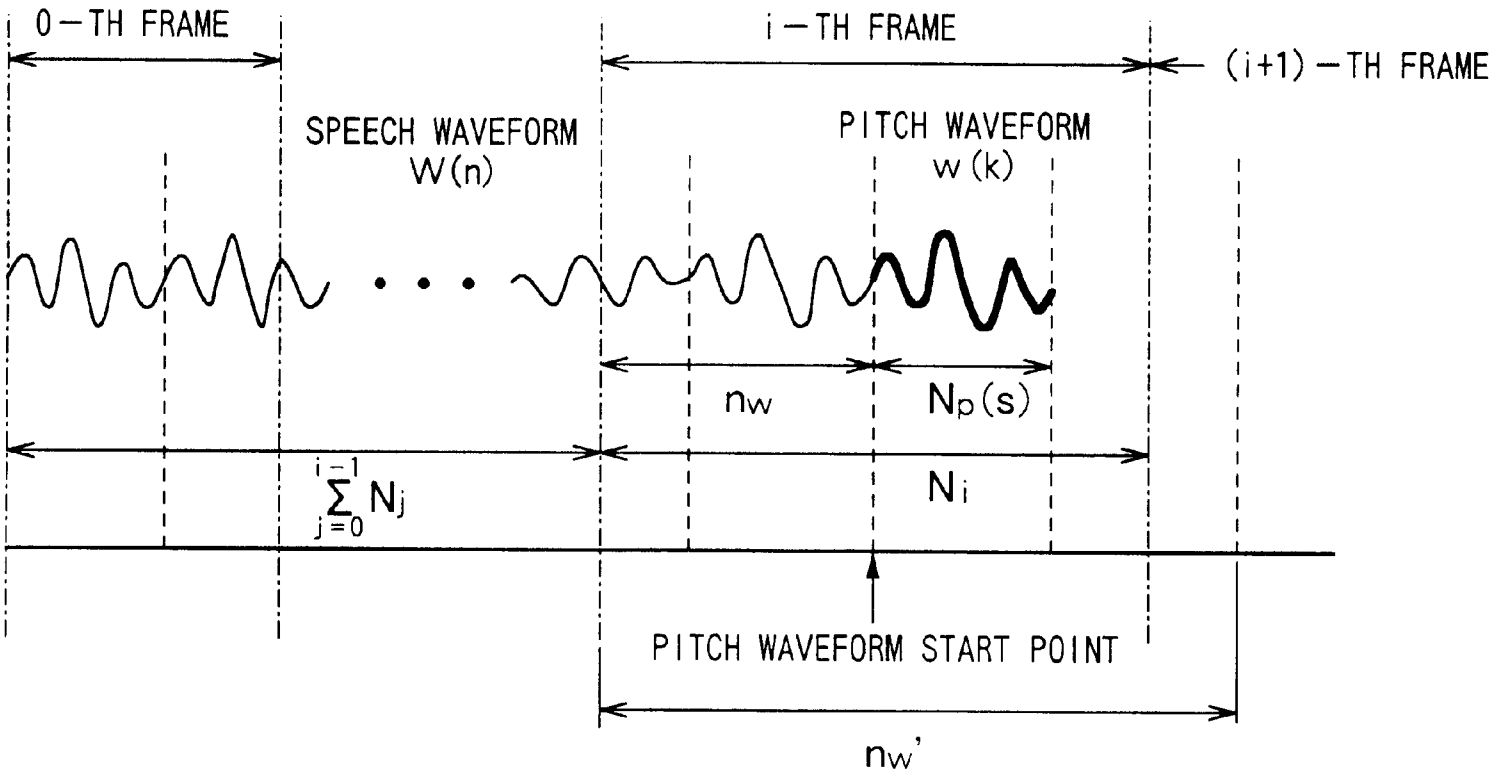
FIG. 11 is a graph for explaining the connection of generated pitch waveforms.

FIG. 11 explains connection or concatenation of generated pitch waveforms. Let W(n) ($0 \leqq n$) be the speech waveform output as synthesized speech from the waveform generation unit 9. The connection of the pitch waveforms is done by:

$$W\left(\sum_{j=0}^{i-1} N_j + n_w + k\right) = w(k) \quad (0 \le k < N_p(s)) \quad (18)$$

In step S13, the waveform point number storage unit 6 updates the number $n_w$ of waveform points, as in equation (19) below. Thereafter, the flow returns to step S9 to continue processing.

$$n_w = n_w + N_p(s) \tag{19}$$

On the other hand, if $n_w \geqq N_i$ in step S9, the flow advances to step S14. In step S14, the number $n_w$ of waveform points is initialized, as written in equation (20) below. For example, as shown in FIG. 11, as a result of updating $n_w$ by $n_w+N_i$ by the processing in step S13, if $n_w'$ has exceeded $N_i$, the initial $n_w$ of the next (i+1)-th frame is set as $n_w'-N_i$, so that the speech waveform can be normally connected.

$$n_w = n_w - N_i \tag{20}$$

Finally, it is checked in step S15 if processing of all the frames is complete. If NO in step S15, the flow advances to step S16. In step S16, externally input control data (articulating speed, voice pitch) are stored in the control data storage unit 2. In step S17, the parameter sequence counter i is updated by i=i+1. The flow then returns to step S6 to repeat the above-mentioned processing. On the other hand, if it is determined in step S15 that processing of all the frames is complete, the processing ends.

As described above, according to the first embodiment, since a speech waveform can be generated by generating and connecting pitch waveforms on the basis of the pitch and parameters of a speech to be synthesized, the sound quality of the synthesized speech can be prevented from deteriorating.

Upon generating pitch waveforms, since the products of the waveform generation matrices and parameters obtained in advance are calculated in units of pitches, the calculation volume required for generating a speech waveform can be reduced.

[Second Embodiment]

Figure 12A:
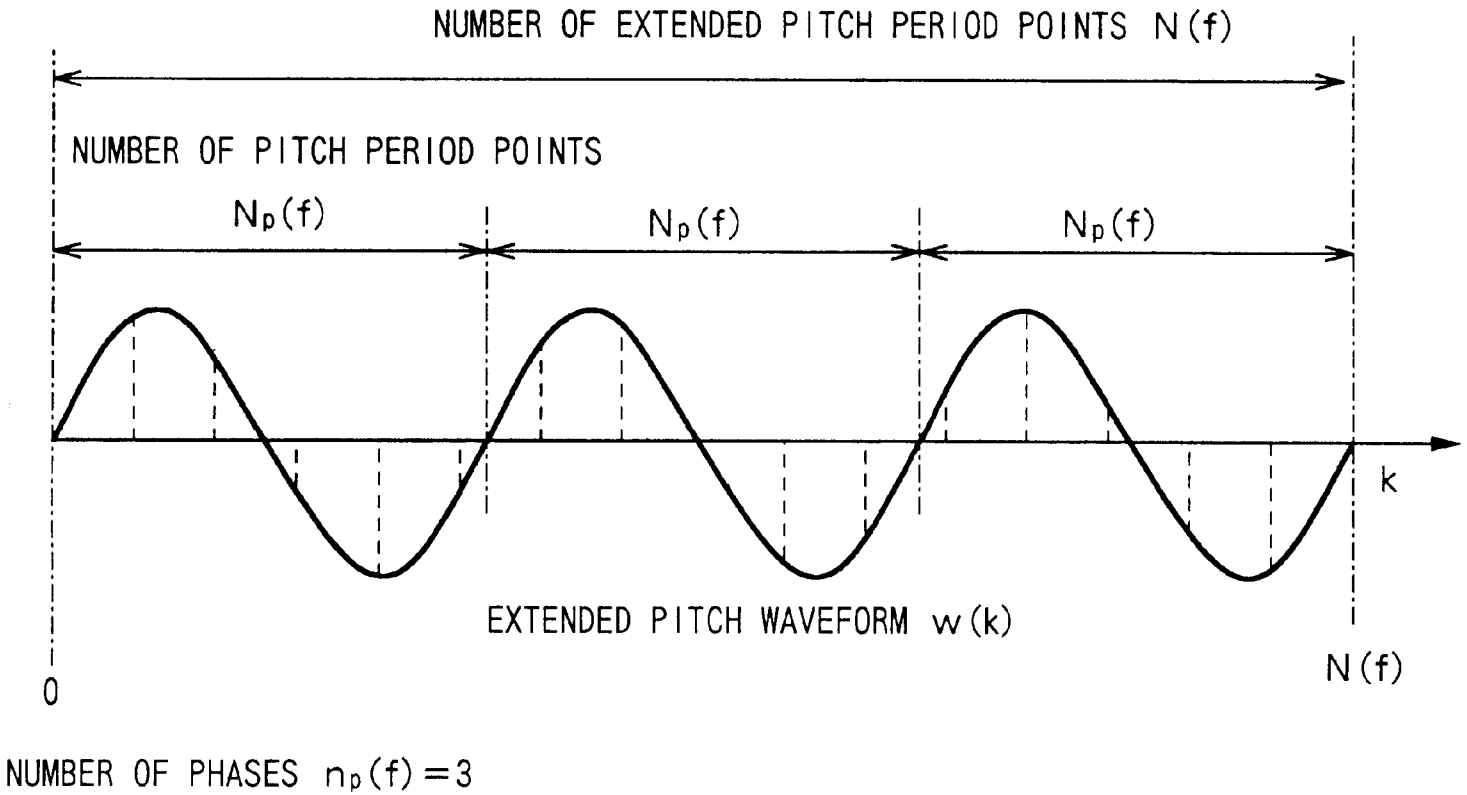
FIG. 12A is a graph for explaining waveform points on an extended pitch waveform according to the second embodiment.

The second embodiment will be described below. The hardware arrangement and functions of a speech synthesis apparatus according to the second embodiment are the same as those of the first embodiment (FIGS. 22 and 1). In the second embodiment, the pitch waveform generation method done by the waveform generation unit 9 is different from that of the first embodiment. The pitch waveform generation procedure by performed the waveform generation unit 9 will be described in detail below. FIG. 12A shows waveform points on a pitch waveform according to the second embodiment.

As in the first embodiment, let p(m) be the synthesis parameters used in pitch waveform generation, let $f_s$ be the sampling frequency, $T_s=(1/f_s)$ be the sampling period, let f be the pitch frequency of the speech to be synthesized, and let T (=1/f) be the pitch period. Then, the number $N_p(f)$ of pitch period points is given by equation (4-1) above.

In the second embodiment, the decimal part of the number $N_p(f)$ of pitch period points is expressed by connecting phase-shifted pitch waveforms. The following explanation will be given assuming that [x] represents a maximum integer equal to or smaller than x, as in the first embodiment.

The number of pitch waveforms corresponding to the frequency f is represented by the number $n_p(f)$ of phases. FIG. 12A shows an example of pitch waveforms when $n_p(f)=3$. In the example shown in FIG. 12A, the period of an extended pitch waveform for three pitch periods equals an integer multiple of the sampling period. Furthermore, the number N(f) of extended pitch period points is defined, as indicated by equation (21-1) below, and the number $N_p(f)$ of pitch period points is quantized as indicated by equation (21-2) below using that number N(f) of extended pitch period points:

$$N(f) = [n_p(f)N_p(f)] = \left[n_p(f)\frac{f_s}{f}\right] \tag{21-1}$$

$$N_p(f) = \frac{N(f)}{n_p(f)} \tag{21-2}$$

Let $\theta_1$ be the angle per point when the number $N_p(f)$ of pitch period points is set in correspondence with an angle $2\pi$. Then, $\theta_1$ is given by:

$$\theta_1 = \frac{2\pi}{N_p(f)} \tag{22}$$

When a matrix Q, its elements q(t,u), and an inverse matrix of Q are expressed using equations (6-1), (6-2), and (6-3) of the first embodiment, the spectrum envelope values corresponding to integer multiples of the pitch frequency are expressed by equations (23-1) and (23-2) below as in equations (7-1) and (7-2) above:

$$e(l) = \sum_{t=0}^{M-1} \cos(tl\theta_1) \sum_{m=0}^{M-1} q_{inv}(t, m)p(m) \; (1 \le l \le [N_p(f)/2]) \tag{23-1}$$

$$e(l) = \sum_{m=0}^{M-1} p(m) \sum_{t=0}^{M-1} \cos(tl\theta_1) q_{inv}(t, m) \; (1 \le l \le [N_p(f)/2]) \tag{23-2}$$

Let $\theta_2$ be the angle per point when the number N(f) of extended pitch period points is set in correspondence with $2\pi$. Then, $\theta_2$ is given by:

$$\theta_2 = \frac{2\pi}{N(f)} \tag{24}$$

Let w(k) ($0 \leqq k < N(f)$) be the extended pitch waveform shown in FIG. 12A. As in the first embodiment, let C(f) be a power normalization coefficient corresponding to the pitch frequency f, and be given by equation (8) above using $f_0$ as the pitch frequency that yields C(f)=1.0. Then, the extended pitch waveform w(k) is generated as written by equations (25-1) to (25-3) by superposing sine waves corresponding to integer multiples of the pitch frequency:

$$w(k) = C(f) \sum_{l=1}^{[N_p(f)/2]} e(l)\sin(lkn_p(f)\theta_2) \tag{25-1}$$

$$w(k) = C(f) \sum_{l=1}^{[N_p(f)/2]} \sin(lkn_p(f)\theta_2) \sum_{t=0}^{M-1} \cos(tl\theta_1) \sum_{m=0}^{M-1} q_{inv}(t, m)p(m) \tag{25-2}$$

$$w(k) = C(f) \sum_{m=0}^{M-1} p(m) \sum_{l=1}^{[N_p(f)/2]} \sin(lkn_p(f)\theta_2) \sum_{t=0}^{M-1} \cos(tl\theta_1) q_{inv}(t, m) \tag{25-3}$$

Alternatively, the extended pitch waveform may be generated as written by equations (26-1) to (26-3) by superposing sine waves while shifting their phases by $\pi$:

$$w(k) = C(f) \sum_{l=1}^{[N_p(f)/2]} e(l)\sin(l(kn_p(f)\theta_2 + \pi)) \tag{26-1}$$

$$w(k) = C(f) \sum_{l=1}^{[N_p(f)/2]} \sin(l(kn_p(f)\theta_2 + \pi)) \sum_{t=0}^{M-1} \cos(tl\theta_1) \sum_{m=0}^{M-1} q_{inv}(t, m)p(m) \tag{26-2}$$

$$w(k) = C(f) \sum_{m=0}^{M-1} p(m) \sum_{l=1}^{[N_p(f)/2]} \sin(l(kn_p(f)\theta_2 + \pi)) \sum_{t=0}^{M-1} \cos(tl\theta_1) q_{inv}(t, m) \tag{26-3}$$

Let $i_p$ be a phase index (formula (27-1)). Then, a phase angle $\phi(f,i_p)$ corresponding to the pitch frequency f and phase index $i_p$ is defined by equation (27-2) below. Also, mod(a,b) represents the remainder obtained when a is divided by b, and $r(f,i_p)$ is defined by equation (27-3) below:

$$i_p(0 \le i_p < n_p(f)) \tag{27-1}$$

$$\phi(f, i_p) = \frac{2\pi}{n_p(f)} i_p \tag{27-2}$$

$$r(f, i_p) = mod(i_p N(f), n_p(f)) \tag{27-3}$$

Accordingly, the number $P(f,i_p)$ of pitch waveform points of a pitch waveform corresponding to the phase index $i_p$ is calculated by equation (28) below using $r(f,i_p)$ above:

$$P(f, i_p) = \left[\frac{(i_p+1)N(f)}{n_p(f)}\right] - \left[1 - \frac{r(f, i_p+1)}{n_p(f)}\right] - \left[\frac{i_p N(f)}{n_p(f)}\right] + \left[1 - \frac{r(f, i_p)}{n_p(f)}\right] \tag{28}$$

Using the number $P(f,i_p)$ of pitch waveform points for each phase, a pitch waveform $w_p(k)$ corresponding to the phase index $i_p$ is given by:

$$w_p(k) = \begin{cases} w(k) & (i_p = 0, 0 \le k < P(f, i_p)) \\ w\left(\sum_{j=0}^{i_p-1} P(f, j) + k\right) & (0 < i_p < n_p(f)), 0 \le k < P(f, i_p)) \end{cases} \tag{29}$$

After the pitch waveform for one phase is generated, the phase index is updated by equation (30-1) below, and the phase angle is calculated by equation (30-2) below using the updated phase index:

$$i_p = \mathrm{mod}((i_p+1), n_p(f)) \tag{30-1}$$

$$\phi_p = \phi(f, i_p) \tag{30-2}$$

Figure 12B:
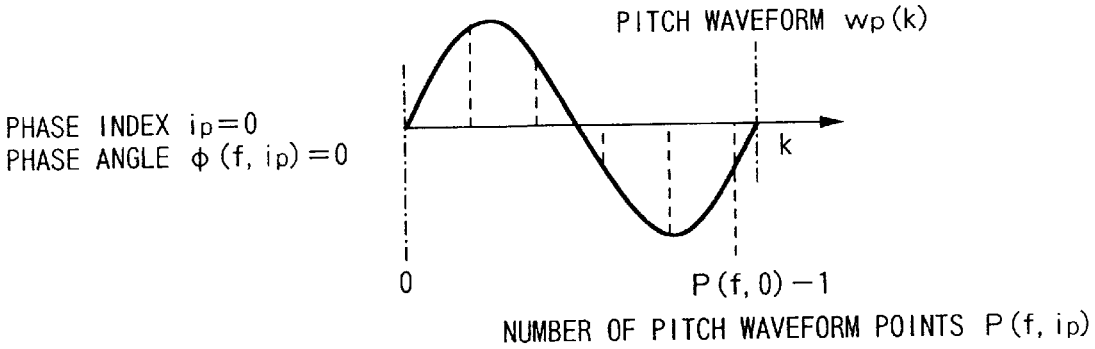
FIGS. 12B to 12D are graphs showing the pitch waveforms in different phases on the extended pitch waveform shown in FIG. 12A.
Figure 12C:
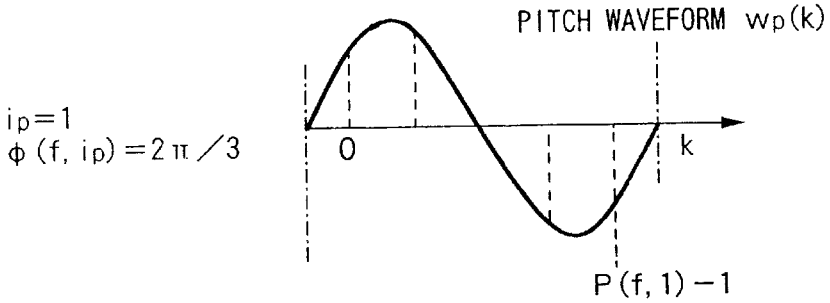
Figure 12D:
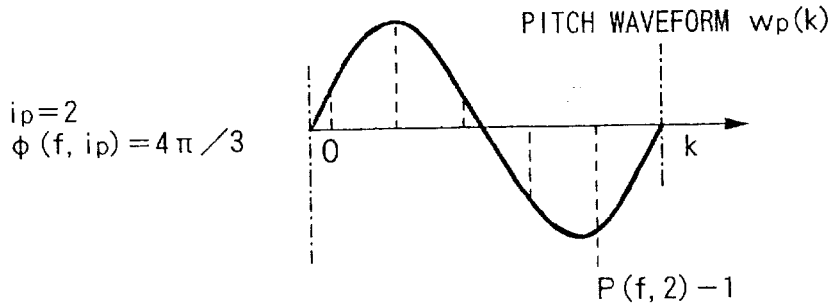

As described above, equation (25-3) or (26-3) is calculated at each phase index given by equation (29) to generate a pitch waveform for one phase. FIGS. 12B to 12D show the pitch waveforms of the extended pitch waveform shown in FIG. 12A in units of phases. The next phase index and phase angle are set by equations (30-1) and (30-2) in turn, thus generating pitch waveforms.

Furthermore, when the pitch frequency is changed to f' upon generating the next pitch waveform, i' that satisfies equation (31-1) below is calculated to obtain a phase angle closest to $\phi_p$, and $i_p$ is determined by equation (31-2) below:

$$|\phi(f', i') - \phi_p| = \min_{0 \le i < n_p(f')} |\phi(f', i) - \phi_p| \tag{31-1}$$

$$i_p = i' \tag{31-2}$$

The principle of waveform generation of this embodiment has been described. The waveform generation unit 9 of this embodiment does not directly calculate equation (25-3) or (26-3), but generates waveforms using waveform generation matrices $WGM(s,i_p)$ (to be described below) which are calculated and stored in advance in correspondence with pitch scales and phases.

Note that the pitch scale s is used as a measure for expressing the voice pitch. Also, let $n_p(s)$ be the number of phases corresponding to pitch scale $s \in S$ (S is a set of pitch scales), $i_p$ ($0 \leqq i_p < n_p(s)$) be the phase index, N(s) be the number of extended pitch period points, and $P(s,i_p)$ be the number of pitch waveform points. Furthermore, $\theta_1$ given by equation (22) above and $\theta_2$ given by equation (24) above are respectively expressed by equations (32-1) and (32-2) below using $N_p(s)$:

$$\theta_1 = \frac{2\pi}{N_p(s)} \tag{32-1}$$

$$\theta_2 = \frac{2\pi}{N(s)} \tag{32-2}$$

A waveform generation matrix $WGM(s,i_p)$ including $c_{km}(s,i_p)$ obtained by equation (33-1) or (33-2) below as an element is calculated, and is stored in a table. Note that equation (33-1) corresponds to equation (25-3), and equation (33-2) corresponds to equation (26-3). Also, equation (33-3) represents the waveform generation matrix.

$$c_{km}(s, i_p) = \begin{cases} \sum_{l=1}^{[N_p(s)/2]} \sin(lkn_p(s)\theta_2) \sum_{t=0}^{M-1} \cos(tl\theta_1) q_{inv}(t, m) & (i_p = 0) \\ \sum_{l=1}^{[N_p(s)/2]} \sin\left(l\left(\sum_{j=0}^{i_p-1} p(s, j) + k\right) n_p(s)\theta_2\right) \sum_{t=0}^{M-1} \cos(tl\theta_1) q_{inv}(t, m) & (0 < i_p < n_p(s)) \end{cases} \tag{33-1}$$

-continued $$c_{km}(s, i_p) = \begin{cases} \sum_{l=1}^{[N_p(s)/2]} \sin(l(kn_p(s)\theta_2 + \pi)) \sum_{t=0}^{M-1} \cos(tl\theta_1) q_{inv}(t, m) & (i_p = 0) \\ \sum_{l=1}^{[N_p(s)/2]} \sin\left(l\left(\left(\sum_{j=0}^{i_p-1} p(s, j) + k\right) n_p(s)\theta_2 + \pi\right)\right) \sum_{t=0}^{M-1} \cos(tl\theta_1) q_{inv}(t, m) & (0 < i_p < n_p(s)) \end{cases} \quad (33\text{-}2)$$

$$WGM(s) = (c_{km}(s, i_p))(0 \le k < P(s, i_p), 0 \le m < M) \quad (33\text{-}3)$$

A phase angle $\phi_p$ corresponding to the pitch scale s and phase index $i_p$ is calculated by equation (34-1) below and is stored in a table. Also, the relation that provides $i_0$ which satisfies equation (34-2) below with respect to the pitch scale s and phase angle $\phi_p$ ($\in\{\phi(s,i_p)|s \in S, 0 \leqq i < n_p(s)\}$) is defined by equation (34-3) below and is stored in a table.

$$\phi(s, i_p) = \frac{2\pi}{n_p(s)} i_p \quad (34\text{-}1)$$

$$|\phi(s, i_0) - \phi_p| = \min_{0 \le i < n_p(s)} |\phi(s, i) - \phi_p| \quad (34\text{-}2)$$

$$i_0 = I(s, \phi_p) \quad (34\text{-}3)$$

Furthermore, the number $n_p(s)$ of phases, the number $P(s,i_p)$ of pitch waveform points, and power normalization coefficient C(s) corresponding to the pitch scale s and phase index $i_p$ are stored in tables.

The waveform generation unit 9 generates a pitch waveform w(k) by receiving synthesis parameters p(m) ($0 \leqq m < M$) output from the synthesis parameter interpolation unit 7 and pitch scales s output from the pitch scale interpolation unit 8 using the phase index $i_p$ and phase angle $\phi_p$ stored in its internal registers. More specifically, the waveform generation unit 9 determines the phase index $i_p$ by equation (35-1) below, reads out the number $P(s,i_p)$ of pitch waveform points, power normalization coefficient C(s), and waveform generation matrix $WGM(s,i_p)=(c_{km}(s,i_p))$ from the tables, and generates a pitch waveform by equation (35-2) below.

$$i_p = I(s, \phi_p) \quad (35\text{-}1)$$

$$w_p(k) = C(s) \sum_{m=0}^{M-1} c_{km}(s, i_p) p(m) \ (0 \le k < P(s, i_p)) \quad (35\text{-}2)$$

After the pitch waveform is generated, the phase index is updated by equation (36-1) below in accordance with equation (30-1) above, and the phase angle is updated by equation (36-2) below in accordance with equation (30-2) above using the updated phase index.

$$i_p = \mathrm{mod}((i_p+1), n_p(s)) \quad (36\text{-}1)$$

$$\phi_p = \phi(s, i_p) \quad (36\text{-}2)$$

Figure 13:
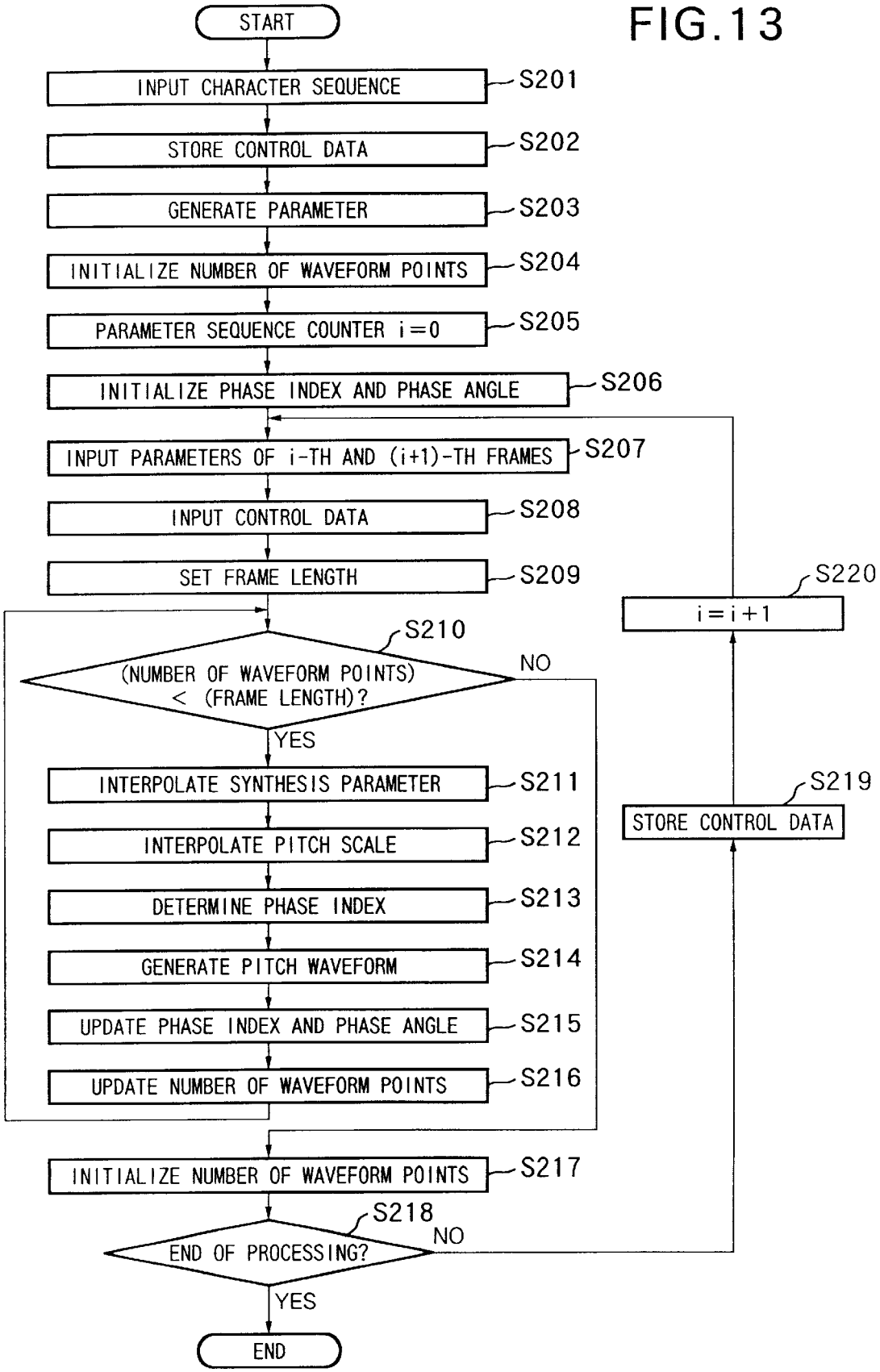
FIG. 13 is a flow chart showing the speech synthesis procedure according to the second embodiment.

The above-mentioned operation will be explained with reference to the flow chart in FIG. 13. In step S201, a phonetic text is input by the character sequence input unit 1. In step S202, externally input control data (articulating speed and voice pitch) and control data included in the input phonetic text are stored in the control data storage unit 2. In step S203, the parameter generation unit 3 generates a parameter sequence on the basis of the phonetic text input by the character sequence input unit 1. The data structure of parameters for one frame generated in step S203 is the same as that in the first embodiment, as shown in FIG. 8.

In step S204, the internal registers of the waveform point number storage unit 6 are initialized to 0. If $n_w$ represents the number of waveform points, $n_w=0$ is set. Furthermore, in step S205, the parameter sequence counter i is initialized to 0. In step S206, the phase index $i_p$ is initialized to 0, and the phase angle $\phi_p$ is initialized to 0.

In step S207, the parameter storage unit 4 loads parameters for the i-th and (i+1)-th frames output from the parameter generation unit 3. In step S208, the frame length setting unit 5 loads the articulating speed output from the control data storage unit 2. In step S209, the frame length setting unit 5 sets a frame length $N_i$ using articulating speed coefficients of the parameters stored in the parameter storage unit 4, and the articulating speed output from the control data storage unit 2.

In step S210, it is checked if the number $n_w$ of waveform points is smaller than the frame length $N_i$. If $n_w \geqq N_i$, the flow advances to step S217; if $n_w < N_i$, the flow advances to step S211 to continue processing. In step S211, the synthesis parameter interpolation unit 7 interpolates synthesis parameters using synthesis parameters $p_i(m)$ and $p_{i+1}(m)$ stored in the parameter storage unit 4, the frame length $N_i$ set by the frame length setting unit 5, and the number $n_w$ of waveform points stored in the waveform point number storage unit 6. Note that the parameter interpolation is done in the same manner as in step S10 (FIG. 7) in the first embodiment.

In step S212, the pitch scale interpolation unit 8 performs pitch scale interpolation using pitch scales $s_i$ and $s_{i+1}$ stored in the parameter storage unit 4, the frame length $N_i$ set by the frame length setting unit 5, and the number $n_w$ of waveform points stored in the waveform point number storage unit 6. Note that pitch scale interpolation is done in the same manner as in step S11 (FIG. 7) in the first embodiment.

In step S213, the phase index $i_p$ is calculated by equation (34-3) above using the pitch scale s obtained by equation (17) of the first embodiment and phase angle $\phi_p$. More specifically, $i_p$ is determined by:

$$i_p = I(s, \phi_p) \quad (37)$$

In step S214, the waveform generation unit 9 generates a pitch waveform using the synthesis parameters p[m] ($0 \leqq m < M$) obtained by equation (15) above and pitch scales s obtained by equation (17) above. More specifically, the waveform generation unit 9 reads out the number $P(s,i_p)$ of pitch waveform points, power normalization coefficient C(s), and the waveform generation matrix $WGM(s,i_p)=(C_{km}(s,i_p))$ ($0 \leqq k \leqq P(s,i_p)$, $0 \leqq m < M$) corresponding to the pitch scale s from the corresponding tables, and generates the pitch waveform using equation (35-2) mentioned above.

Let W(n) ($0 \leqq n$) be the speech waveform output as synthesized speech from the waveform generation unit 9.

Connection of the pitch waveforms is done in the same manner as in the first embodiment, i.e., by equations (38) below using a frame length $N_j$ of the j-th frame:

$$\left.\begin{aligned} W(n_w+k) &= w_p(k) \quad (i=0,\ 0 \le k < P(s, i_p) \\ W\left(\sum_{j=0}^{i-1} N_j + n_w + k\right) &= w_p(k) \quad (i>0,\ 0 \le k < P(s, i_p)) \end{aligned}\right\} \tag{38}$$

In step S215, the phase index is updated by equation (36-1) above, and the phase angle is updated by equation (36-2) above using the updated phase index $i_p$. Subsequently, in step S216, the waveform point number storage unit 6 updates the number $n_w$ of waveform points by equation (39-1) below. Thereafter, the flow returns to step S210 to continue processing. On the other hand, if it is determined in step S210 that $n_w \geqq N_i$, the flow advances to step S217. In step S217, the number $n_w$ of waveform points is initialized by equation (39-2) below.

$$n_w = n_w + P(s, i_p) \tag{39-1}$$

$$n_w = n_w - N_i \tag{39-2}$$

Finally, it is checked in step S218 if processing of all the frames is complete. If NO in step S218, the flow advances to step S219. In step S219, externally input control data (articulating speed, voice pitch) are stored in the control data storage unit 2. In step S220, the parameter sequence counter i is updated by i=i+1. The flow then returns to step S207 to continue the above-mentioned processing. On the other hand, if it is determined in step S218 that processing of all the frames is complete, the processing ends.

As described above, according to the second embodiment, the same effects as in the first embodiment can be expected. Also, upon generating pitch waveforms, since pitch waveforms which are out of phase are generated and connected to express the decimal part of the number of pitch period points, synthesized speech with accurate pitch can be obtained.

[Third Embodiment]

Figure 14:
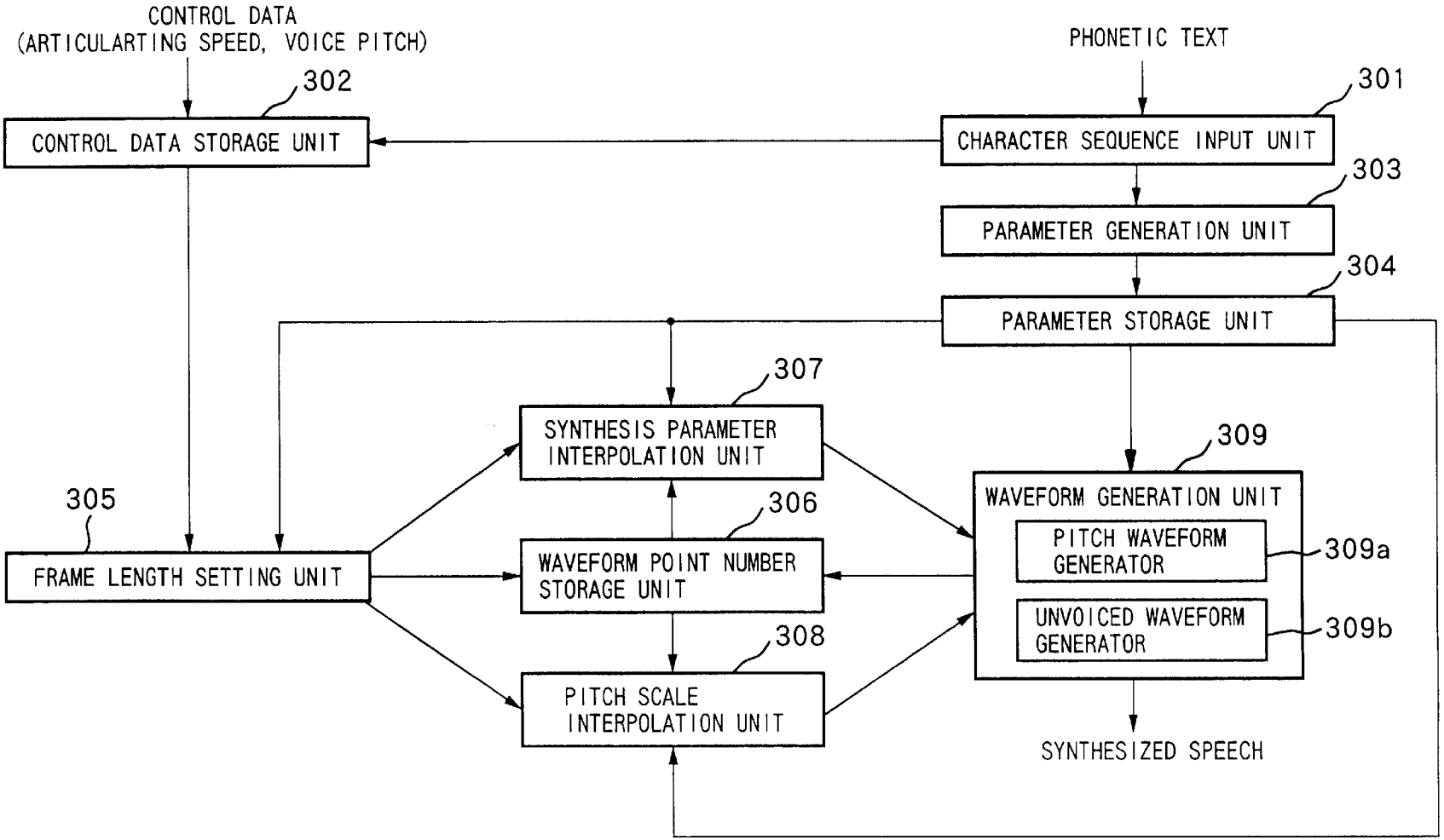
FIG. 14 is a block diagram showing the functional arrangement of a speech synthesis apparatus according to the third embodiment.

FIG. 14 is a block diagram showing the functional arrangement of a speech synthesis apparatus according to the third embodiment. In FIG. 14, reference numeral 301 denotes a character sequence input unit, which inputs a character sequence of speech to be synthesized. For example, if the speech to be synthesized is "音声 (onsei)", a character sequence "OnSEI" is input. The character sequence may include a control sequence for setting the articulating speech, voice pitch, and the like. Reference numeral 302 denotes a control data storage unit which stores information, which is determined to be the control sequence in the character sequence input unit 301, and control data such as the articulating speech, the voice pitch, and the like input from a user interface in its internal registers.

Reference numeral 303 denotes a parameter generation unit for generating a parameter sequence corresponding to the character sequence input by the character sequence input unit 301. Reference numeral 304 denotes a parameter storage unit for extracting parameters from the parameter sequence generated by the parameter generation unit 303, and storing the extracted parameters in its internal registers. Reference numeral 305 denotes a frame length setting unit for calculating the length of each frame on the basis of the control data stored in the control data storage unit 302 and associated with the articulating speech, and an articulating speech coefficient (a parameter used for determining the length of each frame in correspondence with the articulating speech) stored in the parameter storage unit 304.

Reference numeral 306 denotes a waveform point number storage unit for calculating the number of waveform points per frame, and storing it in its internal register. Reference numeral 307 denotes a synthesis parameter interpolation unit for interpolating the synthesis parameters stored in the parameter storage unit 304 on the basis of the frame length set by the frame length setting unit 305 and the number of waveform points stored in the waveform point number storage unit 306. Reference numeral 308 denotes a pitch scale interpolation unit for interpolating each pitch scale stored in the parameter storage unit 304 on the basis of the frame length set by the frame length setting unit 305 and the number of waveform points stored in the waveform point number storage unit 306.

Reference numeral 309 denotes a waveform generation unit. A pitch waveform generator 309*a* of the waveform generation unit 309 generates pitch waveforms on the basis of the synthesis parameters interpolated by the synthesis parameter interpolation unit 307 and the pitch scale interpolated by the pitch scale interpolation unit 308, and connects the pitch waveforms to output synthesized speech. On the other hand, an unvoiced waveform generator 309*b* generates unvoiced waveforms on the basis of the synthesis parameters output from the synthesis parameter interpolation unit 307, and connects them to output synthesized speech.

Note that pitch waveform generation performed by the pitch waveform generator 309*a* is the same as that in the first embodiment. Hence, in the third embodiment, unvoiced waveform generation performed by the unvoiced waveform generator 309*b* will be explained.

Let p(m) ($0 \leqq m < M$) be a synthesis parameter used in unvoiced waveform generation. If $f_s$ represents the sampling frequency, a sampling period $T_s$ is expressed by $T_s = 1/f$. Also, let f be the pitch frequency of a sine wave used in unvoiced waveform generation. f is set at a frequency lower than the audible frequency band. Furthermore, if [x] represents a maximum integer equal to or smaller than x, the number $N_p(f)$ of pitch period points corresponding to the pitch period f is given by equation (40-1) below. The number $N_{uv}$ of unvoiced waveform points is equal to the number $N_p(f)$ of pitch period points, and is given by equation (40-2) below.

$$N_p(f) = \left[\frac{f_s}{f}\right] \tag{40-1}$$

$$N_{uv} = N_p(f) \tag{40-2}$$

If θ represents the angle per point when the number of unvoiced waveform points is set in correspondence with an angle 2π, θ is:

$$\theta = \frac{2\pi}{N_{uv}} \tag{41}$$

Furthermore, a matrix Q and its inverse matrix are defined by equations (42-1) to (42-3). Note that t is a row index, and u is a column index.

$$Q = (q(t, u))\ (0 \le t < M,\ 0 \le u < M) \tag{42-1}$$

-continued $$q(t, u) = \cos\left(tu\frac{2\pi}{N}\right) \tag{42-2}$$

$$Q^{-1} = (q_{inv}(t, u)) \tag{42-3}$$

A value e(1) of the spectrum envelope corresponding to an integer multiple of the pitch frequency f is expressed by equations (43-1) and (43-2) below using an element $q_{inv}(t, m)$ of the inverse matrix:

$$e(l) = \sum_{t=0}^{M-1} \cos(tl\theta) \sum_{m=0}^{M-1} q_{inv}(t, m)p(m) \quad (1 \le l \le [N_{uv}/2]) \tag{43-1}$$

$$e(l) = \sum_{m=0}^{M-1} p(m) \sum_{t=0}^{M-1} \cos(tl\theta) q_{inv}(t, m) \quad (1 \le l \le [N_{uv}/2]) \tag{43-2}$$

Let $w_{uv}(k)$ ($0 \leqq k < N_{uv}$) be the unvoiced waveform, and let C(f) be a power normalization coefficient corresponding to the pitch frequency f. Note that C(f) is given by equation (8) above using a pitch frequency $f_0$ that yields C(f)=1.0. This C(f) will be called a power normalization coefficient $C_{uv}$ used in unvoiced waveform generation ($C_{uv}$=C(f)).

In this embodiment, an unvoiced waveform is generated by superposing sine waves corresponding to integer multiples of the pitch frequency f while shifting their phases randomly. Let $\alpha_1$ ($0 \leqq 1 \leqq [N_{uv}/2]$) be the phase shift. $\alpha_1$ is set at a random value that falls within the range $-\pi \leqq \alpha_1 < \pi$. The unvoiced waveform $w_{uv}(k)$ ($0 \leqq k < N_{uv}$) is expressed by equations (44-1) to (44-3) below using the above-mentioned $C_{uv}$, p(m), and $\alpha_1$:

$$w_{uv}(k) = C_{uv} \sum_{l=1}^{[N_{uv}/2]} e(l)\sin(lk\theta + \alpha_1) \tag{44-1}$$

$$w_{uv}(k) = C_{uv} \sum_{l=1}^{[N_{uv}/2]} \sin(lk\theta + \alpha_1) \sum_{t=0}^{M-1} \cos(tl\theta) \sum_{m=0}^{M-1} q_{inv}(t, m)p(m) \tag{44-2}$$

$$w_{uv}(k) = C_{uv} \sum_{m=0}^{M-1} p(m) \sum_{l=1}^{[N_{uv}/2]} \sin(lk\theta + \alpha_1) \sum_{t=0}^{M-1} \cos(tl\theta) q_{inv}(t, m) \tag{44-3}$$

In place of directly calculating equation (44-3) above, the following tables may be stored to increase the calculation speed.

A waveform generation matrix UVWGM($i_{uv}$) having c($i_{uv}$,m) as an element calculated by equation (45-2) below using an unvoiced waveform index iuv (formula (45-1)) is stored in a table. Also, the number $N_{uv}$ of pitch period points and power normalization coefficient $C_{uv}$ are stored in tables.

$$i_{uv} \ (0 \le i_{uv} < N_{uv}) \tag{45-1}$$

$$c(i_{uv}, m) = \sum_{l=1}^{[N_{uv}/2]} \sin(li_{uv}\theta + \alpha_l) \sum_{t=0}^{M-1} \cos(tl\theta) q_{inv}(t, m) \ (0 \le m < M) \tag{45-2}$$

$$UVWGM(i_{uv}) = (c(i_{uv}, m)) \ (0 \le i_{uv} < N_{uv}, 0 \le m < M) \tag{45-3}$$

The waveform generation unit 309 generates an unvoiced waveform for one point by reading the power normalization coefficient $C_{uv}$ and the unvoiced waveform generation matrix UVWGM($i_{uv}$)=(c($i_{uv}$,m)) from the tables upon receiving the unvoiced waveform index $i_{uv}$ stored in the internal register and the synthesis parameters p(m) ($0 \leqq m < M$) output from the synthesis parameter interpolation unit 307, and by calculating:

$$w_{uv}(i_{uv}) = C_{uv} \sum_{m=0}^{M-1} c(i_{uv}, m)p(m) \tag{46}$$

After the unvoiced waveform is generated, the number $N_{uv}$ of pitch period points is read out from the table, and the unvoiced waveform index $i_{uv}$ is updated by equation (47-1) below. Also, the number $n_w$ of waveform points stored in the waveform point number storage unit 306 is updated by equation (47-2) below:

$$i_{uv} = \mathrm{mod}((i_{uv}+1), N_{uv}) \tag{47-1}$$

$$n_w = n_w + 1 \tag{47-2}$$

The above-mentioned operation will be explained below with reference to the flow chart in FIG. 15.

In step S301, a phonetic text is input by the character sequence input unit 301. In step S302, externally input control data (articulating speed and voice pitch) and control data included in the input phonetic text are stored in the control data storage unit 302. In step S303, the parameter generation unit 303 generates a parameter sequence on the basis of the phonetic text input by the character sequence input unit 301. FIG. 16 shows the data structure of parameters for one frame generated in step S303. As compared to FIG. 8, "uvflag" indicating voiced/unvoiced information is added.

In step S304, the internal registers of the waveform point number storage unit 306 are initialized to 0. If $n_w$ represents the number of waveform points, $n_w$=0 is set. Furthermore, in step S305, the parameter sequence counter i is initialized to 0. In step S306, the unvoiced waveform index $i_{uv}$ is initialized to 0.

In step S307, the parameter storage unit 304 loads parameters for the i-th and (i+1)-th frames output from the parameter generation unit 303. In step S308, the frame length setting unit 305 loads the articulating speech output from the control data storage unit 302. In step S309, the frame length setting unit 305 sets a frame length $N_i$ using articulating speech coefficients of the parameters stored in the parameter storage unit 304, and the articulating speed output from the control data storage unit 302.

In step S310, it is checked using the voiced/unvoiced information "uvflag" stored in the parameter storage unit 304 if the parameters for the i-th frame are those for an unvoiced waveform. If YES in step S310, the flow advances to step S311; otherwise, the flow advances to step S317.

In step S311, it is checked if the number $n_w$ of waveform points is smaller than the frame length $N_i$. If $n_w \geqq N_i$, the flow advances to step S315; if $n_w < N_i$, the flow advances to step S312 to continue processing.

In step S312, the waveform generation unit 309 (unvoiced waveform generator 309*b*) generates an unvoiced waveform using the synthesis parameters p(m) ($0 \leqq m < M$) input from the synthesis parameter interpolation unit 307. The power normalization coefficient $C_{uv}$ is read out from the table, and the unvoiced waveform generation matrix UVWGM{$i_{uv}$)=(c($i_{uv}$,m)) corresponding to the unvoiced waveform index $i_{uv}$ is read out from the table, thereby generating an unvoiced waveform in accordance with equation (46) above.

Let W(n) ($0 \leqq n$) be the speech waveform output as synthesized speech from the waveform generation unit 309, and $N_j$ be the frame length of the j-th frame. Then, the generated unvoiced waveforms are connected in accordance with equation (48-1) or (48-2) below:

$$W(n_w) - w_{uv}(i_{uv})\ (i = 0) \tag{48-1}$$

$$W\left(\sum_{j=0}^{i-1} N_j + n_w\right) = w_{uv}(i_{uv})\ (i > 0) \tag{48-2}$$

In step S313, the number $N_{uv}$ of unvoiced waveform points is read out from the table, and the unvoiced waveform index is updated by equation (49-1) below. In step S314, the waveform point number storage unit 306 updates the number $n_w$ of waveform points by equation (49-2) below. Thereafter, the flow returns to step S311 to continue processing.

$$i_{uv} = \mathrm{mod}((i_{uv}+1), N_{uv}) \tag{49-1}$$

$$n_w = n_w + 1 \tag{49-2}$$

On the other hand, if it is determined in step S310 that the voiced/unvoiced information indicates a voiced waveform, the flow advances to step S317 to generate and connect pitch waveforms for the i-th frame. The processing performed in this step is the same as that in steps S9, S10, S11, S12, and S13 in the first embodiment.

If $n_w \geqq N_i$ in step S311, the flow advances to step S315 to initialize the number $n_w$ of waveform points by:

$$n_w = n_w - N_i \tag{50}$$

Finally, it is checked in step S316 if processing of all the frames is complete. If NO in step S316, the flow advances to step S318. In step S318, externally input control data (articulating speed, voice pitch) are stored in the control data storage unit 302. In step S319, the parameter sequence counter i is updated by i=i+1. The flow then returns to step S307 to continue the above-mentioned processing. On the other hand, if it is determined in step S316 that processing of all the frames is complete, the processing ends.

As described above, according to the third embodiment, the same effects as in the first embodiment are expected. In addition, unvoiced waveforms can be generated and connected on the basis of the pitch and parameters of the speech to be synthesized. For this reason, the sound quality of synthesized speech can be prevented from deteriorating.

Upon generating unvoiced waveforms as well, since the products of the matrices and parameters obtained in advance are calculated in units of pitches, the calculation volume required for generating a speech waveform can be reduced.

[Fourth Embodiment]

The functional arrangement of a speech synthesis apparatus according to the fourth embodiment is the same as that in the first embodiment (FIG. 1). Pitch waveform generation performed by the waveform generation unit 9 of the fourth embodiment will be explained below.

Let p(m) ($0 \leqq m < M$) be the synthesis parameter used in pitch waveform generation. An analysis sampling frequency $f_{s1}$ represents the sampling frequency used in analyzing the power spectrum envelope as synthesis parameters. An analysis sampling period $T_{s1}$ is expressed by $T_{s1} = 1/f_{s1}$. If f represents the pitch frequency of the synthesized speech, a pitch period T is given by T=1/f. Hence, the number $N_{p1}(f)$ of analysis pitch period points is expressed by equation (51-1) below. When [x] represents a maximum integer equal to or smaller than x, equation (51-2) is obtained by quantizing the number $N_{p1}(f)$ of analysis pitch period points by an integer.

$$N_{p1}(f) = f_{s1}T = \frac{T}{T_{s1}} = \frac{f_{s1}}{f} \tag{51-1}$$

$$N_{p1}(f) = \left[\frac{f_{s1}}{f}\right] \tag{51-2}$$

If a synthesis sampling frequency $f_{s2}$ represents the sampling frequency of the synthesized speech, the number $N_{p2}(f)$ of synthesis pitch period points is given by equation (52-1) below, and is quantized by equation (52-2) below.

$$N_{p2}(f) = \frac{f_{s2}}{f} \tag{52-1}$$

$$N_{p2}(f) = \left[\frac{f_{s2}}{f}\right] \tag{52-2}$$

If $\theta_1$ represents the angle per point when the number of analysis pitch points is set in correspondence with an angle 2π, $\theta_1$ is given by:

$$\theta_1 = \frac{2\pi}{N_{p1}(f)} \tag{53}$$

Furthermore, a matrix Q is given by equations (54-1) and (54-2), and its inverse matrix of the matrix Q is given by equation (54-3). Note that t is a row index, and u is a column index.

$$Q = (q(t, u))\ (0 \le t < M,\ 0 \le u < M) \tag{54-1}$$

$$q(t, u) = \cos\left(tu\frac{2\pi}{N}\right) \tag{54-2}$$

$$Q^{-1} = (q_{inv}(t, u))\ (0 \le t < M,\ 0 \le u < M) \tag{54-3}$$

When the element $q_{inv}(t,m)$ of the above-mentioned inverse matrix is used, a value e(1) of the spectrum envelope corresponding to an integer multiple of the pitch frequency f is expressed by:

$$e(l) = \sum_{t=0}^{M-1} \cos(tl\theta_1) \sum_{m=0}^{M-1} q_{inv}(t, m)p(m)\ (1 \le l \le [N_p(f)/2]) \tag{55-1}$$

$$e(l) = \sum_{m=0}^{M-1} p(m) \sum_{t=0}^{M-1} \cos(tl\theta_1) q_{inv}(t, m)\ (1 \le l \le [N_p(f)/2]) \tag{55-2}$$

Furthermore, if $\theta_2$ represents the angle per point when the number of synthesis pitch period points is set in correspondence with 2π, $\theta_2$ is given by:

$$\theta_2 = \frac{2\pi}{N_{p2}(f)} \tag{56}$$

Let w(k) ($0 \leqq k < N_{p2}(f)$) be the pitch waveform, and C(f) be a power normalization coefficient corresponding to the pitch frequency f. Note that C(f) is given by equation (8)

above using a pitch frequency $f_0$ that yields C(f)=1.0. Accordingly, the pitch waveform w(k) is generated by superposing sine waves corresponding to integer multiples of the pitch frequency in accordance with the following equations (57-1) to (57-3):

$$w(k) = C(f) \sum_{l=1}^{[N_{pl}(f)/2]} e(l)\sin(lk\theta_2) \tag{57-1}$$

$$w(k) = C(f) \sum_{l=1}^{[N_{pl}(f)/2]} \sin(lk\theta_2) \sum_{t=0}^{M-1} \cos(tl\theta_1) \sum_{m=0}^{M-1} q_{inv}(t, m)p(m) \tag{57-2}$$

$$w(k) = C(f) \sum_{m=0}^{M-1} p(m) \sum_{l=1}^{[N_{pl}(f)/2]} \sin(lk\theta_2) \sum_{t=0}^{M-1} \cos(tl\theta_1) q_{inv}(t, m) \tag{57-3}$$

Alternatively, by superposing sine waves while shifting their phases by π, a pitch waveform w(k) ($0 \leqq k < N_{p2}(f)$) is generated by:

$$w(k) = C(f) \sum_{l=1}^{[N_{pl}(f)/2]} e(l)\sin(l(k\theta_2 + \pi)) \tag{58-1}$$

$$w(k) = C(f) \sum_{l=1}^{[N_{pl}(f)/2]} \sin(l(k\theta_2 + \pi)) \sum_{t=0}^{M-1} \cos(tl\theta_1) \sum_{m=0}^{M-1} q_{inv}(t, m)p(m) \tag{58-2}$$

$$w(k) = C(f) \sum_{m=0}^{M-1} p(m) \sum_{l=1}^{[N_{pl}(f)/2]} \sin(l(k\theta_2 + \pi)) \sum_{t=0}^{M-1} \cos(tl\theta_1) q_{inv}(t, m) \tag{58-3}$$

In place of directly calculating equations (57-3) or (58-3) above, the calculation speed may be increased as follows. Assume that a pitch scale s is used as a measure for expressing the voice pitch, $N_{p1}(s)$ represents the number of analysis pitch points corresponding to the pitch scale $s \in S$ (S is a set of pitch scales), and $N_{p2}(s)$ represents the number of synthesis pitch period points corresponding to the pitch scale s. In this case, $\theta_1$ and $\theta_2$ are respectively given by equations (59-1) and (59-2) below in accordance with equations (53) and (56) above:

$$\theta_1 = \frac{2\pi}{N_{p1}(s)} \tag{59-1}$$

$$\theta_2 = \frac{2\pi}{N_{p2}(s)} \tag{59-2}$$

A waveform generation matrix corresponding to each pitch scale is generated based on $c_{km}(s)$ obtained by equation (60-1) below when equation (57-3) above is used or by equation (60-2) below when equation (58-3) above is used (equation (60-3)), and is stored in a table:

$$c_{km}(s) = \sum_{l=1}^{[N_{pl}(s)/2]} \sin(lk\theta_2) \sum_{t=0}^{M-1} \cos(tl\theta_1) q_{inv}(t, m) \tag{60-1}$$

-continued $$c_{km}(s) = \sum_{l=1}^{[N_{pl}(s)/2]} \sin(l(k\theta_2 + \pi)) \sum_{t=0}^{M-1} \cos(tl\theta_1) q_{inv}(t, m) \tag{60-2}$$

$$WGM(s) = (c_{km}(s)) \ (0 \le k < N_{p2}(s), 0 \le m < M) \tag{60-3}$$

Furthermore, the number $N_{p2}(s)$ of synthesis pitch period points and power normalization coefficient C(s) corresponding to the pitch scale s are stored in tables.

The waveform generation unit 9 reads out the number $N_{p2}(s)$, power normalization coefficient C(s), and waveform generation matrix WGM(s)=($c_{km}(s)$) from the tables upon receiving synthesis parameters p(m) output from the synthesis parameter interpolation unit 7 and pitch scales s output from the pitch scale interpolation unit 8, and generates a pitch waveform by the following equation (61):

$$w(k) = C(s) \sum_{m=0}^{M-1} c_{km}(s)p(m) \ (0 \le k < N_{p2}(s)) \tag{61-1}$$

$$\left.\begin{aligned} W(n_w + k) &= w(k) && (i = 0, 0 \le k < N_{p2}(s)) \\ W\left(\sum_{j=0}^{i-1} N_j + n_w + k\right) &= w(k) && (i > 0, 0 \le k < N_{p2}(s)) \end{aligned}\right\} \tag{61-2}$$

$$n_w = n_w + N_{p2}(s) \tag{61-3}$$

The above-mentioned operation will be described below with reference to the flow chart shown in FIG. 7 used in the first embodiment. Note that the processing operations in steps S1 to S11, and steps S14 to S17 are the same as those in the first embodiment.

In step S12, the waveform generation unit 9 generates a pitch waveform using the synthesis parameter p[m] ($0 \leqq m < M$) obtained by equation (15) above and pitch scale s obtained by equation (17) above. More specifically, the waveform generation unit 9 reads out the number $N_{p2}(s)$ of synthesis pitch period points, the power normalization coefficient C(s), and the waveform generation matrix WGM(s)= ($C_{km}(s)$) ($0 \leqq k \leqq N_{p2}(s)$, $0 \leqq m < M$) corresponding to the pitch scale s from the corresponding tables, and generates a pitch waveform using equation (61) mentioned above.

The generated pitch waveforms are connected based on equation (61-2) using a speech waveform W(n) output as synthesized speech from the waveform generation unit 9 and the frame length $N_j$ of the j-th frame. In step S13, the waveform point number storage unit 6 updates the number $n_w$ of waveform points by equation (61-3).

As described above, according to the fourth embodiment, the same effects as in the first embodiment are expected. Also, upon generating pitch waveforms, pitch waveforms can be generated and connected at an arbitrary sampling frequency using parameters (power spectrum envelope) obtained at a given sampling frequency. Hence, synthesized speech at an arbitrary sampling frequency can be generated by a simple arrangement.

[Fifth Embodiment]

The functional arrangement of a speech synthesis apparatus of the fifth embodiment is the same as that of the first embodiment (FIG. 1). Pitch waveform generation done by the waveform generation unit 9 of the fifth embodiment will be explained below.

As in the first embodiment, let p(m) ($0 \leqq m < M$) be the synthesis parameter used in pitch waveform generation, let $f_s$ be the sampling frequency, $T_s$ (=$1/f_s$) be the sampling period, let f be the pitch frequency of synthesized speech, let T (=1/f) be the pitch period, let $N_p(f)$ be the number of pitch period points, and let θ be the angle per point when the pitch period is set in correspondence with an angle 2π. Also, an element $q_{inv}(t,u)$ of an inverse matrix of a matrix Q defined by equations (6-1) to (6-3) above is used. Then, the value of the spectrum envelope corresponding to an integer multiple of the pitch frequency is expressed by equations (7-1) and (7-2) above.

In the fifth embodiment, the pitch waveform is expressed by superposing cosine waves corresponding to integer multiples of the fundamental frequency. In this case, a power normalization coefficient corresponding to the pitch frequency f is expressed by C(f) (equation (8)) as in the first embodiment, and a pitch waveform w(k) is expressed by equations (62-1) to (62-3):

$$w(k) = C(f) \sum_{l=1}^{[N_p(f)/2]} e(l)\cos(lk\theta) \tag{62-1}$$

$$w(k) = C(f) \sum_{l=1}^{[N_p(f)/2]} \cos(lk\theta) \sum_{m=0}^{M-1} p(m) \sum_{t=0}^{M-1} \cos(tl\theta_1) q_{inv}(t, m) \tag{62-2}$$

$$w(k) = C(f) \sum_{m=0}^{M-1} p(m) \sum_{l=1}^{[N_p(f)/2]} \cos(lk\theta) \sum_{t=0}^{M-1} \cos(tl\theta) q_{inv}(t, m) \tag{62-3}$$

Figure 17:
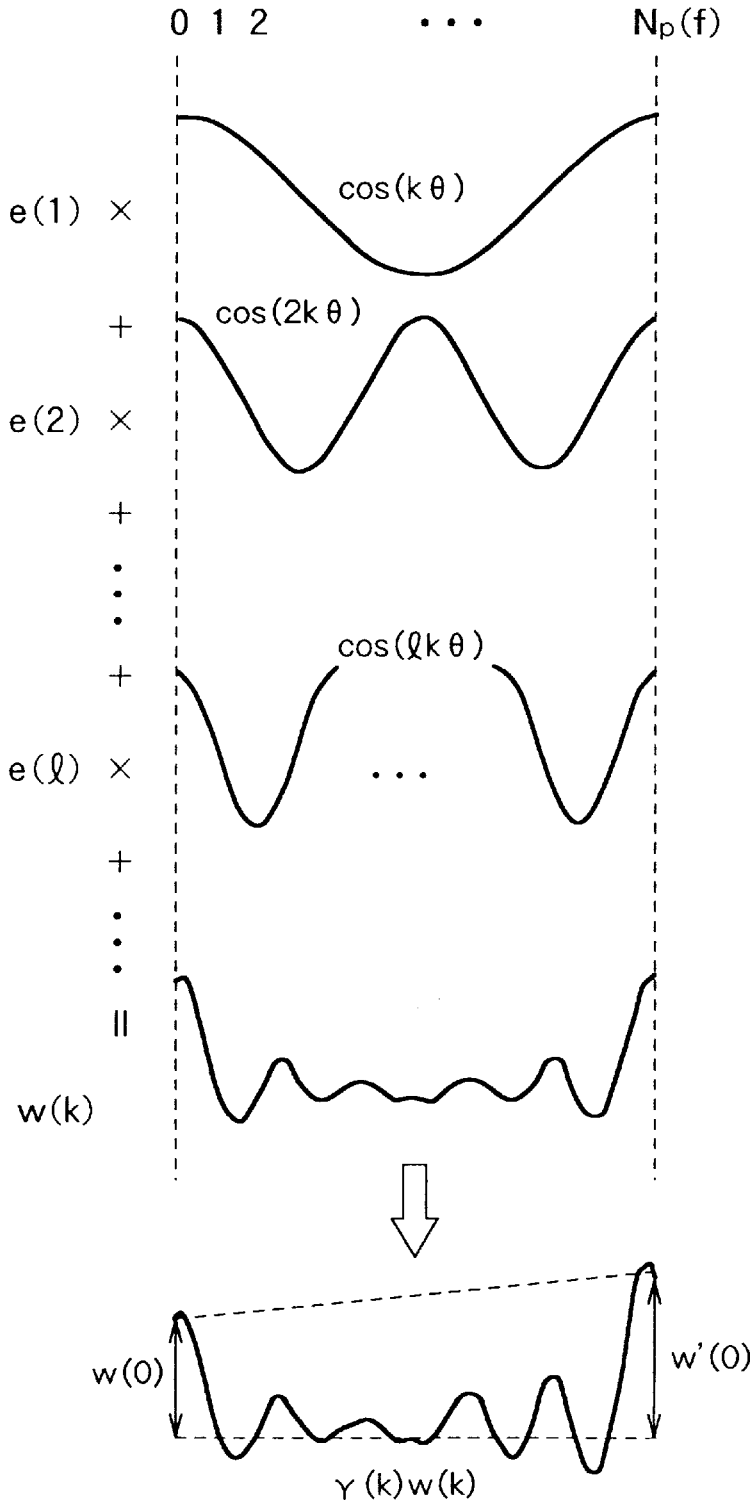
FIG. 17 is a chart for explaining the generation process of a pitch waveform by superposing sine waves according to the fifth embodiment.

Furthermore, when f' represents the pitch frequency of the next pitch waveform, the 0th-order value w' (0) of the next pitch waveform is defined by equation (63-1) below. If γ(k) is defined as in equations (63-2) and (63-3) below, a pitch waveform w(k) ($0 \leqq k < N_p(f)$) is generated using equation (63-4) below. Note that FIG. 17 shows the generation state of pitch waveforms according to the fifth embodiment. In this way, by correcting the amplitude of each pitch waveform, connection to the next pitch waveform can be satisfactorily performed.

$$w'(0) = C(f') \sum_{m=0}^{M-1} p(m) \sum_{l=1}^{[N_p(f')/2]} \sum_{t=0}^{M-1} \cos(tl\theta) q_{inv}(t, m) \tag{63-1}$$

$$\gamma_0 = \frac{w'(0)}{w(0)} \tag{63-2}$$

$$\gamma(k) = 1 + \frac{\gamma_0 - 1}{N_p(f)} \cdot k \ (0 \le k < N_p(f)) \tag{63-3}$$

$$w(k) = \gamma(k) w(k) \tag{63-4}$$

Figure 18:
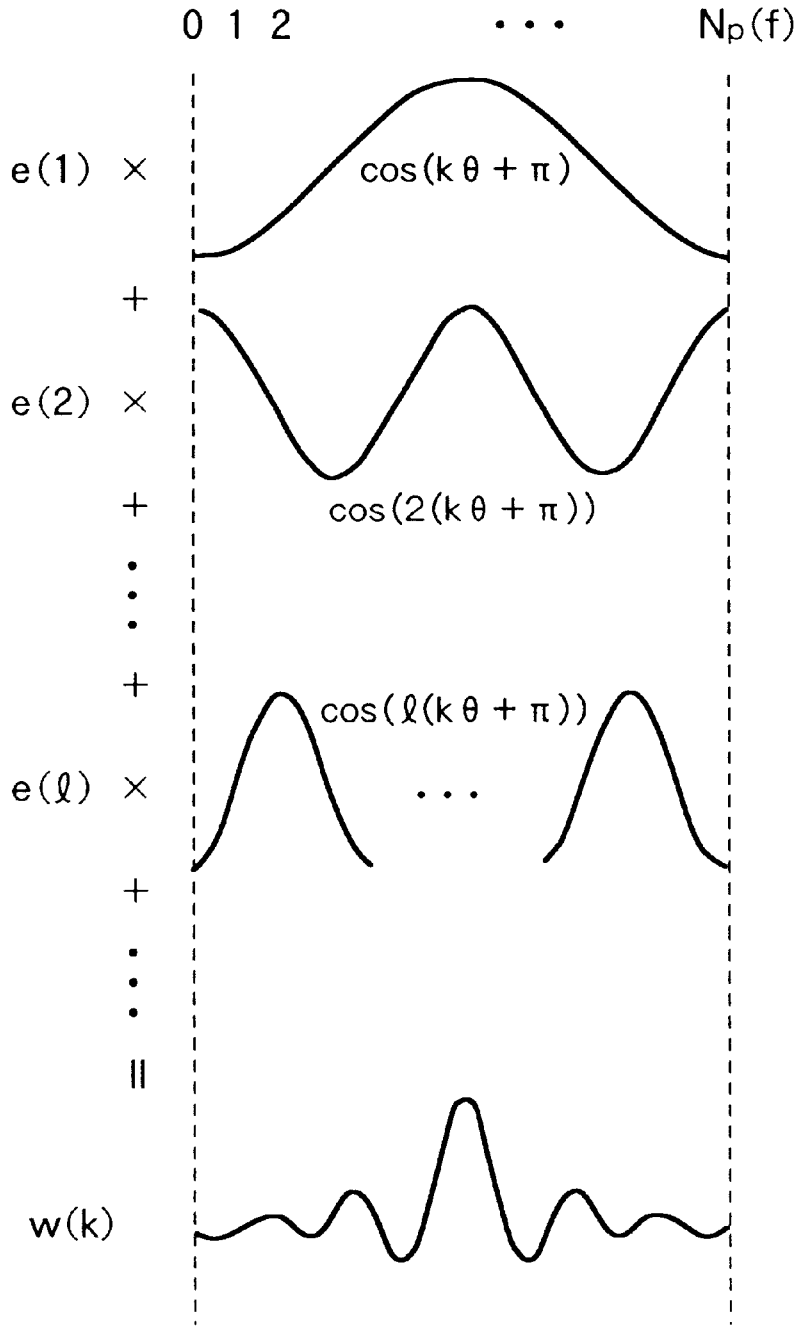
FIG. 18 is a chart for explaining the generation process of a waveform by superposing sine waves whose phases are shifted by $\pi$ from those in FIG. 17.

Alternatively, by superposing cosine waves while shifting their phases, a pitch waveform w(k) ($0 \leqq k < N_p(f)$) is generated by equations (64-1) to (64-3). Note that FIG. 18 explains waveform generation according to equations (64-1) to (64-3).

$$w(k) = C(f) \sum_{l=1}^{[N_p(f)/2]} e(l)\cos(l(k\theta + \pi)) \tag{64-1}$$

$$w(k) = C(f) \sum_{l=1}^{[N_p(f)/2]} \cos(l(k\theta + \pi)) \sum_{m=0}^{M-1} p(m) \sum_{t=0}^{M-1} \cos(tl\theta) q_{inv}(t, m) \tag{64-2}$$

-continued $$w(k) = C(f) \sum_{m=0}^{M-1} p(m) \sum_{l=1}^{[N_p(f)/2]} \cos(l(k\theta + \pi)) \sum_{t=0}^{M-1} \cos(tl\theta) q_{inv}(t, m) \tag{64-3}$$

In place of directly calculating equations (62-3) or (64-3) above, the calculation speed can be increased as follows. Assume that a pitch scale s is used as a measure for expressing the voice pitch, $N_p(s)$ represents the number of pitch points corresponding to the pitch scale s. In this case, θ is given by equation (65-1) below. A waveform generation matrix WGM(s) is calculated for each pitch scale s using equation (65-2) below when equation (62-3) above is used or equation (65-3) below when equation (64-3) above (equation 65-4)) is used, and is stored in a table.

$$\theta = \frac{2\pi}{N_p(s)} \tag{65-1}$$

$$c_{km}(s) = \sum_{l=1}^{[N_p(s)/2]} \cos(lk\theta) \sum_{t=0}^{M-1} \cos(tl\theta) q_{inv}(t, m) \tag{65-2}$$

$$c_{km}(s) = \sum_{l=1}^{[N_p(s)/2]} \cos(l(k\theta + \pi)) \sum_{t=0}^{M-1} \cos(tl\theta) q_{inv}(t, m) \tag{65-3}$$

$$WGM(s) = (c_{km}(s)) \ (0 \le k < N_p(s),\ 0 \le m < M) \tag{65-4}$$

Furthermore, the number $N_p(s)$ of pitch period points and power normalization coefficient C(s) corresponding to the pitch scale s are stored in tables.

The waveform generation unit 9 reads out the number $N_p(s)$ of synthesis pitch period points, power normalization coefficient C(s), and waveform generation matrix WGM(s)= ($c_{km}(s)$) from the tables upon receiving synthesis parameters p(m) ($0 \leqq m < M$) output from the synthesis parameter interpolation unit 7 and the pitch scales s output from the pitch scale interpolation unit 8, and generates a pitch waveform by calculating:

$$w(k) = C(s) \sum_{m=0}^{M-1} c_{km}(s) p(m) \ (0 \le k < N_p(s)) \tag{66}$$

When the waveform generation matrix is calculated using equation (65-2) above, the waveform generation unit 9 substitutes a pitch scale s' of the next pitch waveform into equation (63-4) above, and calculates the pitch waveform using the following equations (67-1) to (67-4):

$$w'(0) = C(s') \sum_{m=0}^{M-1} p(m) \sum_{l=1}^{[N_p(s')/2]} \sum_{t=0}^{M-1} \cos(tl\theta) q_{inv}(t, m) \tag{67-1}$$

$$\gamma_0 = \frac{w'(0)}{w(0)} \tag{67-2}$$

$$\gamma(k) = 1 + \frac{\gamma_0 - 1}{N_p(s)} \cdot k \ (0 \le k < N_p(s)) \tag{67-3}$$

$$w(k) = \gamma(k) w(k) \tag{67-4}$$

The above-mentioned operation will be explained below with reference to the flow chart in FIG. 7. Steps S1 to S11, and steps S13 to S17 implement the same processing as that in the first embodiment. The processing in step S12 according to the fifth embodiment will be described below.

In step S12, the waveform generation unit 9 generates a pitch waveform using the synthesis parameter p[m] ($0 \leqq m < M$) obtained by equation (15) above and pitch scale s obtained by equation (17) above. More specifically, the waveform generation unit 9 reads out the number $N_p(s)$ of synthesis pitch period points, the power normalization coefficient C(s), and the waveform generation matrix WGM(s)= $(C_{km}(s))$ ($0 \leqq k < N_p(s)$, $0 \leqq m < M$) corresponding to the pitch scale s from the corresponding tables, and generates a pitch waveform using equation (66) mentioned above.

Furthermore, when the waveform generation matrix is calculated using equation (65-2) above, the waveform generation unit 9 reads out a pitch scale difference $\Delta_s$ per point from the pitch scale interpolation unit 8, and calculates the pitch scale s' of the next pitch waveform using equation (68-1) below. Using the calculated pitch scale s', the unit 9 calculates γ(k) by equations (68-2) to (68-4) below, and obtains a pitch waveform by equation (68-5) below:

$$s' = s + N_p(s)\Delta_s \tag{68-1}$$

$$w'(0) = C(s')\sum_{m=0}^{M-1} p(m) \sum_{l=1}^{[N_p(s')/2]} \sum_{t=0}^{M-1} \cos(tl\theta) q_{inv}(t, m) \tag{68-2}$$

$$\gamma_0 = \frac{w'(0)}{w(0)} \tag{68-3}$$

$$\gamma(k) = 1 + \frac{\gamma_0 - 1}{N_p(s)} \cdot k \quad (0 \leq k < N_p(s)) \tag{68-4}$$

$$w(k) = \gamma(k) w(k) \tag{68-5}$$

Connection of the generated pitch waveforms is done, as has been described above with reference to FIG. 11. More specifically, the pitch waveforms are connected by equations (69) below to have a speech waveform W(n) ($0 \leqq n$) output as synthesized speech from the waveform generation unit 9 and a frame length $N_j$ of the j-th frame:

$$\left.\begin{aligned} W(n_w + k) &= w(k) && (i = 0,\ 0 \leq k < N_p(s)) \\ W\left(\sum_{j=0}^{i-1} N_j + n_w + k\right) &= w(k) && (i > 0,\ 0 \leq k < N_p(s)) \end{aligned}\right\} \tag{69}$$

As may be apparent from the above, according to the fifth embodiment, the same effects as in the first embodiment are expected, and pitch waveforms can be generated on the basis of the product sum of cosine series. Furthermore, upon connecting the pitch waveforms, the pitch waveforms are corrected so that adjacent pitch waveforms have equal amplitude values, thus obtaining natural synthesized speech.

[Sixth Embodiment]

The functional arrangement of a speech synthesis apparatus according to the sixth embodiment is the same as that in the first embodiment (FIG. 1). Pitch waveform generation performed by the waveform generation unit 9 of the sixth embodiment will be explained below.

As in the first embodiment, let p(m) ($0 \leqq m < M$) be the synthesis parameter used in pitch waveform generation, let $f_s$ be the sampling frequency, $T_s$ ($=1/f_s$) be the sampling period, let f be the pitch frequency of synthesized speech, let T ($=1/f$) be the pitch period, $N_p(f)$ be the number of pitch period points, and let θ be the angle per point when the pitch period is set in correspondence with an angle 2π. Also, an element $q_{inv}(t,u)$ of an inverse matrix of a matrix Q defined by equations (6-1) to (6-3) above is used. Then, the value of the spectrum envelope corresponding to an integer multiple of the pitch frequency is expressed by equations (7-1) and (7-2) above.

The sixth embodiment obtains half-period pitch waveforms w(k) by utilizing symmetry of the pitch waveform, and generates a speech waveform by connecting them. Hence, in the sixth embodiment, a half-period pitch waveform w(k) is defined by:

$$w(k) \quad \left(0 \leq k \leq \left[\frac{N_p(f)}{2}\right]\right) \tag{70}$$

If a power normalization coefficient C(f) corresponding to the pitch frequency f is given by equation (8) above, a half-period pitch waveform w(k) ($0 \leqq k \leqq [N_p(f)/2]$) is generated by equations (71-1) to (71-3) by superposing sine waveforms corresponding to integer multiples of the fundamental frequency:

$$w(k) = C(f) \sum_{l=1}^{[N_p(f)/2]} e(l)\sin(lk\theta) \tag{71-1}$$

$$w(k) = C(f) \sum_{l=1}^{[N_p(f)/2]} \sin(lk\theta) \sum_{m=0}^{M-1} p(m) \sum_{t=0}^{M-1} \cos(tl\theta) q_{inv}(t, m) \tag{71-2}$$

$$w(k) = C(f) \sum_{m=0}^{M-1} p(m) \sum_{l=1}^{[N_p(f)/2]} \sin(lk\theta) \sum_{t=0}^{M-1} \cos(tl\theta) q_{inv}(t, m) \tag{71-3}$$

Alternatively, by superposing sine waves while shifting their phases by π, a half-period pitch waveform w(k) ($0 \leqq k < [N_p(f)/2]$) is generated by:

$$w(k) = C(f) \sum_{l=1}^{[N_p(f)/2]} e(l)\sin(l(k\theta + \pi)) \tag{72-1}$$

$$w(k) = C(f) \sum_{l=1}^{[N_p(f)/2]} \sin(l(k\theta + \pi)) \sum_{m=0}^{M-1} p(m) \sum_{t=0}^{M-1} \cos(tl\theta) q_{inv}(t, m) \tag{72-2}$$

$$w(k) = C(f) \sum_{m=0}^{M-1} p(m) \sum_{l=1}^{[N_p(f)/2]} \sin(l(k\theta + \pi)) \sum_{t=0}^{M-1} \cos(tl\theta) q_{inv}(t, m) \tag{72-3}$$

Instead of directly calculating equations (71-3) or (72-3) above, the calculation speed may be increased as follows. Assume that a pitch scale s is used as a measure for expressing the voice pitch, and waveform generation matrices WGM(s) corresponding to the respective pitch scales s are calculated and stored in a table. Assuming that $N_p(s)$ represents the number of pitch period points corresponding to the pitch scale s, $c_{km}(s)$ is calculated by equation (73-2) below when equation (71-3) above is used or by equation (73-3) below when equation (72-3) above is used, and a waveform generation matrix is obtained by equation (73-4) below:

$$\theta = \frac{2\pi}{N_p(s)} \tag{73-1}$$

-continued $$c_{km}(s) = \sum_{l=1}^{[N_p(s)/2]} \sin(lk\theta) \sum_{t=0}^{M-1} \cos(tl\theta) q_{inv}(t, m) \tag{73-2}$$

-continued $$c_{km}(s) = \sum_{l=1}^{[N_p(s)/2]} \sin(l(k\theta + \pi)) \sum_{t=0}^{M-1} \cos(tl\theta) q_{inv}(t, m) \tag{73-3}$$

$$WGM(s) = (c_{km}(s)) \left(0 \le k \le \left[\frac{N_p(f)}{2}\right], 0 \le m < M\right) \tag{73-4}$$

Furthermore, the number $N_p(s)$ of pitch period points and power normalization coefficient C(s) corresponding to the pitch scale s are stored in tables.

The waveform generation unit 9 reads out the number $N_p(s)$ of pitch period points, the power normalization coefficient C(s), and the waveform generation matrix WGM(s) $=(c_{km}(s))$ from the tables upon receiving synthesis parameters p(m) ($0 \leqq m \leqq M$) output from the synthesis parameter interpolation unit 7 and pitch scales s output from the pitch scale interpolation unit 8, and generates a half-period pitch waveform by:

$$w(k) = C(s) \sum_{m=0}^{M-1} c_{km}(s) p(m) \left(0 \le k \le \left[\frac{N_p(s)}{2}\right]\right) \tag{74}$$

The above-mentioned operation will be described below with reference to the flow chart in FIG. 7. Steps S1 to S11, and steps S13 to S17 implement the same processing as that in the first embodiment. The processing in step S12 according to the sixth embodiment will be described in detail below.

In step S12, the waveform generation unit 9 generates a half-period pitch waveform using the synthesis parameter p[m] ($0 \leqq m < M$) obtained by equation (15) above and pitch scale s obtained by equation (17) above. More specifically, the waveform generation unit 9 reads out the number $N_p(s)$ of pitch period points, the power normalization coefficient C(s), and the waveform generation matrix WGM(s)=($C_{km}$(s)) ($0 \leqq k \leqq [N_p(s)/2]$, $0 \leqq m < M$) corresponding to the pitch scale s from the corresponding tables, and generates a half-period pitch waveform using equation (74) above.

Connection of the generated half-period pitch waveforms will be explained below. Let W(n) ($0 \leqq n$) be the speech waveform output as synthesized speech from the waveform generation unit 9. Connection of half-period pitch waveforms w(k) is done by equation (75) below using a frame length $N_j$ of the j-th frame:

$$\begin{cases} W(n_w + k) = w(k) & \left(i = 0, 0 \le k \le \left[\frac{N_p(s)}{2}\right]\right) \\ W\left(\sum_{j=0}^{i-1} N_j + n_w + k\right) = w(k) & \left(i > 0, 0 \le k \le \left[\frac{N_p(s)}{2}\right]\right) \\ W(n_w + k) = -w(N_p(s) - k & \left(i = 0, \left[\frac{N_p(s)}{2}\right] < k < N_p(s)\right) \\ W\left(\sum_{j=0}^{i-1} N_j + n_w + k\right) = -w(N_p(s) - k) & \left(i > 0, \left[\frac{N_p(s)}{2}\right] < k < N_p(s)\right) \end{cases} \tag{75}$$

In summary, according to the sixth embodiment, the same effects as in the first embodiment are expected, and waveform symmetry is exploited upon generating pitch waveforms, thus reducing the calculation volume required for generating a speech waveform.

[Seventh Embodiment]

The functional arrangement of a speech synthesis apparatus according to the seventh embodiment is the same as that in the first embodiment (FIG. 1). Pitch waveform generation performed by the waveform generation unit 9 of the seventh embodiment will be explained below with reference to FIGS. 19A to 19D. The seventh embodiment generates pitch waveforms for half the period of the extended pitch waveform described above in the second embodiment by utilizing symmetry of the pitch waveform, and connects these waveforms.

Figure 19A:
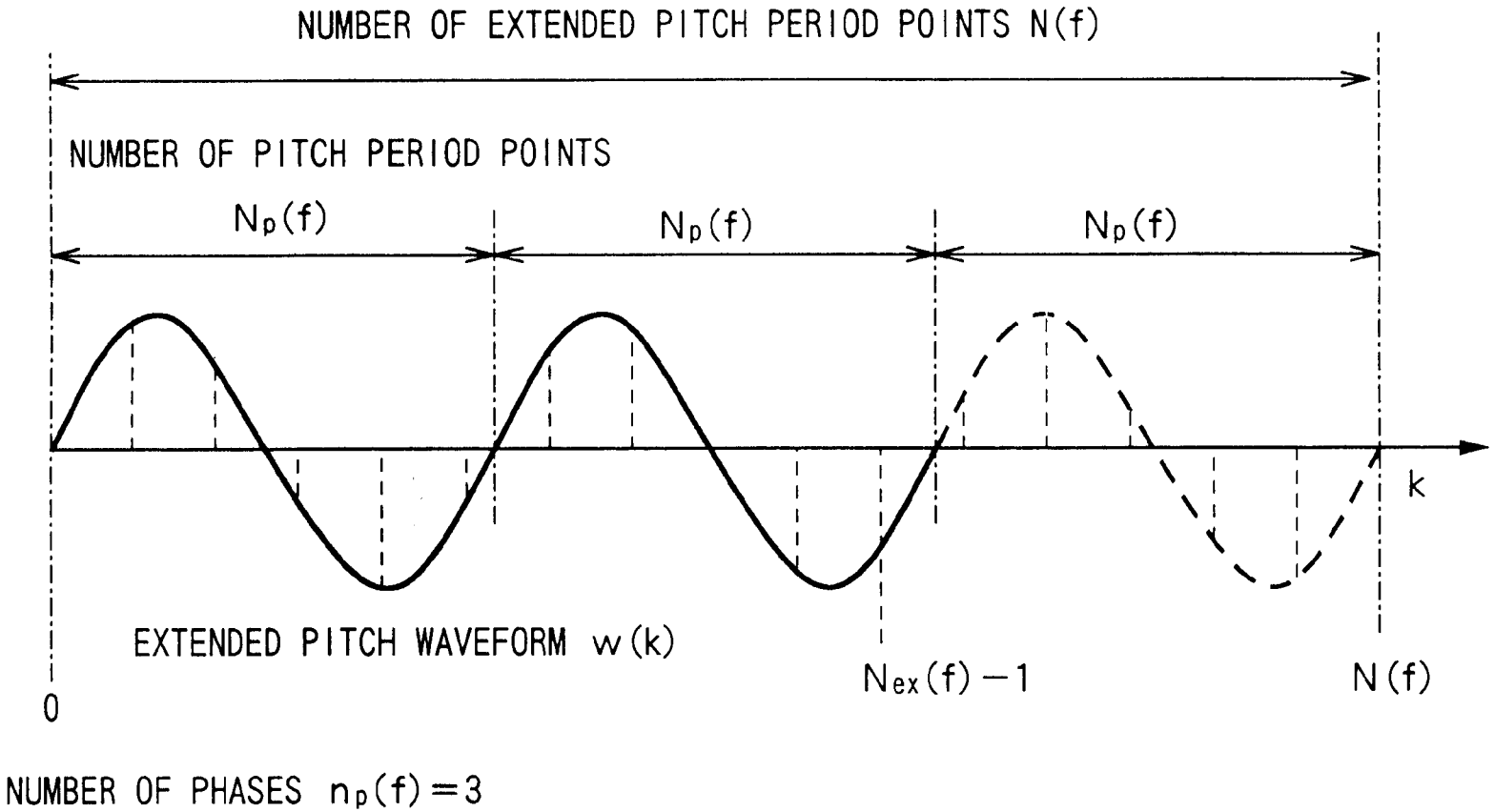
FIG. 19A is a graph for explaining an extended pitch waveform according to the seventh embodiment.
Figure 19B:
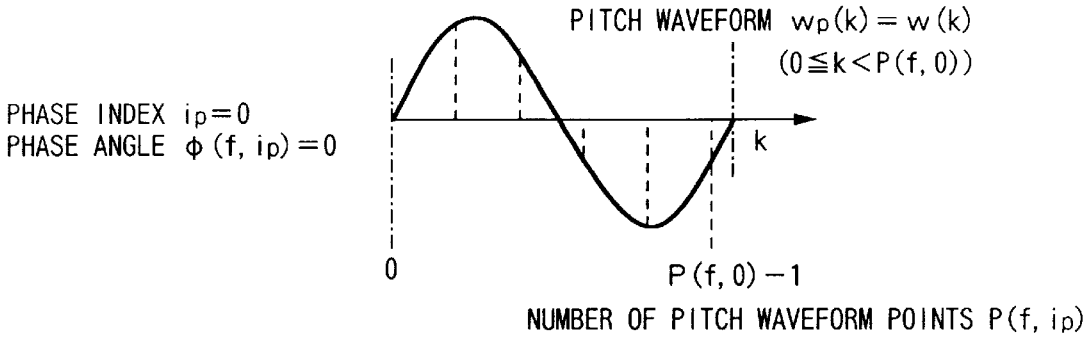
FIGS. 19B to 19D are graphs showing the pitch waveforms in different phases on the extended pitch waveform shown in FIG. 19A.
Figure 19C:
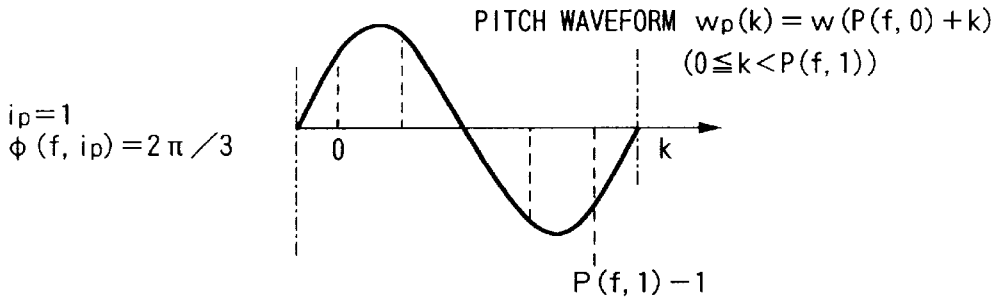
Figure 19D:
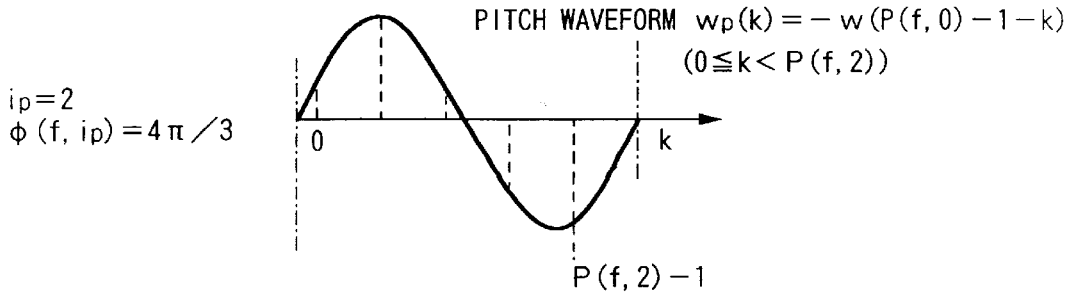

As in the second embodiment, let p(m) ($0 \leqq m < M$) be the synthesis parameter used in pitch waveform generation, let $f_s$ be the sampling frequency, let $T_s$ ($=1/f_s$) be the sampling period, let f be the pitch frequency of synthesized speech, let T ($=1/f$) be the pitch period, and let $n_p(f)$ be the number of phases indicating the number of pitch waveforms corresponding to the frequency f. Equations (21-1), (21-2), and (22) above define the number N(f) of extended pitch period points, the number $N_p(f)$ of pitch period points, and an angle $\theta_1$ per point when the number $N_p(f)$ of pitch period points is set in correspondence with an angle $2\pi$. The value of the spectrum envelope corresponding to an integer multiple of the pitch frequency is given by equations (23-1) and (23-2) above using an element $q_{inv}(t,u)$ of an inverse matrix of a matrix Q defined by equations (6-1) to (6-3) above. FIG. 19A shows an example of pitch waveforms when $n_p(f)=3$.

If $\theta_2$ represents the angle per point when the number of extended pitch period points is set in correspondence with $2\pi$, $\theta_2$ is given by equation (76-1) below. Also, mod(a,b) represents "the remainder obtained when a is divided by b", and the number $N_{ex}(f)$ of extended pitch waveform points is defined by equation (76-2) below:

$$\theta_2 = \frac{2\pi}{N(f)} \tag{76-1}$$

-continued $$N_{ex}(f) = \left[\frac{\left[\frac{n_p(f)+1}{2}\right]N(f)}{n_p(f)}\right] - \left[1 - \frac{\mathrm{mod}\left(\left(\left[\frac{n_p(f)+1}{2}\right]N(f)\right), n_p(f)\right)}{n_p(f)}\right] + 1 \tag{76-2}$$

Assuming that C(f) represents a power normalization coefficient corresponding to the pitch frequency f and is given by equation (8) above, an extended pitch waveform w(k) ($0 \leqq k < N_{ex}(f)$) is generated by equations (77-1) to (77-3) by superposing sine waves corresponding to integer multiples of the pitch frequency:

$$w(k) = C(f) \sum_{l=1}^{[N_p(f)/2]} e(l)\sin(lkn_p(f)\theta_2) \tag{77-1}$$

$$w(k) = C(f) \sum_{l=1}^{[N_p(f)/2]} \sin(lkn_p(f)\theta_2) \sum_{t=0}^{M-1} \cos(tl\theta) \sum_{m=0}^{M-1} q_{inv}(t, m)p(m) \tag{77-2}$$

$$w(k) = C(f) \sum_{m=0}^{M-1} p(m) \sum_{l=1}^{[N_p(f)/2]} \sin(lkn_p(f)\theta_2) \sum_{t=0}^{M-1} \cos(tl\theta_1) q_{inv}(t, m) \tag{77-3}$$

Alternatively, the extended pitch waveform w(k) ($0 \leqq k < N_{ex}(f)$) is generated by equations (78-1) to (78-3) by superposing sine waves while shifting their phases by $\pi$:

$$w(k) = C(f) \sum_{l=1}^{[N_p(f)/2]} e(l)\sin(l(kn_p(f)\theta_2 + \pi)) \tag{78-1}$$

$$w(k) = C(f) \sum_{l=1}^{[N_p(f)/2]} \sin(l(kn_p(f)\theta_2 + \pi)) \sum_{t=0}^{M-1} \cos(tl\theta_1) \sum_{m=0}^{M-1} q_{inv}(t, m)p(m) \tag{78-2}$$

$$w(k) = C(f) \sum_{m=0}^{M-1} p(m) \sum_{l=1}^{[N_p(f)/2]} \sin(l(kn_p(f)\theta_2 + \pi)) \sum_{t=0}^{M-1} \cos(tl\theta_1) q_{inv}(t, m) \tag{78-3}$$

A phase index $i_p$ is defined by equation (79-1) below. Also, a phase angle $\phi(f,i_p)$ corresponding to the pitch frequency f and phase index $i_p$ is defined by equation (79-2) below. Furthermore, $r(f,i_p)$ is defined by equation (79-3) below:

$$i_p \quad (0 \le i_p < n_p(f)) \tag{79-1}$$

$$\phi(f, i_p) = \frac{2\pi}{n_p(f)} i_p \tag{79-2}$$

$$r(f, i_p) = \mathrm{mod}(i_p N(f), n_p(f)) \tag{79-3}$$

Accordingly, the number $P(f,i_p)$ of pitch waveform points of a pitch waveform corresponding to the phase index $i_p$ is calculated by:

$$P(f, i_p) = \left[\frac{(i_p+1)N(f)}{n_p(f)}\right] - \left[1 - \frac{r(f, i_p+1)}{n_p(f)}\right] - \left[\frac{i_p N(f)}{n_p(f)}\right] + \left[1 - \frac{r(f, i_p)}{n_p(f)}\right] \tag{80}$$

A pitch waveform corresponding to the phase index $i_p$ is obtained by:

$$w_p(k) = \begin{cases} w(k) & (i_p = 0, 0 \le k < P(f, i_p)) \\ w\left(\sum_{j=0}^{i_p-1} P(f, j) + k\right) & \left(0 \le i_p < \left[\frac{N_p(f)+1}{2}\right], 0 \le k < P(f, i_p)\right) \\ -w\left(\sum_{j=0}^{n_p(f)-1-i_p} P(f, j) - 1 - k\right) & \left(\left[\frac{N_p(f)+1}{2}\right] \le i_p < n_p(f), 0 \le k < P(f, i_p)\right) \end{cases} \tag{81}$$

Thereafter, the phase index $i_p$ is updated by equation (82-1) below, and the phase angle $\phi_p$ is calculated by equation (82-2) below using the updated phase index $i_p$:

$$i_p = \mathrm{mod}((i_p+1), n_p(f)) \tag{82-1}$$

$$\phi_p = \phi(f, i_p) \tag{82-2}$$

Furthermore, when the pitch frequency is changed to f' upon generating the next pitch waveform, i' that satisfies equation (83-1) below is calculated to obtain a phase angle closest to $\phi_p$, and $i_p$ is determined by equation (83-2) below:

$$|\phi(f', i') - \phi_p| = \min_{0 \le i < n_p(f')} |\phi(f', i) - \phi_p| \tag{83-1}$$

$$i_p = i' \tag{83-2}$$

In lieu of directly calculating equations (77-3) or (78-3) above, the calculation speed can be increased as follows. Assume that the pitch scale s is used as a measure for expressing the voice pitch. Also, let $n_p(s)$ be the number of phases corresponding to pitch scale $s \in S$ (S is a set of pitch scales), let $i_p$ ($0 \leqq i_p < n_p(s)$) be the phase index, N(s) be the number of extended pitch period points, and let $P(s,i_p)$ be the number of pitch waveform points. Then, a waveform generation matrix $WGM(s,i_p)$ corresponding to each pitch scale s and phase index $i_p$ is calculated and stored in a table. Initially, $\theta_1$ and $\theta_2$ are obtained by equations (84-1) and (84-2) below in accordance with equations (22) and (76-1) above. Thereafter, $c_{km}(s,i_p)$ is calculated by equation (84-3) below when equation (77-3) above is used or by equation (84-4) below when equation (78-3) above is used, and the waveform generation matrix $WGM(s,i_p)$ is calculated by equation (84-5) below:

$$\theta_1 = \frac{2\pi}{N_p(s)} \tag{84-1}$$

$$\theta_2 = \frac{2\pi}{N(s)} \tag{84-2}$$

$$c_{km}(s, i_p) = \begin{cases} \sum_{l=1}^{[N_p(s)/2]} \sin(lkn_p(s)\theta_2)\cos(ml\theta_1) & (i_p = 0) \\ \sum_{l=1}^{[N_p(s)/2]} \sin\left(l\left(\sum_{j=0}^{i_p-1} p(s, j) + k\right)n_p(s)\theta_2\right)\cos(ml\theta_1) & \left(0 < i_p < \left[\frac{n_p(s)+1}{2}\right]\right) \end{cases} \tag{84-3}$$

$$c_{km}(s, i_p) = \begin{cases} \sum_{l=1}^{[N_p(s)/2]} \sin(l(kn_p(s)\theta_2 + \pi))\cos(ml\theta_1) & (i_p = 0) \\ \sum_{l=1}^{[N_p(s)/2]} \sin\left(l\left(\left(\sum_{j=0}^{i_p-1} p(s, j) + k\right)n_p(s)\theta_2 + \pi\right)\right)\cos(ml\theta_1) & \left(0 < i_p < \left[\frac{n_p(s)+1}{2}\right]\right) \end{cases} \tag{84-4}$$

$$WGM(s) = (c_{km}(s, i_p))\ (0 \le k < P(s, i_p), 0 \le m < M) \tag{84-5}$$

A phase angle $\phi(s,i_p)$ corresponding to the pitch scale s and phase index $i_p$ is calculated by equation (85-1) below and is stored in a table. Also, a relation that provides $i_0$ which satisfies equation (85-2) below with respect to the pitch scale s and phase angle $\phi_p$ ($\in\{\phi(s,i_p)|s \in S, 0 \leqq i < n_p(s)\}$) is defined by equation (85-3) below and is stored in a table.

$$\phi(s, i_p) = \frac{2\pi}{n_p(s)} i_p \tag{85-1}$$

$$|\phi(s, i_0) - \phi_p| = \min_{0 \le i < n_p(s)} |\phi(s, i) - \phi_p| \tag{85-2}$$

$$i_0 = I(s, \phi_p) \tag{85-3}$$

Furthermore, the number $n_p(s)$ of phases, the number $P(s,i_p)$ of pitch waveform points, and the power normalization coefficient C(s) corresponding to the pitch scale s and phase index $i_p$ are stored in tables.

The waveform generation unit 9 determines the phase index $i_p$ by equation (86-1) below using the phase index $i_p$ and phase angle $\phi_p$ stored in the internal registers upon receiving the synthesis parameters p(m) ($0 \leqq m < M$) output from the synthesis parameter interpolation unit 7 and pitch scales s output from the pitch scale interpolation unit 8. Using the determined phase index $i_p$, the unit 9 reads out the number $P(s,i_p)$ of pitch waveform points and power normalization coefficient C(s) from the tables. If $i_p$ satisfies relation (86-2) below, the unit 9 reads out the waveform generation matrix $WGM(s,i_p)=(c_{km}(s,i_p))$ from the table, and generates a pitch waveform using equation (86-3) below:

$$i_p = I(s, \phi_p) \tag{86-1}$$

$$0 \le i_p < \left[\frac{n_p(s)+1}{2}\right] \tag{86-2}$$

-continued $$w_p(k) = C(s)\sum_{m=0}^{M-1} c_{km}(s, i_p)p(m)\ (0 \le k < P(s, i_p)) \tag{86-3}$$

On the other hand, if $i_p$ satisfies relation (87-1) below, the unit 9 defines k' by equation (87-2) below, reads out a waveform generation matrix $WGM(s,i_p)=(c_{k'm}(s,n_{p(s)})-1-i_p)$ from the table, and generates a pitch waveform using equation (87-3) below:

$$\left[\frac{n_p(s)+1}{2}\right] \le i_p < n_p(s) \tag{87-1}$$

$$k' = P(s, n_p(s) - 1 - i_p) - 1 - k\ (0 \le k < P(s, i_p)) \tag{87-2}$$

$$w_p(k) = -C(s)\sum_{m=0}^{M-1} c_{k'm}(s, n_p(s) - 1 - i_p)p(m)\ (0 \le k < P(s, i_p)) \tag{87-3}$$

After the pitch waveform is generated, the phase index is updated by equation (88-1) below, and the phase angle is updated by equation (88-2) below using the updated phase index.

$$i_p = \mathrm{mod}((i_p+1), n_p(s)) \tag{88-1}$$

$$\phi_p = \phi(s, i_p) \tag{88-2}$$

The above-mentioned operation will be explained with reference to the flow chart in FIG. 13. Note that the processing in steps S201 to S213 and steps S215 to S220 is the same as that in the second embodiment.

In step S214, the waveform generation unit 9 generates a pitch waveform using the synthesis parameters p[m]

($0 \leqq m < M$) obtained by equation (15) above and pitch scales s obtained by equation (17) above. More specifically, the waveform generation unit 9 reads out the number $P(s,i_p)$ of pitch waveform points and power normalization coefficient C(s) corresponding to the pitch scale s from the corresponding tables. When $i_p$ satisfies relation (86-2), the unit 9 reads out the waveform generation matrix $WGM(s,i_p)=(c_{km}(s,i_p))$ from the table, and generates a pitch waveform using equation (86-3) above.

On the other hand, when $i_p$ satisfies relation (87-1), the unit 9 calculates k' using equation (87-2) above, reads out the waveform generation matrix $WGM(s,i_p)=(c_{k'm}(s,n_p(s)-1-i_p))$ from the table, and generates a pitch waveform using equation (87-3) above.

Connection of pitch waveforms will be explained below. Let W(n) ($0 \leqq n$) be the speech waveform output as synthesized speech from the waveform generation unit 9. Connection of the pitch waveforms is done in the same manner as in the first embodiment, i.e., by equations (89) below using a frame length $N_j$ of the j-th frame:

$$\left.\begin{aligned} W(n_w+k) &= w_p(k) \quad (i=0,\ 0 \le k < P(s,i_p)) \\ W\left(\sum_{j=0}^{i-1} N_j + n_w + k\right) &= w_p(k) \quad (i>0,\ 0 \le k < P(s,i_p)) \end{aligned}\right\} \tag{89}$$

It follows from the foregoing that, according to the seventh embodiment, the same effects as in the second embodiment are expected, and waveform symmetry is utilized upon generating pitch waveforms, thus reducing the calculation volume required for generating a speech waveform.

[Eighth Embodiment]

The functional arrangement of a speech synthesis apparatus according to the seventh embodiment is the same as that in the first embodiment (FIG. 1). Pitch waveform generation done by the waveform generation unit 9 of the eighth embodiment will be explained below.

As in the first embodiment, let p(m) ($0 \leqq m < M$) be the synthesis parameter used in pitch waveform generation, let $f_s$ be the sampling frequency, $T_s$ ($1/f_s$) be the sampling period, let f be the pitch frequency of synthesized speech, let T (=1/f) be the pitch period, $N_p(f)$ be the number of pitch period points, and let θ be the angle per point when the pitch period is set in correspondence with an angle 2π. Also, a matrix Q and its inverse matrix are defined using equations (6-1) to (6-3) above.

Let $i_c(m_c)$ be a spectrum envelope index (formula (90-1)). Assume that $i_c(m_c)$ is a real value that satisfies $0 \leqq i_c(m_c) \leqq M-1$. Also, let $p_c(m_c)$ be the spectrum envelope whose pattern has changed (formula (90-2)). Note that $p_c(m_c)$ is calculated by equation (90-3) or (90-4) below.

$$i_c(m_c)\ (0 \le m_c < M) \tag{90-1}$$

$$p_c(m_c)\ (0 \le m_c < M) \tag{90-2}$$

$$p_c(m_c) = \sum_{t_c=0}^{M-1} \cos\left(t_c i_c(m_c)\frac{2\pi}{N}\right) \sum_{m=0}^{M-1} q_{inv}(t_c, m)p(m)\ (0 \le m_c < M) \tag{90-3}$$

$$p_c(m_c) = \sum_{m=0}^{M-1} p(m) \sum_{t_c=0}^{M-1} \cos\left(t_c i_c(m_c)\frac{2\pi}{N}\right) q_{inv}(t_c, m)\ (0 \le m_c < M) \tag{90-4}$$

Figure 20A:
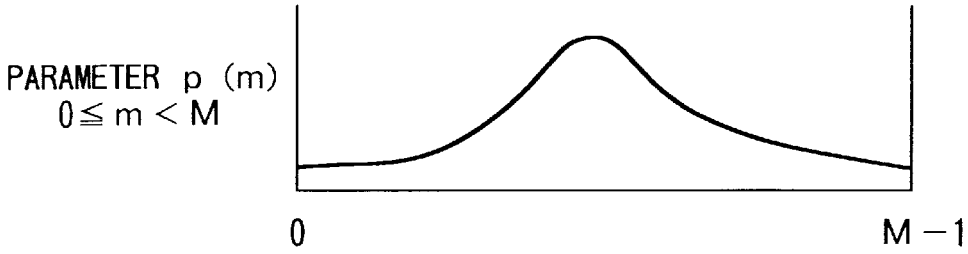
FIG. 20A is a graph showing an example of changes in a spectrum envelope pattern when N=16 and M=9 in the eighth embodiment.
Figure 20B:
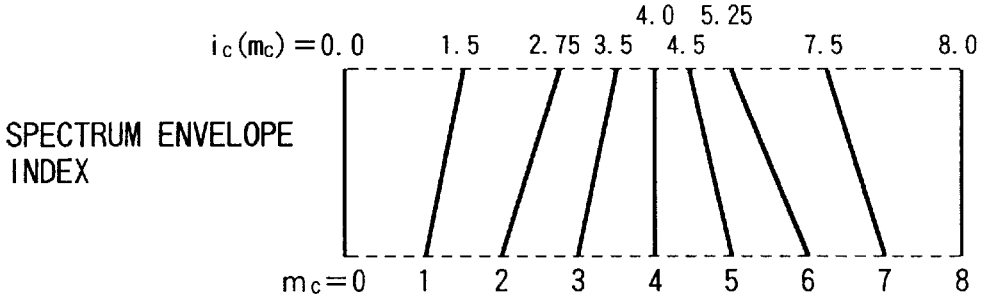
FIG. 20B is a graph showing an example of changes in a spectrum envelope pattern when N=16 and M=9 in the eighth embodiment.
Figure 20C:
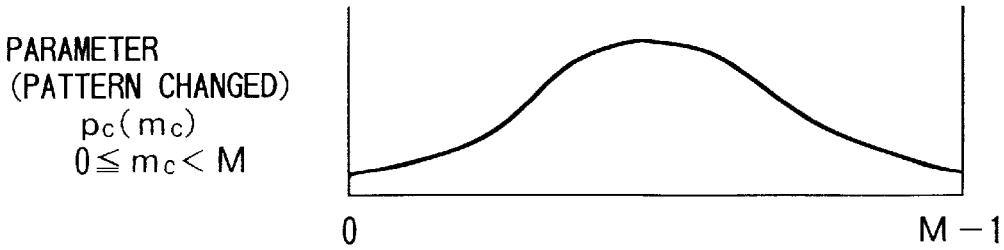
FIG. 20C is a graph showing an example of changes in a spectrum envelope pattern when N=16 and M=9 in the eighth embodiment.

FIGS. 20A to 20C show an example of change in spectrum envelope pattern when N=16 and M=9. The peak of the spectrum envelope has been broadened horizontally by designating the spectrum envelope indices. When the spectrum envelope whose pattern has changed is used, the value of the spectrum envelope corresponding to an integer multiple of the pitch frequency is given by the following equation (91-1) or (91-2):

$$e(l) = \sum_{t=0}^{M-1} \cos(tl\theta) \sum_{m_c=0}^{M-1} q_{inv}(t, m_c)p_c(m_c)\ (1 \le l \le [N_p(f)/2]) \tag{91-1}$$

$$e(l) = \sum_{t=0}^{M-1} \cos(tl\theta) \sum_{m_c=0}^{M-1} q_{inv}(t, m_c)p_c(m_c)\ (1 \le l \le [N_p(f)/2]) \tag{91-2}$$

Furthermore, equation (92-1) or (92-2) below is obtained when e(1) is calculated from the parameter p(m):

$$e(l) = \sum_{m_c=0}^{M-1} \left( \sum_{m=0}^{M-1} p(m) \sum_{t_c=0}^{M-1} \cos\left(t_c i_c(m_c) 2\frac{\pi}{N}\right) q_{inv}(t_c, m) \right) \sum_{t=0}^{M-1} \cos(tl\theta) q_{inv}(t, m_c)\ (1 \le l \le [N_p(f)/2]) \tag{92-1}$$

$$e(l) = \sum_{m=0}^{M-1} p(m) \sum_{m_c=0}^{M-1} \sum_{t_c=0}^{M-1} \cos\left(t_c i_c(m_c) 2\frac{\pi}{N}\right) q_{inv}(t_c, m) \sum_{t=0}^{M-1} \cos(tl\theta) q_{inv}(t, m_c)\ (1 \le l \le [N_p(f)/2]) \tag{92-2}$$

Assume that w(k) ($0 \leqq k < N_p(f)$) represents the pitch waveform. Also, C(f) represents a power normalization coefficient corresponding to the pitch frequency f, and is given by equation (8). The pitch waveform w(k) is generated by equations (93-1) to (93-3) below by superposing sine waves corresponding to integer multiples of the fundamental frequency:

$$w(k) = C(f) \sum_{l=1}^{[N_p(f)/2]} e(l)\sin(lk\theta) \tag{93-1}$$

-continued $$w(k) = C(f) \sum_{l=1}^{[N_p(f)/2]} \sin(lk\theta) \sum_{m=0}^{M-1} p(m) \sum_{m_c=0}^{M-1} \sum_{t_c=0}^{M-1} \cos\left(t_c i_c(m_c) \frac{2\pi}{N}\right) q_{inv}(t_c, m) \sum_{t=0}^{M-1} \cos(tl\theta) q_{inv}(t, m_c) \tag{93-2}$$

$$w(k) = C(f) \sum_{m=0}^{M-1} p(m) \sum_{t=1}^{[N_p(f)/2]} \sin(lk\theta) \sum_{m_c=0}^{M-1} \sum_{t_c=0}^{M-1} \cos\left(t_c i_c(m_c) \frac{2\pi}{N}\right) q_{inv}(t_c, m) \sum_{t=0}^{M-1} \cos(tl\theta) q_{inv}(t, m_c) \tag{93-3}$$

Alternatively, the pitch waveform w(k) ($0 \leqq k < N_p(f)$) is generated by equations (94-1) to (94-3) by superposing sine waves while shifting their phases by $\pi$:

$$\dot{w}(k) = C(f) \sum_{l=1}^{[N_p(f)/2]} e(l) \sin(l(k\theta + \pi)) \tag{94-1}$$

$$w(k) = C(f) \sum_{l=1}^{[N_p(f)/2]} \sin(l(k\theta + \pi)) \sum_{m=0}^{M-1} p(m) \sum_{m_c=0}^{M-1} \sum_{t_c=0}^{M-1} \cos\left(t_c i_c(m_c) \frac{2\pi}{N}\right) q_{inv}(t_c, m) \sum_{t=0}^{M-1} \cos(tl\theta) q_{inv}(t, m_c) \tag{94-2}$$

$$w(k) = C(f) \sum_{m=0}^{M-1} p(m) \sum_{t=1}^{[N_p(f)/2]} \sin(l(k\theta + \pi)) \sum_{m_c=0}^{M-1} \sum_{t_c=0}^{M-1} \cos\left(t_c i_c(m_c) \frac{2\pi}{N}\right) q_{inv}(t_c, m) \sum_{t=0}^{M-1} \cos(tl\theta) q_{inv}(t, m_c) \tag{94-3}$$

The waveform generation unit 9 attains high-speed calculations by executing the processing to be described below in place of directly calculating equation (93-3) or (94-3). Assume that a pitch scale s is used as a measure for expressing the voice pitch, and the waveform generation matrices WGM(s) corresponding to pitch scales s are calculated and stored in a table. If $N_p(s)$ represents the number of pitch period points corresponding to the pitch scale s, the angle $\theta$ per point is expressed by equation (95-1) below. Then, $c_{km}(s)$ is obtained by equation (95-2) below when equation (93-3) above is used or by equation (95-3) below when equation (94-3) above is used, and a waveform generation matrix is obtained by equation (95-4) below:

$$\theta = \frac{2\pi}{N_p(s)} \tag{95-1}$$

$$c_{km}(s) = \sum_{l=1}^{[N_p(f)/2]} \sin(lk\theta) \sum_{m_c=0}^{M-1} \sum_{t_c=0}^{M-1} \cos\left(t_c i_c(m_c) \frac{2\pi}{N}\right) q_{inv}(t_c, m) \sum_{t=0}^{M-1} \cos(tl\theta) q_{inv}(t, m_c) \tag{95-2}$$

$$c_{km}(s) = \sum_{l=1}^{[N_p(f)/2]} \sin(l(k\theta + \pi)) \sum_{m_c=0}^{M-1} \sum_{t_c=0}^{M-1} \cos\left(t_c i_c(m_c) \frac{2\pi}{N}\right) q_{inv}(t_c, m) \sum_{t=0}^{M-1} \cos(tl\theta) q_{inv}(t, m_c) \tag{95-3}$$

$$WGM(s) = (c_{km}(s)) \ (0 \leq k < N_p(s), 0 \leq m < M) \tag{95-4}$$

Furthermore, the number $N_p(s)$ of pitch period points and power normalization coefficient C(s) corresponding to the pitch scale s are stored in tables.

The waveform generation unit 9 reads out the number $N_p(s)$ of synthesis pitch period points let, power normalization coefficient C(s), and the waveform generation matrix WGM(s)=($c_{km}(s)$) from the tables upon receiving synthesis parameters p(m) ($0 \leqq m < M$) output from the synthesis parameter interpolation unit 7 and the pitch scales s output from the pitch scale interpolation unit 8, and generates a pitch waveform by calculating:

$$w(k) = C(s) \sum_{m=0}^{M-1} c_{km}(s) p(m) \ (0 \leq k < N_p(s)) \tag{96}$$

The above-mentioned operation will be explained below with reference to the flow chart in FIG. 7. Note that the processing in steps S1 to S11, and steps S14 to S17 is the same as that in the first embodiment. The processing in steps S12 and S13 according to the eighth embodiment will be explained below.

In step S12, the waveform generation unit 9 generates a pitch waveform using the synthesis parameter p[m] ($0 \leqq m < M$) obtained by equation (15) above and pitch scale s obtained by equation (17) above. More specifically, the waveform generation unit 9 reads out the number $N_p(s)$ of pitch period points the, power normalization coefficient C(s), and the waveform generation matrix WGM(s)=($C_{km}(s)$) ($0 \leqq k < N_p(s)$, $0 \leqq m < M$) corresponding to the pitch scale s from the corresponding tables, and generates a pitch waveform using equation (96) mentioned above.

Connection of pitch waveforms will be explained below. If W(n) represents the speech waveform output as synthesized speech from the waveform generation unit 9, connection of pitch waveforms is done by equation (97) using a frame length $N_j$ of the j-th frame:

$$\left.\begin{aligned} W(n_w+k) &= w(k) \quad (i=0,\ 0 \le k < N_p(s)) \\ W\left(\sum_{j=0}^{i-1} N_j + n_w + k\right) &= w(k) \quad (i>0,\ 0 \le k < N_p(s)) \end{aligned}\right\} \tag{97}$$

In step S13, the waveform point number storage unit 6 updates the number $n_w$ of waveform points by:

$$n_w = n_w + N_p(s) \tag{98}$$

As described above, according to the eighth embodiment, the same effects as in the first embodiment are expected. Also, since a means for changing the power spectrum envelope pattern of parameters is implemented upon generating pitch waveforms, and pitch waveforms are generated based on a power spectrum envelope whose pattern has changed, the parameters can be manipulated in the frequency domain. For this reason, an increase in calculation volume can be prevented upon changing the tone color of the synthesized speech.

[Ninth Embodiment]

The functional arrangement of a speech synthesis apparatus according to the ninth embodiment is the same as that in the first embodiment (FIG. 1). Pitch waveform generation performed by the waveform generation unit 9 of the ninth embodiment will be explained below.

As in the first embodiment, let p(m) ($0 \leqq m < M$) be the synthesis parameter used in pitch waveform generation, let $f_s$ be the sampling frequency, $T_s$ ($=1/f_s$) be the sampling period, let f be the pitch frequency of synthesized speech, let T ($=1/f$) be the pitch period, $N_p(f)$ be the number of pitch period points, and let θ be the angle per point when the pitch period is set in correspondence with an angle 2π. Also, a matrix Q and its inverse matrix are defined using equations (6-1) to (6-3) above. Furthermore, let $i_c(m)$ be a parameter index (formula (99-1)). Note that $i_c(m)$ is an integer which satisfies $0 \leqq i_c(m) \leqq M-1$. The value of a spectrum envelope corresponding to an integer multiple of the pitch frequency is expressed by equation (99-2) or (99-3) below:

$$i_c(m)\ (0 \le m < M) \tag{99-1}$$

$$e(l) = \sum_{t=0}^{M-1} \cos(tl\theta) \sum_{m=0}^{M-1} q_{inv}(t,m)\, p(i_c(m))\ (1 \le l \le [N_p(f)/2]) \tag{99-2}$$

-continued $$e(l) = \sum_{m=0}^{M-1} p(i_c(m)) \sum_{t=0}^{M-1} \cos(tl\theta)\, q_{inv}(t,m)\ (1 \le l \le [N_p(f)/2]) \tag{99-3}$$

Let w(k) ($0 \leqq k < M$) be the pitch waveform. If a power normalization coefficient C(f) corresponding to the pitch frequency f is given by equation (8) above, the pitch waveform w(k) is generated by equations (100-1) to (100-3) below by superposing sine waves corresponding to integer multiples of the fundamental frequency (FIG. 4):

$$w(k) = C(f) \sum_{l=1}^{[N_p(f)/2]} e(l)\sin(lk\theta) \tag{100-1}$$

$$w(k) = C(f) \sum_{l=1}^{[N_p(f)/2]} \sin(lk\theta) \sum_{m=0}^{M-1} p(i_c(m)) \sum_{t=0}^{M-1} \cos(tl\theta)\, q_{inv}(t,m) \tag{100-2}$$

$$w(k) = C(f) \sum_{m=0}^{M-1} p(i_c(m)) \sum_{l=1}^{[N_p(f)/2]} \sin(lk\theta) \sum_{t=0}^{M-1} \cos(tl\theta)\, q_{inv}(t,m) \tag{100-3}$$

Alternatively, by superposing sine waves while shifting their phases by π, the pitch waveform is generated by (FIG. 5):

$$w(k) = C(f) \sum_{l=1}^{[N_p(f)/2]} e(l)\sin(l(k\theta+\pi)) \tag{101-1}$$

$$w(k) = C(f) \sum_{l=1}^{[N_p(f)/2]} \sin(l(k\theta+\pi)) \sum_{m=0}^{M-1} p(i_c(m)) \sum_{t=0}^{M-1} \cos(tl\theta)\, q_{inv}(t,m) \tag{101-2}$$

$$w(k) = C(f) \sum_{m=0}^{M-1} p(i_c(m)) \sum_{l=1}^{[N_p(f)/2]} \sin(l(k\theta+\pi)) \sum_{t=0}^{M-1} \cos(tl\theta)\, q_{inv}(t,m) \tag{101-3}$$

The waveform generation unit 9 attains high-speed calculations by executing the processing to be described below in place of directly calculating equation (100-3) or (101-3). Assume that a pitch scale s is used as a measure for expressing the voice pitch, and waveform generation matrices WGM(s) corresponding to pitch scales s are calculated and stored in a table. If $N_p(s)$ represents the number of pitch period points corresponding to the pitch scale s, the angle θ per point is expressed by equation (102-1) below. Then, $c_{km}(s)$ is obtained by equation (102-2) below when equation (100-3) above is used or by equation (102-3) below when equation (101-3) above is used, and a waveform generation matrix is obtained by equation (102-4) below:

$$\theta = \frac{2\pi}{N_p(f)} \tag{102-1}$$

$$c_{km}(s) = \sum_{l=1}^{[N_p(s)/2]} \sin(lk\theta) \sum_{t=0}^{M-1} \cos(tl\theta)\, q_{inv}(t,m) \tag{102-2}$$

$$c_{km}(s) = \sum_{l=1}^{[N_p(s)/2]} \sin(l(k\theta+\pi)) \sum_{t=0}^{M-1} \cos(tl\theta)\, q_{inv}(t,m) \tag{102-3}$$

-continued $$WGM(s) = (c_{km}(s))\ (0 \le k < N_p(s),\ 0 \le m < M) \tag{102-4}$$

Furthermore, the number $N_p(s)$ of pitch period points and power normalization coefficient C(s) corresponding to the pitch scale s are stored in tables.

The waveform generation unit 9 reads out the number $N_p(s)$ of pitch period points, the power normalization coefficient C(s), and the waveform generation matrix WGM(s) $=(c_{km}(s))$ from the tables upon receiving synthesis parameters p(m) ($0 \leqq m < M$) output from the synthesis parameter interpolation unit 7 and the pitch scales s output from the pitch scale interpolation unit 8, and generates a pitch waveform by calculating (FIG. 6):

$$w(k) = C(s)\sum_{m=0}^{M-1} c_{km}(s)p(i_c(m))\ (0 \le k < N_p(s)) \tag{103}$$

The above-mentioned operation will be explained below with reference to the flow chart in FIG. 7. Note that the processing in steps S1 to S11, and steps S13 to S17 is the same as that in the first embodiment. The processing in step S12 according to the ninth embodiment will be explained below.

In step S12, the waveform generation unit 9 generates a pitch waveform using the synthesis parameter p[m] ($0 \leqq m < M$) obtained by equation (15) above and pitch scale s obtained by equation (17) above. More specifically, the waveform generation unit 9 reads out the number $N_p(s)$ of pitch period points, the power normalization coefficient C(s), and the waveform generation matrix WGM(s)$=(C_{km}(s))$ ($0 \leqq k \leqq N_p(s)$, $0 \leqq m < M$) corresponding to the pitch scale s from the corresponding tables, and generates a pitch waveform using equation (103) above.

Connection of pitch waveforms is done by equation (104) below using a speech waveform W(n) output as synthesized speech from the waveform generation unit 9, and a frame length $N_j$ of the j-th frame:

$$\left.\begin{aligned} W(n_w + k) &= w(k) && (i = 0,\ 0 \le k < N_p(s) \\ W\left(\sum_{j=0}^{i-1} N_j + n_w + k\right) &= w(k) && (i > 0,\ 0 \le k < N_p(s)) \end{aligned}\right\} \tag{104}$$

As may be apparent from the foregoing, according to the ninth embodiment, the same effects as in the first embodiment are expected. Also, the order of parameters can be changed upon generating pitch waveforms, and pitch waveforms can be generated using parameters whose order has changed. For this reason, the tone color of synthesized speech can be changed without largely increasing the calculation volume.

[10th Embodiment]

The block diagram that shows the functional arrangement of a speech synthesis apparatus according to the 10th embodiment is the same as that in the first embodiment (FIG. 1). Pitch waveform generation done by the waveform generation unit 9 of the 10th embodiment will be explained below.

As in the first embodiment, let p(m) ($0 \leqq m < M$) be the synthesis parameter used in pitch waveform generation, let $f_s$ be the sampling frequency, $T_s$ ($=1/f_s$) be the sampling period, let f be the pitch frequency of synthesized speech, let T ($=1/f$) be the pitch period, $N_p(f)$ be the number of pitch period points, and let θ be the angle per point when the pitch period is set in correspondence with an angle 2π. Also, a matrix Q and its inverse matrix are defined using equations (6-1) to (6-3) above.

Figure 21:
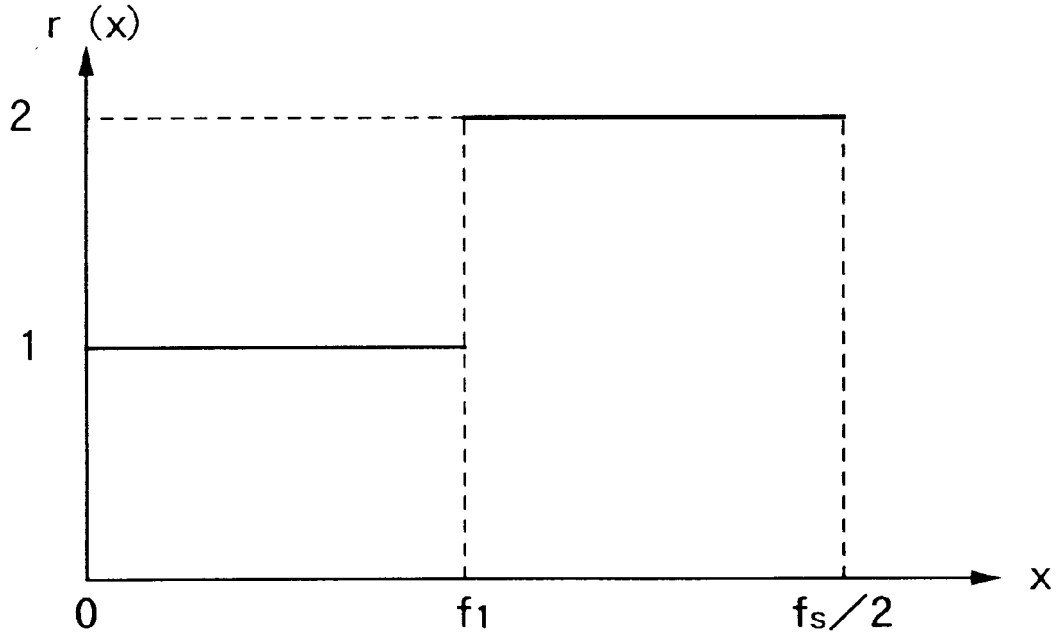
FIG. 21 is a graph showing an example of a frequency characteristic function used for manipulating synthesis parameters according to the 10th embodiment.

Furthermore, let r(x) be the frequency characteristic function used for manipulating synthesis parameters (formula (105-1)). FIG. 21 shows an example wherein the amplitude of a harmonic at a frequency of $f_1$ or higher is doubled. By changing r(x), the synthesis parameter can be manipulated. Using this function, the synthesis parameter is converted as in equation (105-2) below. Then, the value of a spectrum envelope corresponding to an integer multiple of the pitch frequency is expressed by equation (105-3) or (105-4):

$$r(x)\quad (0 \le x < f_s/2) \tag{105-1}$$

$$r\left(\frac{f_s}{N}m\right)p(m) \tag{105-2}$$

$$e(l) = \sum_{t=0}^{M-1} \cos(tl\theta)\sum_{m=0}^{M-1} q_{inv}(t, m)r\left(\frac{f_s}{N}m\right)p(m)\ (1 \le l \le [N_p(f)/2]) \tag{105-3}$$

$$e(l) = \sum_{m=0}^{M-1} r\left(\frac{f_s}{N}m\right)p(m)\sum_{t=0}^{M-1} \cos(tl\theta)q_{inv}(t, m)\ (1 \le l \le [N_p(f)/2]) \tag{105-4}$$

Assuming that a power normalization coefficient C(f) corresponding to the pitch frequency f is given by equation (8), the pitch waveform w(k) ($0 \leqq k < N_p(f)$) is generated by equations (106-1) to (106-3) below by superposing sine waves corresponding to integer multiples of the fundamental frequency:

$$w(k) = C(f)\sum_{l=1}^{[N_p(f)/2]} e(l)\sin(lk\theta) \tag{106-1}$$

$$w(k) = C(f)\sum_{l=1}^{[N_p(f)/2]} \sin(lk\theta)\sum_{m=0}^{M-1} r\left(\frac{f_s}{N}m\right)p(m)\sum_{t=0}^{M-1} \cos(tl\theta)q_{inv}(t, m) \tag{106-2}$$

$$w(k) = C(f)\sum_{m=0}^{M-1} r\left(\frac{f_s}{N}m\right)p(m)\sum_{l=1}^{[N_p(f)/2]} \sin(lk\theta)\sum_{t=0}^{M-1} \cos(tl\theta)q_{inv}(t, m) \tag{106-3}$$

Alternatively, the pitch waveform w(k) ($0 \leqq k < N_p(f)$) is generated by equations (107-1) to (107-3) by superposing sine waves while shifting their phases by π:

$$w(k) = C(f)\sum_{l=1}^{[N_p(f)/2]} e(l)\sin(l(k\theta + \pi)) \tag{107-1}$$

$$w(k) = C(f)\sum_{l=1}^{[N_p(f)/2]} \sin(l(k\theta + \pi))\sum_{m=0}^{M-1} r\left(\frac{f_s}{N}m\right)p(m)\sum_{t=0}^{M-1} \cos(tl\theta)q_{inv}(t, m) \tag{107-2}$$

-continued $$w(k) = C(f)\sum_{m=0}^{M-1} r\left(\frac{f_s}{N}m\right)p(m)\sum_{l=1}^{[N_p(f)/2]}\sin(l(k\theta+\pi))\sum_{t=0}^{M-1}\cos(tl\theta)q_{inv}(t,m) \quad (107\text{-}3)$$

The waveform generation unit 9 attains high-speed calculations by executing the processing to be described below in place of directly calculating equation (106-3) or (107-3). Assume that a pitch scale s is used as a measure for expressing the voice pitch, and the waveform generation matrices WGM(s) corresponding to pitch scales s are calculated and stored in a table. If $N_p(s)$ represents the number of pitch period points corresponding to the pitch scale s, the angle θ per point is expressed by equation (108-1) below. Then, $c_{km}(s)$ is obtained by equation (108-3) below when equation (106-3) above is used or by equation (108-4) below when equation (107-3) above is used, and a waveform generation matrix is obtained by equation (108-5) below:

$$\theta = \frac{2\pi}{N_p(s)} \quad (108\text{-}1)$$

$$r(x)\ (0 \le x \le f_s/2) \quad (108\text{-}2)$$

$$c_{km}(s) = \sum_{l=1}^{[N_p(s)/2]}\sin(lk\theta)\sum_{t=0}^{M-1}\cos(tl\theta)q_{inv}(t,m) \quad (108\text{-}3)$$

$$c_{km}(s) = \sum_{l=1}^{[N_p(s)/2]}\sin(l(k\theta+\pi))\sum_{t=0}^{M-1}\cos(tl\theta)q_{inv}(t,m) \quad (108\text{-}4)$$

$$WGM(s) = (c_{km}(s))\ (0 \le k < N_p(s),\ 0 \le m < M) \quad (108\text{-}5)$$

Furthermore, the number $N_p(s)$ of pitch period points and power normalization coefficient C(s) corresponding to the pitch scale s are stored in tables.

The waveform generation unit 9 reads out the number $N_p(s)$ of synthesis pitch period points, the power normalization coefficient C(s), and the waveform generation matrix WGM(s)=($c_{km}(s)$) from the tables upon receiving synthesis parameters p(m) (0≦m<M) output from the synthesis parameter interpolation unit 7 and the pitch scales s output from the pitch scale interpolation unit 8, and generates, using the frequency characteristic function r(x) (0≦x≦$f_s$/2), a pitch waveform (FIG. 6) by calculating:

$$w(k) = C(s)\sum_{m=0}^{M-1} c_{km}(s)r\left(\frac{f_s}{N}m\right)p(m)\ (0 \le k < N_p(s)) \quad (109)$$

The above-mentioned operation will be explained below with reference to the flow chart in FIG. 7. Note that the processing in steps S1 to S11, and steps S13 to S17 is the same as that in the first embodiment. The processing in step S12 according to the 10th embodiment will be explained below.

In step S12, the waveform generation unit 9 generates a pitch waveform using the synthesis parameter p[m] (0≦m<M) obtained by equation (15) above and pitch scale s obtained by equation (17) above. More specifically, the waveform generation unit 9 reads out the number $N_p(s)$ of pitch period points, the power normalization coefficient C(s), and the waveform generation matrix WGM(s)=($C_{km}$(s)) (0≦k≦$N_p$(s), 0≦m<M) corresponding to the pitch scale s from the corresponding tables, and generates a pitch waveform by equation (109) above using the frequency characteristic function r(x) (0≦x≦$f_s$/2).

On the other hand, connection of the pitch waveforms is done, as shown in FIG. 11. That is, connection of the pitch waveforms is done by equation (110) below using a speech waveform W(n) output as synthesized speech from the waveform generation unit 9, and a frame length $N_j$ of the j-th frame:

$$\left.\begin{aligned} W(n_w+k) &= w(k) && (i=0,\ 0 \le k < N_p(s)) \\ W\left(\sum_{j=0}^{i-1}N_j + n_w + k\right) &= w(k) && (i>0,\ 0 \le k < N_p(s)) \end{aligned}\right\} \quad (110)$$

As described above, according to the 10th embodiment, the same effects as in the first embodiment are expected. Also, a function for determining the frequency characteristics is used upon generating pitch waveforms, parameters are converted by applying function values at frequencies corresponding to the individual elements of the parameters to these elements, and pitch waveforms can be generated based on the converted parameters. For this reason, the tone color of synthesized speech can be changed without largely increasing the calculation volume.

In summary, according to the present invention, since pitch waveforms are generated and connected on the basis of the pitch of synthesized speech and parameters, the sound quality of synthesized speech can be prevented from deteriorating.

Also, since the products of the waveform generation matrices and parameters are calculated in units of pitches, the calculation volume required for generating a speech waveform can be reduced.

As many apparently widely different embodiments of the present invention can be made without departing from the spirit and scope thereof, it is to be understood that the invention is not limited to the specific embodiments thereof except as defined in the appended claims.

What is claimed is:

1. A speech synthesis apparatus for outputting synthesized speech on the basis of a parameter sequence of a speech waveform, comprising:

pitch waveform generation means for generating pitch waveforms on the basis of waveform and pitch parameters which are included in the parameter sequence used in speech synthesis and represent a power spectrum envelope of speech in the frequency domain, said pitch waveform generation means generating the pitch waveform by, a) calculating the product sum of the waveform parameters and an inverse matrix of a matrix representing a cosine series expansion, b) obtaining sample values of the speech envelope, which correspond to integer multiples of the pitch frequency of synthesized speech, by calculating the product sum of said calculated product sum and cosine function, and c) generating pitch waveform based on the obtained sample value; and speech waveform generatiom means for generating a speech waveform by connecting the pitch waveforms generated by said pitch waveform generation means.

2. The apparatus according to claim 1, wherein said pitch waveform generatiom means samples the power spectrum envelope on the basis of a pitch frequency of the synthesized speech determined by the pitch parameters, and transforms the samples values into a waveform in the time domain by Fourier transformation to obtain the pitch waveform.

3. The apparatus according to claim 1, wherein said pitch waveform generation means generates the pitch waveform by Fourier transformation of the sample values.

4. The apparatus according to claim 1, wherein said pitch waveform generation means calculates a sum of sine series having sample values of the power spectrum envelope as coefficients upon generating the pitch waveform on the basis of the power spectrum envelope.

5. The apparatus according to claim 4, wherein the sine series use sine series, phases of which are respectively shifted from each other by half a period.

6. The apparatus according to claim 1, wherein said pitch waveform generation means generates the pitch waveform by obtaining a product sum of a sine series having the sample values as coefficients.

7. The apparatus according to claim 6, further comprising:

storage means for storing waveform generation matrices obtained by calculating in advance product sums of the cosine function and sine series in units of pitch parameters, and wherein said pitch waveform generation means generates the pitch waveform by obtaining a product of the waveform generation matrix corresponding to the pitch parameter obtained from said storage means, and the waveform parameter.

8. The apparatus according to claim 1, further comprising waveform parameter interpolation means for interpolating the waveform parameters representing a spectrum envelope in units of periods of the pitch waveforms upon generating the pitch waveforms by said pitch waveform generation means.

9. The apparatus according to claim 1, further comprising pitch parameter interpolation means for interpolating the pitch parameters representing pitches of the synthesized speech in units of periods of the pitch waveforms upon generating the pitch waveforms by said pitch waveform generation means.

10. The apparatus according to claim 1, wherein when one period of the pitch waveform is not an integer multiple of a sampling period, said pitch waveform generation means generates a phase-shifted pitch waveform on the basis of a shift amount between the period of the pitch waveform and the sampling period.

11. The apparatus according to claim 10, wherein the phase-shifted pitch waveform is obtained by connecting n pitch waveforms, and a period thereof is an integer multiple of the sampling frequency.

12. The apparatus according to claim 1, further comprising:

unvoiced waveform generation means for generating an unvoiced waveform for one pitch period on the basis of waveform and pitch parameters included in the parameter sequence used in speech synthesis, and wherein said speech waveform generation means generates the speech waveform of the synthesized speech by connecting the pitch waveforms generated by said pitch waveform generation means and the unvoiced waveform generated by said unvoiced waveform generation means on the basis of an order of the parameter sequence.

13. The apparatus according to claim 12, wherein the waveform parameters in said unvoiced waveform generation means represent a power spectrum envelope of speech in the frequency domain, and said unvoiced waveform generation means generates the unvoiced waveform on the basis of the power spectrum envelope.

14. The apparatus according to claim 12, wherein a pitch frequency of the unvoiced waveform is lower than the audible frequency range.

15. The apparatus according to claim 14, wherein said unvoiced waveform generation means generates the unvoiced waveform by calculating a product sum of sample values corresponding to integer multiples of the pitch frequency of the unvoiced waveform on the power spectrum envelope, and sine functions which are given random phase shifts.

16. The apparatus according to claim 15, wherein the sample values on the power spectrum envelope are obtained by calculating product sums of the waveform parameters and a cosine function.

17. The apparatus according to claim 16, further comprising:

storage means for storing waveform generation matrices obtained by calculating in advance product sums of the cosine function and sine functions in units of pitch parameters, and wherein said pitch waveform generation means generates the pitch waveform by obtaining a product of the waveform generation matrix corresponding to the pitch parameter obtained from said storage means, and the waveform parameter.

18. The apparatus according to claim 1, wherein the waveform parameters represent a power spectrum envelope of speech in the frequency domain, and said pitch waveform generation means acquires sample values corresponding to integer multiples of a pitch frequency of the synthesized speech from the power spectrum envelope, uses the acquired sample values as coefficients of a cosine series, and generates the pitch waveform on the basis of a product sum of the coefficients and the cosine function.

19. The apparatus according to claim 18, wherein the cosine series use a cosine series, phases of which are respectively shifted from each other by half a period.

20. The apparatus according to claim 18, wherein the sample values on the power spectrum envelope are product sums of the waveform parameters and the cosine function.

21. The apparatus according to claim 20, further comprising:

storage means for storing waveform generation matrices obtained by calculating in advance product sums of cosine series having as coefficients the power spectrum envelope and sine series having as coefficients sample values of the power spectrum envelope in units of pitch parameters, and wherein said pitch waveform generation means generates the pitch waveform by obtaining a product of the waveform generation matrix corresponding to the pitch parameter obtained from said storage means, and the waveform parameter.

22. The apparatus according to claim 18, wherein said pitch waveform generation means comprises correction means for correcting an amplitude value of the pitch waveform on the basis of an amplitude value of the next pitch waveform.

23. The apparatus according to claim 22, wherein said correction means corrects a value of the pitch waveform at each sample point on the basis of a ratio between 0th-order amplitude values of adjacent pitch waveforms.

24. The apparatus according to claim 1, wherein the waveform parameters represent a power spectrum envelope of speech in the frequency domain, and said pitch waveform generation means generates half-period pitch waveforms each having a period half a pitch period of the synthesized speech on the basis of the power spectrum envelope, and said speech waveform generation means generates one-period pitch waveforms each for one period by symmetrically connecting the half-period pitch waveforms, and generates the speech waveform by connecting the one-period pitch waveforms.

25. The apparatus according to claim 1, wherein when one period of the pitch waveform is not an integer multiple of a sampling period, said pitch waveform generation means connects n pitch waveforms so that a period of the connected waveform equals an integer multiple of the sampling period and generates a pitch waveform obtained by connecting pitch waveforms up to a value corresponding to an integer part of (n+1)/2, and said speech waveform generation means generates n pitch waveforms by connecting the pitch waveform obtained by connecting pitch waveforms up to the value corresponding to the integral part of (n+1)/2, and a symmetric waveform, and generates the speech waveform by connecting the n pitch waveforms.

26. The apparatus according to claim 1, wherein the waveform parameters represent a power spectrum envelope of speech in the frequency domain, and said apparatus further comprises changing means for changing a pattern of the power spectrum envelope used in said pitch waveform generation means.

27. The apparatus according to claim 26, wherein said pitch waveform generation means obtains sample values on the power spectrum envelope, which has been changed by said changing means, by calculating product sums of the waveform parameters and a cosine function, and generates the pitch waveforms by calculating product sums of the sample values and a sine function.

28. The apparatus according to claim 27, further comprising:

storage means for storing waveform generation matrices obtained by calculating in advance product sums of the cosine and sine functions in units of pitch parameters and power spectrum envelopes obtained by said changing means, and wherein said pitch waveform generation means generates the pitch waveform by calculating a product of the waveform generation matrix corresponding to the pitch parameter and the waveform parameters.

29. The apparatus according to claim 1, wherein said pitch waveform generation means comprises means for changing an order of parameters, and generates the pitch waveforms on the basis of the parameters, the order of which has changed.

30. The apparatus according to claim 1, wherein the waveform parameters are coefficients corresponding to orders of series representing a power spectrum envelope of speech in the frequency domain, and said pitch waveform generation means generates the pitch waveforms of the synthesized speech on the basis of the power spectrum envelope, and said apparatus further comprises changing means for changing coefficients of the waveform parameters.

31. The apparatus according to claim 30, wherein said changing means applies a function having as coefficients the orders of the series representing the power spectrum envelope to the coefficients of the waveform parameters.

32. A speech synthesis method for outputting synthesized speech on the basis of a parameter sequence of a speech waveform, comprising:

a pitch waveform generation step of generating pitch waveforms on the basis of waveform and pitch parameters which are included in the parameter sequence used in speech synthesis and represent a power spectrum envelope of speech in the frequency domain, said pitch waveform generation step generating the pitch waveform by, a) calculating the product sum of the waveform parameters and an inverse matrix of a matrix representing a cosine series expansion, b) obtaining sample values of the speech envelope, which correspond to integer multiples of the pitch frequency of synthesized speech, by calculating the product sum of said calculated product sum and cosine function, and c) generating pitch waveform based on the obtained sample value; and a speech waveform generation step of generating a speech waveform by connecting the pitch waveforms generated in the pitch waveform generation step.

33. The method according to claim 32, wherein the pitch waveform generation step includes the step of sampling the power spectrum envelope on the basis of a pitch frequency of the synthesized speech determined by the pitch parameters, and transforming the sampled values into a waveform in the time domain by Fourier transformation to obtain the pitch waveform.

34. The method according to claim 32, wherein the pitch waveform generation step includes the step of generating the pitch waveform by Fourier transformation of the calculated sample values.

35. The method according to claim 32, wherein the pitch waveform generation step includes the step of generating the pitch waveform by calculating a sum of sine series having sample values of the power spectrum envelope as coefficients upon generating the pitch waveform on the 5 basis of the power spectrum envelope.

36. The method according to claim 35, wherein the sine series are sine series, phases of which are respectively shifted from each other by half a period.

37. The method according to claim 32, wherein the pitch waveform generation step includes the step of generating the pitch waveform by calculating a product sum of sine series using the calculated sample values as coefficients.

38. The method according to claim 37, further comprising:

the storage step of storing waveform generation matrices obtained by calculating in advance product sums of the cosine function and sine series in units of pitch parameters, and wherein the pitch waveform generation step includes the step of generating the pitch waveform by obtaining a product of the waveform generation matrix corresponding to the pitch parameter obtained in the storage step, and the waveform parameter.

39. The method according to claim 32, further comprising the waveform parameter interpolation step of interpolating the waveform parameters representing a spectrum envelope in units of periods of the pitch waveforms upon generating the pitch waveforms in the pitch waveform generation step.

40. The method according to claim 32, further comprising the pitch parameter interpolation step of interpolating the pitch parameters representing pitches of the synthesized speech in units of periods of the pitch waveforms upon generating the pitch waveforms in the pitch waveform generation step.

41. The method according to claim 32, wherein the pitch waveform generation step includes the step of generating a phase-shifted pitch waveform on the basis of a shift amount between the period of the pitch waveform and the sampling period, when one period of the pitch waveform is not an integer multiple of a sampling period.

42. The method according to claim 41, wherein the phase-shifted pitch waveform is obtained by connecting n pitch waveforms, and a period thereof is an integer multiple of the sampling frequency.

43. The method according to claim 32, further comprising:

the unvoiced waveform generation step of generating an unvoiced waveform for one pitch period on the basis of waveform and pitch parameters included in the parameter sequence used in speech synthesis, and wherein the speech waveform generation step includes the step of generating the speech waveform of the synthesized speech by connecting the pitch waveforms generated in the pitch waveform generation step and the unvoiced waveform generated in the unvoiced waveform generation step on the basis of an order of the parameter sequence.

44. The method according to claim 43, wherein the waveform parameters in the unvoiced waveform generation step represent a power spectrum envelope of speech in the frequency domain, and the unvoiced waveform generation step includes the step of generating the unvoiced waveform on the basis of the power spectrum envelope.

45. The method according to claim 44, wherein a pitch frequency of the unvoiced waveform is lower than the audible frequency range.

46. The method according to claim 45, wherein the unvoiced waveform generation step includes the step of generating the unvoiced waveform by calculating a product sum of sample values corresponding to integer multiples of the pitch frequency of the unvoiced waveform on the power spectrum envelope, and sine functions which are given random phase shifts.

47. The method according to claim 46, wherein the sample values on the power spectrum envelope are obtained by calculating product sums of the waveform parameters and a cosine function.

48. The method according to claims 47, further comprising:

the storage step of storing waveform generation matrices obtained by calculating in advance product sums of the cosine function and sine functions in units of pitch parameters, and wherein the pitch waveform generation step includes the step of generating the pitch waveform by obtaining a product of the waveform generation matrix corresponding to the pitch parameter obtained in the storage step, and the waveform parameter.

49. The method according to claim 32, wherein the waveform parameters represent a power spectrum envelope of speech in the frequency domain, and the pitch waveform generation step includes the step of acquiring sample values corresponding to integer multiples of a pitch frequency of the synthesized speech from the power spectrum envelope, using the acquired sample values as coefficients of cosine series, and generating the pitch waveform on the basis of a product sum of the coefficients and a cosine function.

50. The method according to claim 49, wherein the cosine series use cosine series, phases of which are respectively shifted from each other by half a period.

51. The method according to claim 49, wherein the sample values on the power spectrum envelope are product sums of the waveform parameters and a cosine function.

52. The method according to claim 51, further comprising:

the storage step of storing waveform generation matrices obtained by calculating in advance product sums of cosine series having as coefficients the power spectrum envelope and sine series having as coefficients sample values of the power spectrum envelope in units of pitch parameters, and wherein the pitch waveform generation step includes the step of generating the pitch waveform by obtaining a product of the waveform generation matrix corresponding to the pitch parameter obtained in the storage step, and the waveform parameter.

53. The method according to claim 49, wherein the pitch waveform generation step comprises the correction step of correcting an amplitude value of the pitch waveform on the basis of an amplitude value of the next pitch waveform.

54. The method according to claim 53, wherein the correction step includes the step of correcting a value of the pitch waveform at each sample point on the basis of a ratio between 0th-order amplitude values of adjacent pitch waveforms.

55. The method according to claim 32, wherein the waveform parameters represent a power spectrum envelope of speech in the frequency domain, and the pitch waveform generation step includes the step of generating half-period pitch waveforms each having a period half a pitch period of the synthesized speech on the basis of the power spectrum envelope, and the speech waveform generation step includes the step of generating one-period pitch waveforms each for one period by symmetrically connecting the half-period pitch waveforms, and generating the speech waveform by connecting the one-period pitch waveforms.

56. The method according to claim 32, wherein the pitch waveform generation step includes the step of connecting n pitch waveforms so that a period of the connected waveform equals an integer multiple of the sampling period, when one period of the pitch waveform is not an integer multiple of a sampling period, and generating a pitch waveform obtained by connecting pitch waveforms up to a value corresponding to an integer part of (n+1)/2, and the speech waveform generation step includes the step of generating n pitch waveforms by connecting the pitch waveforms obtained by connecting pitch waveforms up to the value corresponding to the integral part of (n+1)/2, and a symmetric waveform, and generating the speech waveform by connecting the n pitch waveforms.

57. The method according to claim 37, wherein the waveform parameters represent a power spectrum envelope of speech in the frequency domain, and said method further comprises the changing step of changing a pattern of the power spectrum envelope used in the pitch waveform generation step.

58. The method according to claim 57, wherein the pitch waveform generation step includes the step of obtaining sample values on the power spectrum envelope, which has been changed in the changing step, by calculating product sums of the waveform parameters and a cosine function, and generating the pitch waveforms by calculating product sums of the sample values and a sine function.

59. The method according to claim 58, further comprising:

the storage step of storing waveform generation matrices obtained by calculating in advance product sums of the cosine and sine functions in units of pitch parameters and power spectrum envelopes obtained in the changing step, and wherein the pitch waveform generation step includes the step of generating the pitch waveform by calculating a product of the waveform generation matrix corresponding to the pitch parameter and the waveform parameters.

60. The method according to claim 32, wherein the pitch waveform generation step comprises the step of changing an order of parameters, so as to generate the pitch waveforms on the basis of the parameters, the order of which has changed.

61. The method according to claim 32, wherein the waveform parameters are coefficients corresponding to orders of series representing a power spectrum envelope of speech in the frequency domain, and the pitch waveform generation step includes the step of generating the pitch waveforms of the synthesized speech on the basis of the power spectrum envelope, and said method further comprises the changing step of changing coefficients of the waveform parameters.

62. The method according to claim 61, wherein the changing step includes the step of applying a function having as coefficients the orders of the series representing the power spectrum envelope to the coefficients of the waveform parameters.

63. A computer readable memory which stores a control program for outputting synthesized speech on the basis of a parameter sequence of a speech waveform, said control program making a computer serve as:

pitch waveform generation means for generating pitch waveforms on the basis of waveform and pitch parameters which are included in the parameter sequence used in speech synthesis and represent a power spectrum envelope of speech in the frequency domain, said pitch waveform generation means generating the pitch waveform by, a) calculating the product sum of the waveform parameters and an inverse matrix of a matrix representing a cosine series expansion, b) obtaining sample values of the speech envelope, which correspond to integer multiples of the pitch frequency of synthesized speech, by calculating the product sum of said calculated product sum and cosine function, and c) generating pitch waveform based on the obtained sample value; and speech waveform generation means for generating a speech waveform by connecting the pitch waveforms generated by said pitch waveform generation means.

* * * * *

UNITED STATES PATENT AND TRADEMARK OFFICE

CERTIFICATE OF CORRECTION

PATENT NO. : 6,021,388

DATED : February 1, 2000

INVENTOR(S) : Mitsuru OTSUKA, et al.

It is certified that error appears in the above-identified patent and that said Letters Patent is hereby corrected as shown below:

COLUMN 4:

Line 2, "a" should read --an--.

COLUMN 9:

Line 41, "by performed the" should read --performed by the--.

COLUMN 20:

Line 65, "C(f)" should read --let C(f)--.

COLUMN 28:

Line 15, at line 3 of equation 75, "-w($N_p$(s)-k" should read -- -w($N_p$(s)-k)--.

UNITED STATES PATENT AND TRADEMARK OFFICE

CERTIFICATE OF CORRECTION

PATENT NO. : 6,021,388

DATED : February 1, 2000

INVENTOR(S) : Mitsuru OTSUKA, et al.

It is certified that error appears in the above-identified patent and that said Letters Patent is hereby corrected as shown below:

COLUMN 35:

Line 29, at equation (94-3) "$\sum_{t=1}^{|1Np(f)/2|}$" should read -- $\sum_{l=1}^{|1Np(f)/2|}$ --.

Line 63, "points let," should read --points, let--.

COLUMN 36:

Line 62, "points the," should read --points, the--.

COLUMN 43:

Line 3, "samples" should read --sampled--.

COLUMN 47:

Line 47, "claims 47 ," should read --claim 47,--.

UNITED STATES PATENT AND TRADEMARK OFFICE

CERTIFICATE OF CORRECTION

PATENT NO. : 6,021,388

DATED : February 1, 2000

INVENTOR(S) : Mitsuru OTSUKA, et al.

It is certified that error appears in the above-identified patent and that said Letters Patent is hereby corrected as shown below:

COLUMN 48:

Line 55, "claims 37," should read --claim 32,--.

Signed and Sealed this

Fifteenth Day of May, 2001

Nicholas P. Godici

*Attest:*

NICHOLAS P. GODICI

*Attesting Officer*

*Acting Director of the United States Patent and Trademark Office*